US009013516B2

(12) United States Patent
Sakamoto et al.

(10) Patent No.: US 9,013,516 B2
(45) Date of Patent: Apr. 21, 2015

(54) IMAGE DISPLAY DEVICE HAVING MEMORY PROPERTY

(75) Inventors: Michiaki Sakamoto, Kanagawa (JP); Koji Shigemura, Kanagawa (JP); Setsuo Kaneko, Kanagawa (JP); Tetsushi Sato, Kanagawa (JP); Kenichi Takatori, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 573 days.

(21) Appl. No.: 13/369,030

(22) Filed: Feb. 8, 2012

(65) Prior Publication Data

US 2012/0200610 A1 Aug. 9, 2012

(30) Foreign Application Priority Data

Feb. 8, 2011 (JP) ..... 2011-025513
Jan. 20, 2012 (JP) ..... 2012-010530

(51) Int. Cl.
*G09G 5/10* (2006.01)
*G09G 3/34* (2006.01)
*G09G 3/20* (2006.01)

(52) U.S. Cl.
CPC ..... *G09G 3/344* (2013.01); *G09G 3/2018* (2013.01); *G09G 2300/08* (2013.01); *G09G 2300/0876* (2013.01); *G09G 2310/08* (2013.01)

(58) Field of Classification Search
CPC ..... G09G 3/34; G09G 3/044
See application file for complete search history.

(56) References Cited

U.S. PATENT DOCUMENTS 8,599,129 B2 * 12/2013 Miyamoto ..... 345/107
8,717,280 B2 * 5/2014 de Zeeuw et al. ..... 345/107

(Continued)

FOREIGN PATENT DOCUMENTS

JP 4049202 12/2007
JP 2009-047737 3/2009

(Continued)

OTHER PUBLICATIONS

Extended European Search Report dated May 31, 2012; Application No. 12154499.3.

(Continued)

*Primary Examiner* — Kent Chang
*Assistant Examiner* — Nathan Brittingham
(74) *Attorney, Agent, or Firm* — Young & Thompson

(57) ABSTRACT

An image display device expresses multiple colors including intermediate colors and an electrophoretic particle making up the image display device includes n-kinds of (n>2) charged particles each having colors and threshold value voltages each being different from one another. A specified period during which a voltage is applied includes a resetting period for applying a resetting voltage, a first, . . . , $k^{th}$, . . . , $n^{th}$ voltage applying periods and a voltage to be applied includes a resetting voltage, 0V, first voltage (absolute value) to be applied within the first voltage applying period, 0V, $k^{th}$ voltage (absolute value) to be applied within $k^{th}$ voltage applying period, and 0V voltage, $n^{th}$ voltage (absolute value) to be applied within an $n^{th}$ voltage applying period. Relationships:

$$|\text{first applied voltage}|>|k^{th}\text{ applied voltage}|>|n^{th}\text{ voltage}|$$

and $$|\text{first applied voltage}|<|k^{th}\text{ voltage}|<|n^{th}\text{ voltage}|$$

are satisfied.

21 Claims, 24 Drawing Sheets

| W | | | I-1 | | | I-2 | | | N | | |
|---|---|---|---|---|---|---|---|---|---|---|---|
| C | M | Y | C | M | Y | C | M | Y | C | M | Y |
| 0 | 0 | 0 | 0.5 | 0.5 | 0.5 | 1 | 1 | 0.5 | 0.5 | 1.0 | 0.5 |

(56) References Cited

U.S. PATENT DOCUMENTS

| | | | | |
|---|---|---|---|---|
| 2007/0200874 | A1* | 8/2007 | Amundson et al. | 345/690 |
| 2008/0112040 | A1* | 5/2008 | Suwabe et al. | 359/296 |
| 2008/0117165 | A1 | 5/2008 | Machida et al. | |

FOREIGN PATENT DOCUMENTS

| | | | |
|---|---|---|---|
| JP | 2009-145751 | | 7/2009 |
| JP | 2009145751 | A * | 7/2009 |
| JP | 4385438 | | 10/2009 |

OTHER PUBLICATIONS

EP Office Action dated Jan. 6, 2014; Application No. 12154499.3.

"Alternative Flat Panel Display Technologies" In: Willem den Boer: "Active Matrix Liquid Crystal Displays: Fundamentals and Applications", 2005, Newnes, U.S.A., XP002676120, ISBN: 0750678135 pp. 197-221.

"AMLCD Electronics" In: Willem den Boer: "Active Matrix Liquid Crystal Displays: Fundamentals and Applications", 2005, Newnes, U.S.A., XP002676121, ISBN: 0750678135 pp. 87-111.

* cited by examiner

| W (or K) | | | I-1 | | | I-2 | | | N | | |
|---|---|---|---|---|---|---|---|---|---|---|---|
| C | M | Y | C | M | Y | C | M | Y | C | M | Y |
| 0 (1) | 0 (1) | 0 (1) | Ry | Ry | Ry | Rm | Rm | Ry | Rc | Rm | Ry |

| W | | | I-1 | | | I-2 | | | N | | |
|---|---|---|---|---|---|---|---|---|---|---|---|
| C | M | Y | C | M | Y | C | M | Y | C | M | Y |
| 0 | 0 | 0 | 0.5 | 0.5 | 0.5 | 1 | 1 | 0.5 | 0.5 | 1.0 | 0.5 |

[Intermediate Transition State]

IMAGE DISPLAY DEVICE HAVING MEMORY PROPERTY

INCORPORATION BY REFERENCE

This application is based upon and claims the benefit of priorities from Japanese Patent Application Nos. 2011-025513, filed on Feb. 8, 2011 and 2012-010530 filed on Jan. 20, 2012, the disclosures of which are incorporated herein in its entirety by reference.

BACKGROUND OF THE INVENTION

1. Field of the Invention

The present invention relates to an image display device having a memory property and more particularly to the image display device having the memory property that can be suitably used for electronic paper display device such as electronic books, electronic newspaper, and the like.

2. Description of the Related Art

As a display device capable of doing a deed of "reading" without stress, an electronic paper display device referred to as an electronic book, electronic newspaper and the like is now under development. Since it is necessary that the electronic paper display of this kind is thin, lightweight, hard to crack, and low in power consumption, its construction by using a display element having a memory property is desirable. As a display element to be used in a device having a memory property, conventionally, an electrophoretic display element or cholesteric. liquid crystal or the like is known, however, in recent years, electrophoretic display elements of two or more kinds are attracting attention. In this specification, the electrophoretic display element conceptually contains a device such as a powder element that can achieve displaying by causing electrically charged particles to move in a solvent or the like.

Hereinafter, an electrophoretic display device of a type that displays white and black colors by active-matrix driving method is described. The electrophoretic display device is so configured that a TFT (Thin-Film Transistor) glass substrate, electrophoretic display element film, and facing substrate are stacked in layers in this order. On the TFT glass substrate, TFTs serving as a plurality of switching elements arranged in a matrix manner, pixel electrodes, gate lines, and data lines are mounted. The electrophoretic display device is constructed in a manner in which micro capsules being about 40 μm in size spread in a polymer binder. A solvent is injected into an inner portion of each of the microcapsules and, in the solvent, two kinds of positively and negatively-charged nanoparticles, that is, a white pigment made up of negatively charged titanium dioxide particles and a black pigment made up of positively charged carbon particles are confined within a dispersed and floated state. Moreover, on the facing substrate, a facing electrode (common electrode) to provide a reference potential is formed.

The electrophoretic display device is operated by applying a voltage corresponding to pixel data between the pixel electrode and facing electrode and by moving the white and black pigments up and down. That is, when a positive voltage is applied to the pixel electrode, the negatively charged white pigment is attracted by the pixel electrode while the positively charged black pigment is attracted by the facing electrode and, therefore, by using the facing electrode side as its display surface, black is displayed on the screen. Further, when a negative voltage is applied to the pixel electrode, the positively charged black pigments are attracted by the pixel electrode while the negatively charged white pigments are attracted by the facing electrode and, as a result, white is displayed on the screen. Next, when an image display is to be changed from white to black, a positive signal voltage is applied to the pixel electrode and, when the image display is changed from black to white, a negative signal voltage is applied to the pixel electrode, and when a current image display is maintained, that is, the image display is changed from white or white and from black to black, 0V is applied. Thus, sine the electrophoretic display element has a memory property, by comparing the current image (previous image) and next image (renewed image), a signal to be applied is determined.

In the above, the white and black display microcapsule type electrophoretic display device is described. However, an advent of an electrophoretic display device that can display colors without losing an excellent display state in white and black as in the case of paper and without using a color filter is further expected and an electrophoretic display device that can display bright color even in order of unit pixel is still under development.

For example, in Patent Reference 1 (Japanese Patent No. 4049202), an electrophoretic display device is disclosed which includes a pair of substrates, a dispersion medium enclosed between the pair of substrates, an electrophoretic particle contained in the dispersion medium having either positive or negative charge of the same polarity and providing three colors each being different from one another, (for example, cyan (C), magenta (M), and yellow (Y)), and a white (W) support body to support the electrophoretic particles. In the electrophoretic display device disclosed in the Patent Reference 1, by setting a voltage (hereinafter "threshold value voltage") to initiate the movement of the electrophoretic particle having three colors each being different from one another and by applying a voltage by using a difference in threshold voltage (absolute value), one cell can display cyan (C), magenta (M), and yellow (Y) in addition to white (W) and black (K), and second color and third color of these CMY colors.

Moreover, in Patent Reference 2 (Japanese Patent No. 4385438), a color electrophoretic display device is also disclosed which includes a black particle having charge of a first polarity, a particle (electrophoretic particle) having charge of second polarity opposite to the first polarity, a liquid dispersion medium to disperse these particles in a manner in which electrophoresis can occur, and an electrophoretic display element film in which a plurality of kinds of microcapsules with these media enclosed therein is stacked in layers. In the microcapsule disclosed in the Patent Reference 2, particles having charge of the second polarity of red (R), green (G), and blue (B) each being different in charged amount are enclosed for every kind of the microcapsule.

By utilizing the fact that the charged amount of each of the particles (R), (G), and (B) having charge of the second polarity is different from one another and that the threshold voltage of red (R), green (G), and blue (B) having charge of second polarity is also different in color from one another and, as in the case of the Patent Reference 1, bright color display has been realized without using a color filter.

Further, in Patent Reference 3 (Japanese Patent Application Laid-open No. 2009-47737), a color electrophoretic display element is disclosed which uses electrophoretic particles having not only 3 colors including cyan (C), magenta (M), and yellow (Y) but also a color of black (K), 4 colors in total.

In brief, the display devices disclosed in the Patent References 1, 2, and 3 show that color displaying can be achieved by allowing the charged particles C, M, and Y (or charged particles R, G, and B) to have three threshold value voltages each being different from one another. However, when color displaying of three charged particles C, M, and Y is to be performed by using a difference in threshold value at a same pixel electrode, the driving for realizing a targeted color displaying is actually very complicated.

This problem is described by paying attention to a behavior of the electrophoretic particle disclosed in the Patent Reference 1 using FIGS. 27 and 28. It is hereinafter assumed that, when the threshold value voltage of each of the electrophoretic particles (charged particle) C, M and Y is Vth(c), Vth(m), and Vth(y), respectively, the characteristic relationship of |Vth(c)|<|Vth(m)|<|Vth(y)| (absolute value) is established. Moreover, applied voltages V1, V2, and V3 satisfy the characteristic relationship of |Vth(c)|<|V3|<|Vth(m)|, |Vth(m)|<|V2|<|Vth(y)|, and |Vth(y)|<|V1|. FIGS. 27 and 28 show hysteresis curves of the electophoretic particles C, M, and Y which represents the characteristic relationship between a threshold voltage and a relative color density. In these drawings, for simplification of the descriptions, in order to set the tilt of each of the hysteresis curves Y, nY, M, nM, C, and nC to be constant, the time when the Y, M, and C move from a rear surface to a display surface is set to different time.

As shown in FIG. 27, it is assumed that the image at the point of time of starting (previous image) is first set to white (W). When the voltage V3 (=10V) is applied, an electrophoretic particle having a cyan color moves to the display surface side, resulting in display of cyan (C) and, when the voltage V2 (=15V) is applied, an electrophoretic particle having a cyan and a magenta color moves to the display surface side, resulting in display of a blue (B) color. Also, when the voltage V1 (=30V) is applied, the electrophoretic particle having the cyan color, the electrophoretic particle having the magenta color, and the electrophoretic particle having the yellow color move to the display surface side, resulting in display of black (K). Moreover, when a previous image has been set to white (W), if a negative voltage is applied, no color particles move to the display surface side and, therefore, the image remains white (W).

Next, when the previous image has been set to black (K) and, if the negative voltage of −V3 (=−10V) is applied, an electrophoretic particle having the cyan color moves to a rear surface substrate side and the electrophoretic particle having the magenta (M) color and electrophoretic particle having the yellow (Y) color are left on the display surface side, thus resulting in display of red (R). When the previous image has been set to black (K), if the voltage of −V2 (=−15V) is applied, the electrophoretic particle having the cyan and magenta colors move to the rear substrate side and only the electrophoretic particle having the yellow (Y) color is left on the display surface side, thus resulting in display of a yellow (Y) color. When the previous image has been set to black (K), if the voltage of −V (=−30V) is applied, the electrophoretic particle having all the colors of cyan (C), magenta (M), and yellow (Y) move to the rear substrate side, thus resulting in display of white (W).

Next, for displaying a green (G) color or magenta (M) color, a driving method being different from the display method applied to driving of red (R), blue (B), cyan (C), yellow (Y), white (W) and black (K) are employed. For example, in order to display magenta (M), as shown in FIG. 28, the voltage of V2 (=15V) is applied to an image for displaying a white (W) color to once change a display color to blue (B). Therefore, by applying the voltage of −V3 (=−10V) to move the electrophoretic particle having a cyan color, a magenta color is then displayed.

Thus, the driving methods for displaying primary colors of red (R), green (G), blue (B), cyan (C), magenta (M), yellow (Y), white (W), and black (K) are described, however, the related driving method for displaying a given color La*b* including an intermediate color and shades of gray is very complicated. The above discussion holds true for the color micro capsule type electrophoretic display device disclosed in the Patent Reference 2 and/or the electrophoretic display device for displaying 4 colors of C, M, Y, and K.

SUMMARY OF THE INVENTION

In view of the above, it is an object of the present invention to provide an image display device having a memory property capable of displaying multiple gray scales including not only each of single colors (R, G, B, C, M, Y, W, and K) but also an intermediate color by using a simple configuration.

According to an aspect of the present invention, there is provided an image display device having a memory property including a display section including a first substrate in which switching elements and pixel electrodes are arranged in a matrix manner, a second substrate in which facing electrodes are formed, and electrophoretic layers containing electrophoretic particles which are interposed between the first substrate and the second substrate, and a voltage applying unit to apply a specified voltage for a predetermined period to the electrophoretic particle interposed between the pixel electrodes and the facing electrodes at time of renewal of a screen and to renew a display state of the display section from a current screen to a next screen having a predetermined color density, wherein the electrophoretic particle includes n-kinds ("n" is a natural number being 3 or more) of charged particles Cn, . . . , Ck, . . . , C1 (k=2 to n−1) which each are different from one another in color and in threshold value voltage for initiating electrophoresis and the charged particles Cn, . . . , Ck, . . . , C1 have a characteristic relationship of |Vth(cn)| < . . . <|Vth(ck)|< . . . <|Vth(c1)|, where |Vth(cn)| is a threshold value voltage of a charged particle Cn, |Vth(ck)| is a threshold value voltage of a charged particle Ck, and |Vth(c1)| is a threshold value voltage of a charged particle C1 and, wherein, at time of renewal of a screen, a predetermined color density of the next screen determines the relative color density of each of the charged particles in order of charged particles C1→, . . . , →Ck→, . . . , →Cn.

By configuring as above, not only displaying of each single color but also displaying of given colors (La*b*) including an intermediate color and shades of gray is made possible.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Figure 1:
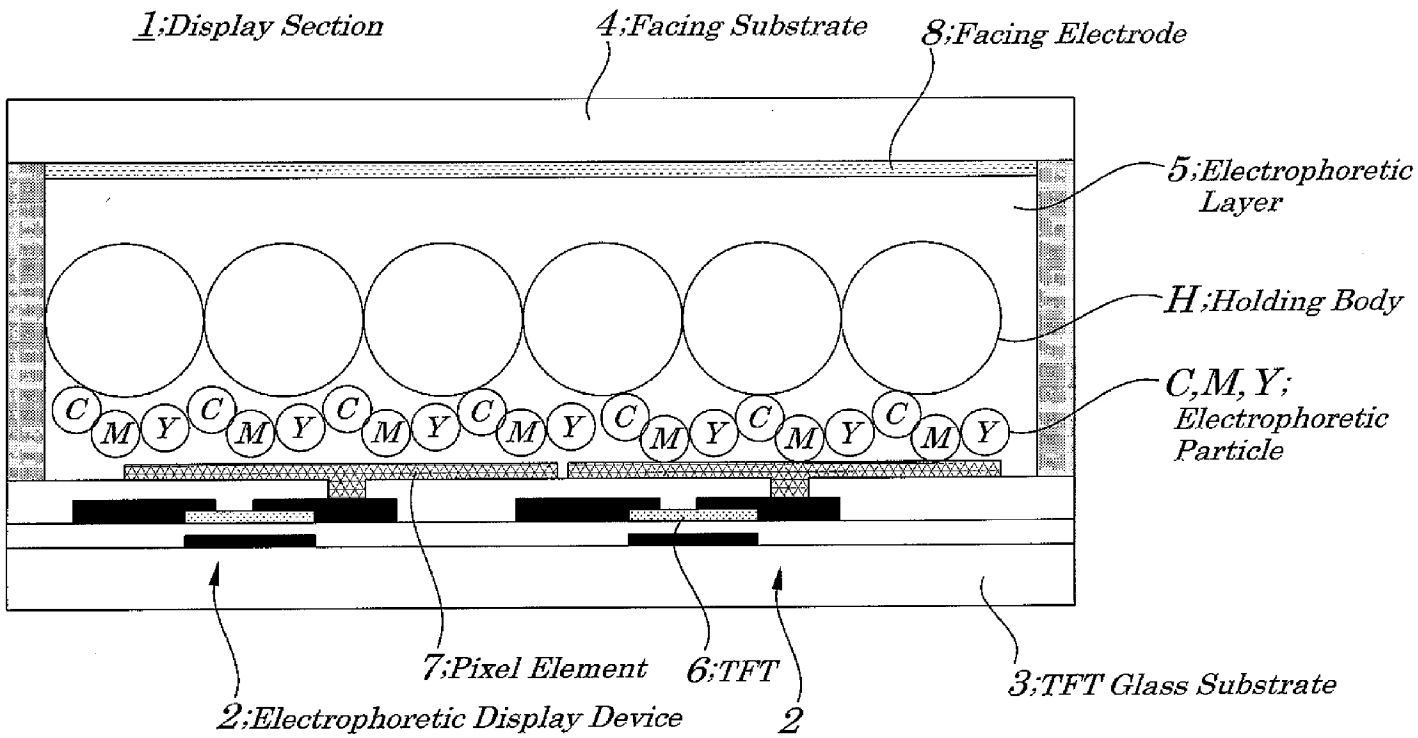
FIG. 1 is a partial cross-sectional diagram conceptionally showing configurations of a display section making up an electrode paper display device according to a first embodiment of the present invention.

Best modes of carrying out the present invention will be described in further detail using various exemplary embodiments with reference to the accompanying drawings.

In order to achieve the present invention, electrophoretic particles are made up of three kinds of charged particles C, M, and Y each being different in color and in threshold voltage to initiate electrophoresis from one another and each of the charged particles C, M, and Y has a characteristic relationship $|Vth(c)|<|Vth(m)|<|Vth(y)|$, where $|Vth(c)|$ is a threshold value voltage of a charged particle C, $|Vth(m)|$ is a threshold value voltage of a charged particle M, and $|Vth(y)|$ is a threshold value voltage of a charged particle Y, and a voltage applying period for renewing a screen includes, at least, a resetting period during which a resetting voltage is applied to reset a screen to aground state in which white or black is displayed, a first sub-frame group period (first voltage applying period) during which a first voltage V1 (or −V1) or 0V voltage is applied to cause a transition from the ground state to a first intermediate transition state where a relative color density of charged particles C, M, and Y becomes Ry, a second sub-frame group period (second voltage applying period) during which a second voltage V2 (or −V2) and/or 0V are applied to cause a transition from the first intermediate transition state to a second intermediate transition where the relative color density of the charged particles C and M become Rm, with the relative color density of a charged particle Y being held to be Ry, and a third sub-frame group period (third voltage applying period) during which a third voltage V3 (or −V3) and/or 0V are applied to cause a transition from the second intermediate transition state to a renewal display state (final transition state) where the relative color density of charged particle C becomes Rc, with the relative color density of charged particles M and Y being still held to be Rm and Ry, and the following formula of a characteristic relationship between a threshold value voltage of each charged particle and a voltage to be applied to each of sub-frame group periods (voltage applying periods) is satisfied:

$$|Vth(c)|<|V3|<|Vth(m)|<|V2|<|Vth(y)|<|V1|,$$

whereby a given color including an intermediate color and shades of gray is made possible.

Moreover, in order to realize the present invention, a voltage applying period at the time of renewing a screen includes, at least, a resetting period during which a reset voltage is applied to reset a screen state to a ground state in which white or black is displayed, a first sub-frame group period (first voltage applying period) during which a first voltage V1 (or −V1) and/or 0V is applied to cause a transition from the ground state to a first intermediate transition state where the relative color density of charged particles C, M, and Y become Ry, a second sub-frame group period (second voltage applying period) during which, a transition by the application of a second voltage V2 (or −V2), from a first intermediate transition state to a second intermediate transition during which, with a relative color density of a charged particle Y being held to be Ry, a relative color density of particles C and M becomes 0 or 1 in a ground state, a transition is allowed to occur, by the application of a second voltage V2 (or −2V) and/or 0V from a second intermediate transitions state in which, with the relative color density of the charged particle Y being held to be Ry, the relative color density of charged particles C and M becomes Rm, a third sub-frame group period (third voltage applying period) during which, after a transition induced by the application of a third voltage V3 (or −V3) and/or 0V from the third intermediate transition state to a ground state in which, with the relative color density of charged particles M and Y being held to be Rm and Ry, the relative color density of the charged particle C becomes 0 or 1 in the ground state, a transition is allowed to occur by the application of the third voltage V3 (or −V3) and/or 0V from the fourth intermediate transition state, to a renewal display state (final transition state) in which, with the relative color density of charged particles M and Y being held to be Ry, a relative color density of the charged particle C becomes Rc, and the following formula of a characteristic relationship between a threshold value voltage of each charged particle and a voltage to be applied to each of sub-frame group periods (voltage applying periods) is satisfied:

$$|Vth(c)|<|V3|<|Vth(m)|<|V2|<|Vth(y)|<|V1|,$$

whereby displaying of a given color including an intermediate color and shades of gray is also made possible.

Still moreover, in order to realize the present invention, a voltage applying period at the time of renewing a screen includes, at least, a resetting period for resetting to a ground state, a first sub-frame group period containing at least a sub-frame during which a first voltage V1 (or −V1) and/or second voltage V2 (or −V2) and/or 0V are applied to cause a transition to a first intermediate transition state in which, with a relative color density being held to be Ry, a relative color density of charged particle Y becomes Ry and a relative color density of the charged particle M becomes 0 or 1, and a second sub-frame period containing at least a sub-frame during which the second voltage V2 (or V2) and a third voltage V3 (or −3V) are applied to cause a transition from the first intermediate transition state to a ground state in which, a relative color density of the charged particle Y being held to be Ry, a relative color density of the charged particle M becomes Rm and a relative color density of charged particle C becomes 0 or 1, a third sub-frame group period containing at least a sub-frame during which the third voltage V3 (or −V3) and/or 0V are applied to cause a transition from the second intermediate transition to a renewal display state in which, with a relative color density of the charged particle M and Y being held to be Rm and Ry, a relative color density of the charged particle C becomes Rc, and the following formula of a characteristic relationship between the threshold voltage of each of the charged particles and the voltage to be applied during each of the sub-frame group periods is satisfied:

$$|Vth(c)|<|V3|<|Vth(m)|<|V2|<|Vth(y)|<|V1|,$$

whereby displaying of a given color including an intermediate color and shades of gray is also made possible.

Here, according to a desired intermediate and/or shades of gray, it is preferable that the number of sub-frames making up the above resetting period and sub-frame group period is set.

First Embodiment

Hereinafter, a first embodiment of the present invention is described in detail by referring to drawings. FIG. 1 is a partial cross-sectional view conceptually showing configurations of a display section making up an electronic paper display device of the first embodiment. The display section includes electrophoretic display devices 2, 2, . . . , having a memory property and displaying colors by an active matrix driving method. Also, each of the electrophoretic display devices 2, 2, . . . , is made up of a TFT glass substrate 3, a facing substrate 4, and en electrophoretic layer 5 sealed between the TFT glass substrate 3 and the facing substrate 4. The TFT glass substrate 3 includes a thin film transistor (hereinafter, also referred to as "TFT") 6 serving as a plurality of switching elements arranged in a matrix manner, a pixel element 7 connected to each of the TFTs 6, a gate line (not shown) and a data line (not shown).

The electrophoretic layer 5 of the present embodiment holds a dispersion medium, electrophoretic particles (hereinafter, also referred to as charged particles) C, M, and Y of cyan (C), magenta (M), and yellow (Y) being nano-particles dispersed in the dispersion medium, and a white holding body H with a particle diameter of 10 to 100 μm to hold the charged particles (this is the same in the embodiments described below).

The charged particles having three colors have the same polarity (in the present embodiment, positive polarity) in the state being dispersed in the dispersion medium and, due to a difference in charged amount, the charged particles are separated from their surfaces of the holding body H, each having different absolute threshold voltage which initiate a movement in the dispersion medium. The holding body H is huge in size when compared with the charged particles C, M, and T and preferably has a polarity being reverse to that of each of the charged particles C, M, and Y, however, is not limited to this.

Also, on the above facing substrate 4, a facing electrode 8 providing a reference potential is formed which provides a COM voltage to determine a reference potential of each of the electrophoretic display devices 2, 2, . . . . The color electrophoretic display device is so configured as to supply a voltage corresponding to pixel data between a pixel electrode 7 and facing electrode 8 to move the charged particles C, M, and Y (hereinafter, charged particles) having three colors CMY from the TFT glass substrate 3 side to the facing substrate 4 side or from the facing substrate 4 side to the TFT glass substrate side. Moreover, in the present embodiment, the facing electrode 2 side is used as a display surface (the same in the other embodiments described below).

Figures 2, 3:
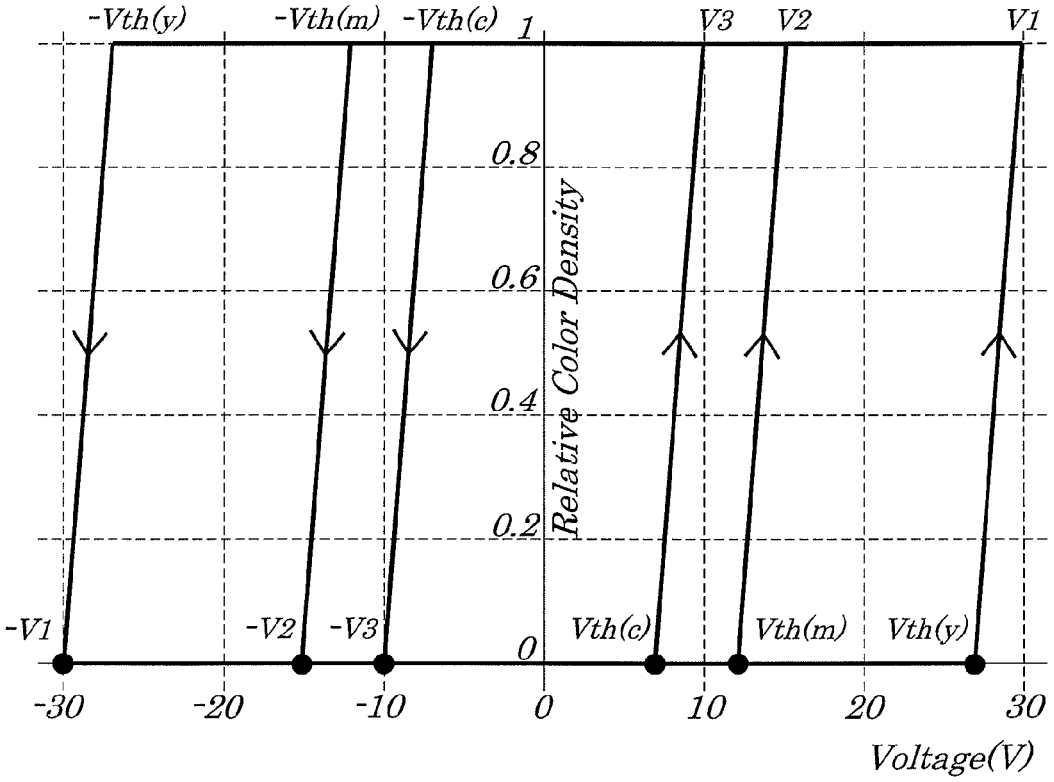
FIG. 2 is a state diagram for explaining a color display principle for an electrophoretic display device making up the display section of FIG. 1.
FIG. 3 is a conceptional diagram for explaining a driving method of displaying intermediate colors and displaying of shades of gray according to the first embodiment of the present invention.

Next, by referring to FIGS. 1 and 2, color displaying principle of the electrophoretic display devices 2, 2, . . . , of the present embodiment is described. According to the embodiment, as shown in these drawings, the threshold valve voltages Vth(c), Vth(m), and Vth(y) of three kinds of charged particles C, M, and Y, respectively, are so set as to satisfy the formula of characteristic relationship of |Vth(c)|<|Vth(m)|<|Vth(y)|. Moreover, the supplied voltages V1, V2, and V3 are so set as to satisfy the formula of characteristic relationship of:

$$|Vth(c)|<|V3|<|Vth(m)|,$$

$$|Vth(m)|<|V2|<|Vth(y)|, \text{ and}$$

$$|Vth(y)|<|V1|.$$

As understood from FIG. 2, behaviors of the charged particles C are first described and, when a voltage exceeds Vth(c) being the threshold voltage, the charged particles C move from the TFT glass substrate 3 side to the facing substrate 4 side and the display density of the cyan color becomes high, causing the display density to reach a saturated density before the voltage reaches the voltage Vth(m). In this state, when a negative voltage is applied and the voltage becomes below −Vth(c) being the threshold value voltage, the charged particle C moves from the facing substrate to the TFT glass substrate 3 side, resulting in lowering of density of the cyan color and, before the voltage reaches −Vth(m), the display density of the cyan color becomes minimum. Similarly, in the case of the charged particle M, when the voltage exceeds Vth(m) or less than −Vth(m) being the threshold voltage, the display density becomes high (or low) and, in the case of the charged particle Y, when the voltage exceeds Vth(y) or less than −Vth(y) being the threshold value voltage, the display density becomes high (or low).

Next, the TFT driving method for the color electrophoretic display device (element) of the present invention is described. In the TFT driving of the electrophoretic display elements 2, 2, . . . , as in the case of a liquid crystal display device, a gate signal is applied to a gate line to perform a shift operation for every line and data provided from the data line is written into the pixel electrode through the TFT of the switching element. The time required for finishing the writing on all lines is defined as one frame, and one line is scanned, for example, at 60 Hz (a period of 16.6 ms). Generally, in the liquid crystal display device, an entire image is switched within this one frame. In the case of the electrophoretic display device 2, 2, . . . , a response speed is higher than that of the liquid crystal display device and, unless a voltage continues to be applied for a plurality of sub-frame periods (this is called "sub-frame period") in the electrophoretic display device and a period made up of a plurality of the sub-frame periods for renewing a screen is called "screen renewing frame period"), a screen cannot be switched. Therefore, in the case of the electrophoretic display device, a PWM (Pulse Width Modulation) driving method in which a predetermined voltage continues to be applied for a plurality of sub-frame periods is employed. By applying a predetermined constant voltage V1 or (V2 or V3) for periods equivalent to the designated number of frames, displaying with gray levels is performed. In the description below, in order to represent display of a given color (for example, La*b*, XYZ, or RGB system), displaying of a given color is explained by the conversion of a relative color density of CMY system being equivalent to colors of three charged particles C, M, and Y.

Driving Method

According to the embodiment, in order to display a state from a previous display state CUR (hereinafter, "current screen" to a display state after the renewing of an image, as shown in FIG. 3, by employing an intermediate transition state (WK, I-1, I-2) including a ground state, a systematic and simple driving method including the display of an intermediate color and shades of gray is realized. By driving a plurality of sub-frames, a predetermined image is renewed. The driving period over a plurality of sub-frames includes a resetting period for a transition to a ground state in which white (W) or black (K) is displayed, a first sub-frame group period (first voltage applying period) during which V1 or −V1 voltage is applied, a second sub-frame group period (second voltage applying period), and a third sub-frame group period (third voltage applying period) during which V3, 0 or −V3 voltage is applied.

More specifically, when, as display information on a pixel to be displayed (next screen N to be displayed), the relative color density of each of the charged particles C, M, and Y is represented by (Rc, Rm, and Ry), as shown in FIG. 3, the first sub-frame group period is a period during which a transition occurs from a ground state where white (W) or black (K) is displayed to the first intermediate transition state I-1 during which the relative color density of the charged particle Y becomes Ry and the second sub-frame group period is a period during which a transition occurs from the first intermediate transition state I-1 to a second transition state I-2 where Y density is Ry and M density becomes Rm, and a third sub-frame group period is a period during which a transition occurs from the second intermediate group state I-2 to a renewal display state (final transition state) where Y density becomes Ry and M density becomes Rm, and C density becomes Rc.

Here, the relative color density Rx (X=C, M, Y) of charged particles C, M, Y is represented by values 0 to 1 and Rx=0 is a density to be obtained when all X particles have moved to a surface (rear) side opposite to the display surface side and Rx=0.5 is a density to be obtained when all X particles have moved to an intermediate surface between the display surface and rear surface and Rx=1 is a density to be obtained when all X particles have moved to the display surface side. (This is applied to other embodiments described below.) Therefore, the relative color density (C, M, Y)=(0, 0, 0) represents a state where a white (W) is displayed and relative color density (C, M, Y)=(1, 1, 1) represents a state where black (K) is displayed.

Table 1 shows a concrete driving voltage data in which each of gray levels of 3 colors CMY is set to 3 gray levels. For simplification, by a charged amount Q of each of the charged particles C, M, and Y so as to be |Qc|>|Qm|>|Qy| and a threshold voltage at which a particle begins to move is set so as to be |Vth(c)|<|Vth(m)|<|Vth(y)| and, where "Qc" shows a charged amount of a charged particle C, "Qm" shows a charged amount of a charged particle M, and "Qy" shows a charged amount of a charged particle Y. The Vth(c) is a threshold voltage at which the charged particle C initiates electrophoresis, the Vth(m) is a threshold voltage at which the charged particle M initiates electrophoresis, and the Vth(y) is a threshold voltage at which the charged particle Y initiates electrophoresis. (This is applied to other embodiments described below.) On the other hand, by making a weight, size and the like of a particle be different, mobility relative to an applied voltage is so set as to be the same in all the charged particles C, M, and Y.

As shown in Table 1, a driving voltage for a first sub-frame group period is set to |V1|=30V and the driving voltage for a second sub-frame group period is set to |V2|=15V, and the driving voltage for a third sub-frame group period is set to be |V3|=10V (if necessary, the driving voltage may be set to any given value).

Moreover, according to a simple model, time Δt needed for each of the charged particles C, M, and Y to move from a rear surface to a display surface is in inverse proportion to that for an applied voltage V and V×Δt=constant. In the embodiment, the time required for the movement of the charged particle C from a rear surface to a display surface (or display surface to a rear surface) is set to be 0.2 seconds when |V|=30V, 0.4 seconds when |V|=15V, and 0.6 seconds when |V|=10V. Also, the time for the movement of the charged particle M from a rear surface to a display surface (or display surface to a rear surface) is set to be 0.2 seconds when |V|=30V, 0.4 seconds when |V|=15V. Moreover, the time for the movement of the charged particle Y from a rear surface to a display surface (or a display surface to a rear surface) is set to be 0.2 seconds when |V|=30V. By taking these relations into consideration, in the present embodiment, when one sub-frame period is 100 ms, a screen frame renewing period is made up of 14 sub-frames (2 sub-frames for a resetting voltage applying period, 2 sub-frames for a first sub-frame group period, 4 sub-frames for a second sub-frame group period, and 6 sub-frames for a third sub-frame group period). Moreover, if a next screen is static one, with sub-frame for terminal 0V application (described later) being included, screen renewal frame time is 15 sub-frames.

TABLE 1

| Targeted Renewing Display | | | Resetting Period Applied Voltage | | Resetting Period Ground State | | | First Sub-frame Group Period Applied Voltage | | First Sub-frame Group Period Intermediate Transition State I-1 | | | Second Sub-frame Group Period Applied Voltage | | | | Second Sub-frame Group Period Intermediate Transition State I-2 | | |
|---|---|---|---|---|---|---|---|---|---|---|---|---|---|---|---|---|---|---|---|
| C | M | Y | Ra | Rb | C | M | Y | 1a | 1b | C | M | Y | 2a | 2b | 2c | 2d | C | M | Y |
| 0 | 0 | 0 | −30 | −30 | 0 | 0 | 0 | 0 | 0 | 0 | 0 | 0 | 0 | 0 | 0 | 0 | 0 | 0 | 0 |
| 0.5 | 0 | 0 | −30 | −30 | 0 | 0 | 0 | 0 | 0 | 0 | 0 | 0 | 0 | 0 | 0 | 0 | 0 | 0 | 0 |
| 1 | 0 | 0 | −30 | −30 | 0 | 0 | 0 | 0 | 0 | 0 | 0 | 0 | 0 | 0 | 0 | 0 | 0 | 0 | 0 |
| 0 | 0.5 | 0 | −30 | −30 | 0 | 0 | 0 | 0 | 0 | 0 | 0 | 0 | 15 | 15 | 0 | 0 | 0.5 | 0.5 | 0 |
| 0.5 | 0.5 | 0 | −30 | −30 | 0 | 0 | 0 | 0 | 0 | 0 | 0 | 0 | 15 | 15 | 0 | 0 | 0.5 | 0.5 | 0 |
| 1 | 0.5 | 0 | −30 | −30 | 0 | 0 | 0 | 0 | 0 | 0 | 0 | 0 | 15 | 15 | 0 | 0 | 0.5 | 0.5 | 0 |
| 0 | 1 | 0 | −30 | −30 | 0 | 0 | 0 | 0 | 0 | 0 | 0 | 0 | 15 | 15 | 15 | 15 | 1 | 1 | 0 |
| 0.5 | 1 | 0 | −30 | −30 | 0 | 0 | 0 | 0 | 0 | 0 | 0 | 0 | 15 | 15 | 15 | 15 | 1 | 1 | 0 |
| 1 | 1 | 0 | −30 | −30 | 0 | 0 | 0 | 0 | 0 | 0 | 0 | 0 | 15 | 15 | 15 | 15 | 1 | 1 | 0 |
| 0 | 0 | 0.5 | −30 | −30 | 0 | 0 | 0 | 30 | 0 | 0.5 | 0.5 | 0.5 | −15 | −15 | 0 | 0 | 0 | 0 | 0.5 |
| 0.5 | 0 | 0.5 | −30 | −30 | 0 | 0 | 0 | 30 | 0 | 0.5 | 0.5 | 0.5 | −15 | −15 | 0 | 0 | 0 | 0 | 0.5 |
| 1 | 0 | 0.5 | −30 | −30 | 0 | 0 | 0 | 30 | 0 | 0.5 | 0.5 | 0.5 | −15 | −15 | 0 | 0 | 0 | 0 | 0.5 |
| 0 | 0.5 | 0.5 | −30 | −30 | 0 | 0 | 0 | 30 | 0 | 0.5 | 0.5 | 0.5 | 0 | 0 | 0 | 0 | 0.5 | 0.5 | 0.5 |
| 0.5 | 0.5 | 0.5 | −30 | −30 | 0 | 0 | 0 | 30 | 0 | 0.5 | 0.5 | 0.5 | 0 | 0 | 0 | 0 | 0.5 | 0.5 | 0.5 |
| 1 | 0.5 | 0.5 | −30 | −30 | 0 | 0 | 0 | 30 | 0 | 0.5 | 0.5 | 0.5 | 0 | 0 | 0 | 0 | 0.5 | 0.5 | 0.5 |
| 0 | 1 | 0.5 | −30 | −30 | 0 | 0 | 0 | 30 | 0 | 0.5 | 0.5 | 0.5 | 15 | 15 | 0 | 0 | 1 | 1 | 0.5 |
| 0.5 | 1 | 0.5 | −30 | −30 | 0 | 0 | 0 | 30 | 0 | 0.5 | 0.5 | 0.5 | 15 | 15 | 0 | 0 | 1 | 1 | 0.5 |
| 1 | 1 | 0.5 | −30 | −30 | 0 | 0 | 0 | 30 | 0 | 0.5 | 0.5 | 0.5 | 15 | 15 | 0 | 0 | 1 | 1 | 0.5 |
| 0 | 0 | 1 | −30 | −30 | 0 | 0 | 0 | 30 | 30 | 1 | 1 | 1 | −15 | −15 | −15 | −15 | 0 | 0 | 1 |
| 0.5 | 0 | 1 | −30 | −30 | 0 | 0 | 0 | 30 | 30 | 1 | 1 | 1 | −15 | −15 | −15 | −15 | 0 | 0 | 1 |
| 1 | 0 | 1 | −30 | −30 | 0 | 0 | 0 | 30 | 30 | 1 | 1 | 1 | −15 | −15 | −15 | −15 | 0 | 0 | 1 |
| 0 | 0.5 | 1 | −30 | −30 | 0 | 0 | 0 | 30 | 30 | 1 | 1 | 1 | −15 | −15 | 0 | 0 | 0.5 | 0.5 | 1 |
| 0.5 | 0.5 | 1 | −30 | −30 | 0 | 0 | 0 | 30 | 30 | 1 | 1 | 1 | −15 | −15 | 0 | 0 | 0.5 | 0.5 | 1 |
| 1 | 0.5 | 1 | −30 | −30 | 0 | 0 | 0 | 30 | 30 | 1 | 1 | 1 | −15 | −15 | 0 | 0 | 0.5 | 0.5 | 1 |
| 0 | 1 | 1 | −30 | −30 | 0 | 0 | 0 | 30 | 30 | 1 | 1 | 1 | 0 | 0 | 0 | 0 | 1 | 1 | 1 |
| 0.5 | 1 | 1 | −30 | −30 | 0 | 0 | 0 | 30 | 30 | 1 | 1 | 1 | 0 | 0 | 0 | 0 | 1 | 1 | 1 |
| 1 | 1 | 1 | −30 | −30 | 0 | 0 | 0 | 30 | 30 | 1 | 1 | 1 | 0 | 0 | 0 | 0 | 1 | 1 | 1 |

| Targeted Renewing Display | | | Third Sub-frame Group Period Applied Voltage | | | | | | Third Sub-frame Group Period Renewal Display N | | |
|---|---|---|---|---|---|---|---|---|---|---|---|
| C | M | Y | 3a | 3b | 3c | 3d | 3e | 3f | C | M | Y |
| 0 | 0 | 0 | 0 | 0 | 0 | 0 | 0 | 0 | 0 | 0 | 0 |
| 0.5 | 0 | 0 | 10 | 10 | 10 | 0 | 0 | 0 | 0.5 | 0 | 0 |
| 1 | 0 | 0 | 10 | 10 | 10 | 10 | 10 | 10 | 1 | 0 | 0 |
| 0 | 0.5 | 0 | −10 | −10 | −10 | 0 | 0 | 0 | 0 | 0.5 | 0 |
| 0.5 | 0.5 | 0 | 0 | 0 | 0 | 0 | 0 | 0 | 0.5 | 0.5 | 0 |
| 1 | 0.5 | 0 | 10 | 10 | 10 | 0 | 0 | 0 | 1 | 0.5 | 0 |
| 0 | 1 | 0 | −10 | −10 | −10 | −10 | −10 | −10 | 0 | 1 | 0 |
| 0.5 | 1 | 0 | −10 | −10 | −10 | 0 | 0 | 0 | 0.5 | 1 | 0 |
| 1 | 1 | 0 | 0 | 0 | 0 | 0 | 0 | 0 | 1 | 1 | 0 |
| 0 | 0 | 0.5 | 0 | 0 | 0 | 0 | 0 | 0 | 0 | 0 | 0.5 |
| 0.5 | 0 | 0.5 | 10 | 10 | 10 | 0 | 0 | 0 | 0.5 | 0 | 0.5 |
| 1 | 0 | 0.5 | 10 | 10 | 10 | 10 | 10 | 10 | 1 | 0 | 0.5 |
| 0 | 0.5 | 0.5 | −10 | −10 | −10 | 0 | 0 | 0 | 0 | 0.5 | 0.5 |
| 0.5 | 0.5 | 0.5 | 0 | 0 | 0 | 0 | 0 | 0 | 0.5 | 0.5 | 0.5 |
| 1 | 0.5 | 0.5 | 10 | 10 | 10 | 0 | 0 | 0 | 1 | 0.5 | 0.5 |
| 0 | 1 | 0.5 | −10 | −10 | −10 | −10 | −10 | −10 | 0 | 1 | 0.5 |
| 0.5 | 1 | 0.5 | −10 | −10 | −10 | 0 | 0 | 0 | 0.5 | 1 | 0.5 |
| 1 | 1 | 0.5 | 0 | 0 | 0 | 0 | 0 | 0 | 1 | 1 | 0.5 |
| 0 | 0 | 1 | 0 | 0 | 0 | 0 | 0 | 0 | 0 | 0 | 1 |
| 0.5 | 0 | 1 | 10 | 10 | 10 | 0 | 0 | 0 | 0.5 | 0 | 1 |
| 1 | 0 | 1 | 10 | 10 | 10 | 10 | 10 | 10 | 1 | 0 | 1 |
| 0 | 0.5 | 1 | −10 | −10 | −10 | 0 | 0 | 0 | 0 | 0.5 | 1 |
| 0.5 | 0.5 | 1 | 0 | 0 | 0 | 0 | 0 | 0 | 0.5 | 0.5 | 1 |
| 1 | 0.5 | 1 | 10 | 10 | 10 | 0 | 0 | 0 | 1 | 0.5 | 1 |
| 0 | 1 | 1 | −10 | −10 | −10 | −10 | −10 | −10 | 0 | 1 | 1 |
| 0.5 | 1 | 1 | −10 | −10 | −10 | 0 | 0 | 0 | 0.5 | 1 | 1 |
| 1 | 1 | 1 | 0 | 0 | 0 | 0 | 0 | 0 | 1 | 1 | 1 |

By using Table 1, a concrete driving method is described. The first column shows a relative color density (C, M, Y) in a targeted renewal display state. The second column shows an applied voltage for a resetting period and a relative color density in a ground state to appear after the completion of the resetting period. The resetting period in the driving operations is made up of 2 sub-frames Ra and Rb and the applied voltage that can be employed is −30V. The third column shows an applied voltage in the first sub-frame group period and a relative color density of a first intermediate transition state I-1 to be reached after the completion of the period. The first sub-frame group period is made up of two sub-frames 1*a* and 1*b* and the applied voltage that can be employed is +30V, 0V, and (−30V). The reason for using two sub-frames is that a response time of a particle is 0.2 seconds at 30V and 1 sub-frame period is 0.1 s. In this specification, a response time represents a time required for a charged particle to move from a display surface to a rear surface or from a rear surface to a display surface. The fourth column shows an applied voltage for the second sub-frame group period and a relative color density in a second intermediate transition state I-2 to be reached after the completion of the period.

The second sub-frame group period is made up of four sub-frames 2*a*, 2*b*, 2*c*, and 2*d* and the applied voltage that can be employed is +15V, 0V, and −15V. The reason for using four sub-frames is that a response time of a particle is 0.4 seconds at 15V and is 0.1 s for one first sub-frame period. The fifth column shows an applied voltage for the third sub-frame group period and a state in which a screen is renewed being a final transition state N in which a terminal point of the period is reached. The third sub-frame group period is made up of six sub-frames 3*a*, 3*b*, 3*c*, 3*d*, and 3*f* and the applied voltage that can be employed is +10V, 0V, and −10V. The reason for using four sub-frames is that a response time of a particle is 0.6 seconds at 10V and is 0.1 s for one sub-frame period. For a resetting period, voltage −V1 (=−30V) is applied for two sub-frames and the charged particles C, M, and Y are moved and gathered on a position opposite to the display surface to display white (W) in a ground state.

During the first sub-frame group period, according to the relative color density of the charged particle Y, when the relative color density (Y) is 0, the voltage to be applied is 0V and, when the relative color density (Y) is 0.5, the voltage to be applied is 30 V for one sub-frame only and when the relative color density (Y) is 1, the voltage to be applied is 30V for sub-frames. By controlling as above, a transition occurs from the ground state to the first intermediate transition state I-1, that is, its (C, M, Y)=(Ry, Ry, and Ry), where Ry takes on values of 3 gray levels (0, 0.5, 1). In the present embodiment, the relative color density (Y) being Ry=0 is obtained when all charged particles Y move to the display surface side and the relative color density (Y) being Ry=0.5 can be obtained when all the charged particle Y stay between the display surface and rear surface and the relative color density (Y) being Ry=1 can be obtained when all the charged particles Y move to the rear surface side. In the present embodiment, a relative color density (Y) at time of Ry=0 can be obtained when all charged particles move to a display surface side and a relative color density (Y) at time of Ry=0 can be obtained when all charged particles move to an intermediate surface between a display surface and a rear surface, and a relative color density (Y) at time of Ry=1 can be obtained when all charged particles move to a rear surface.

During the second sub-frame group period, M-Y being a difference in relative color density between a targeted charged particle M and charged particle Y is calculated and a predetermined amount of voltage of −15 V or 15V is applied. For example, when the relative color density (Y)=0.5 and the relative color density (M)=0, the relative color density (M−Y) =−0.5 and, therefore, by applying −15V for 2 sub-frames, the charged particles M and C are moved to the display surface and opposite side to lower the gray level by one. When a relative color density (Y)=0.5 and a relative color density (M)=0.5, 0V is applied. When the relative color density (Y)=0.5 and relative color density (M)=1, in order to raise the gray level by one, 15V is applied during two sub-frames to increase the charged particles M and C on the display surface side. By the above operation, a transition occurs from a first intermediate transition state I-1, that is, (C, M, Y)=(Ry, Ry, Ry) to a second intermediate transition state I-2, that is, (C, M, Y)=(Rm, Rm, Ry) (Rm with 3 gray levels and Rm=0, 0.5, 1). In the embodiment, the relative color density (M) being Rm=0 can be obtained when all the charged particles M move to a display surface side and the relative color density (M) being Rm=0.5 can be obtained when all the charged particles M stay at an intermediate position between the display surface and rear surface and the relative color density (M) being Rm=1 can be obtained when all the charged particles M move to the rear surface side. In the present embodiment, a relative color density (M) of Rm=0 can be obtained when all charged particles move to a display surface side and a relative color density (M) of Rm=0 can be obtained when all charged particles move to an intermediate surface between the display surface and rear surface and a relative color density (M) of Rm=1 can be obtained when all charged particles move to the rear surface side.

During the third sub-frame group period, C-M being a difference in relative color density between the charged particle C having a targeted relative density and charged particle M is calculated and a predetermined amount of voltages of −10V or 10V is applied. For example, when M=−0.5 and the relative color density (C)=0, a color density difference (C−M) =−0.5 and, therefore, the voltage of −10V is applied for 3 sub-frames and, by moving the charged particle C to the display surface and its opposite surface, gray levels are lowered by one. When the relative color density (M)=0.5 and relative color density (C)=0.5, 0V is applied. When the relative color density (M)=0.5 and relative color density (C)=1, in order to raise the gray level by one, the voltage of 10V is applied for three sub-frames to increase the charged particle C on the display surface side. By operating as above, the transition is made possible from a second intermediate transition state I-2, that is, (C, M, Y)=(Rm, Rm, Ry) to a targeted renewal display state (final transition state) N, that is, (C, M, Y)=(Rc, Rm, Ry) (Rc with 3 gray levels and Rc=0, 0.5, 1). In the embodiment, the relative color density of Rc=0 can be obtained when all the charged particles C move to the display surface side and the relative color density (C) of Rc=0.5 can be obtained when all the charged particles C stay at an intermediate position between the display surface and rear surface and the relative color density (C) can be obtained when all the charged particles C move to the rear surface. In the present embodiment, a relative color density (C) of Rm=0 can be obtained when all charged particles move to a display surface side and a relative color density (C) of Rm=0.5 can be obtained when all charged particles move to an intermediate surface between the display surface and rear surface and a relative color density (C) of Rm=1 can be obtained when all charged particles move to the rear surface side.

Figure 9A:
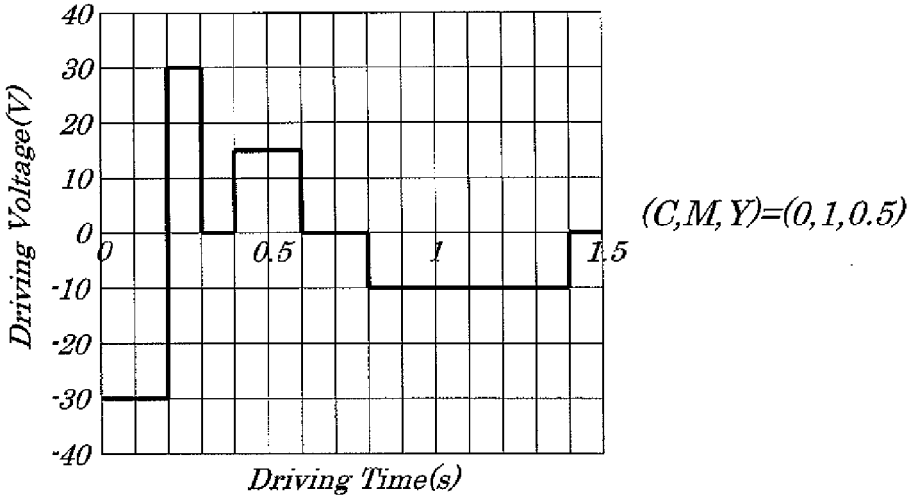
FIG. 9 is a waveform diagram showing the driving voltage waveform for explaining the driving method of the first embodiment.
Figure 9B:
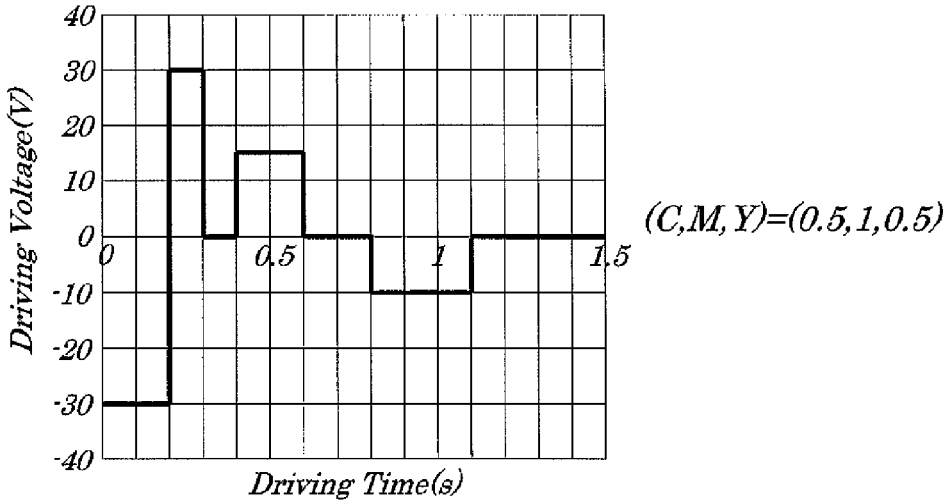
Figure 9C:
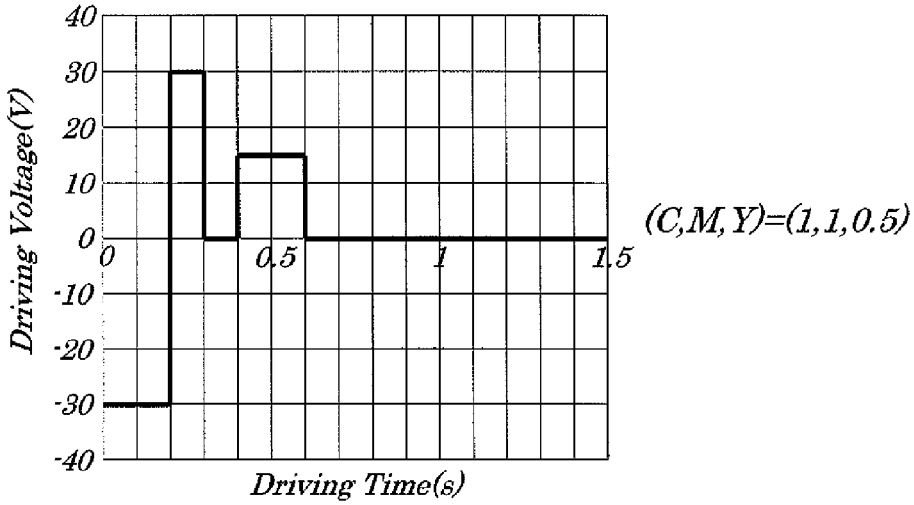
Figure 10A:
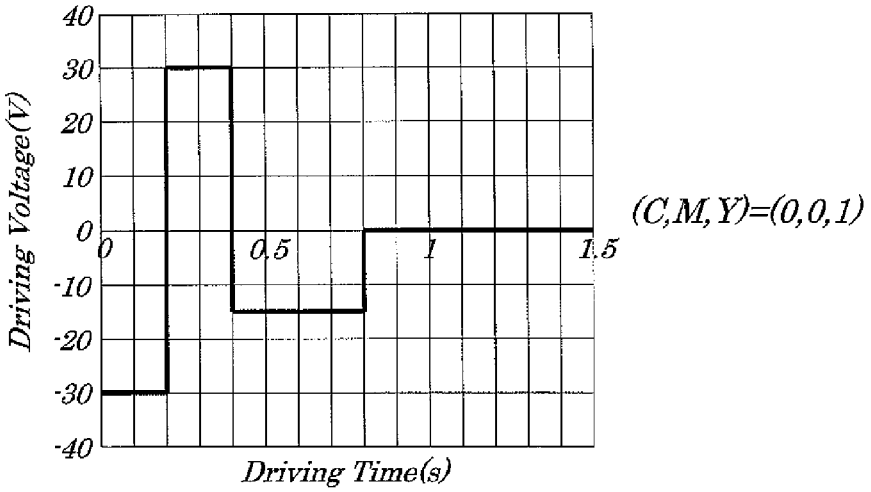
FIG. 10 is a waveform diagram showing the driving voltage waveform for explaining the driving method of the first embodiment.
Figure 10B:
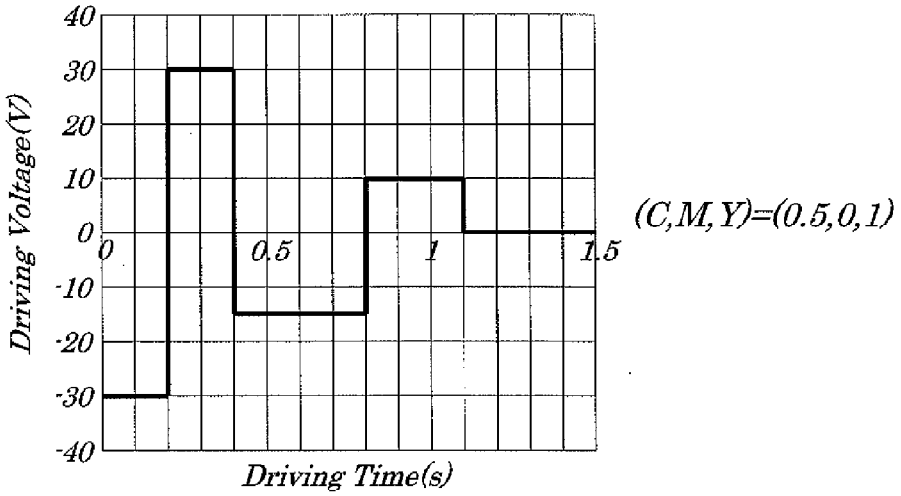
Figure 10C:
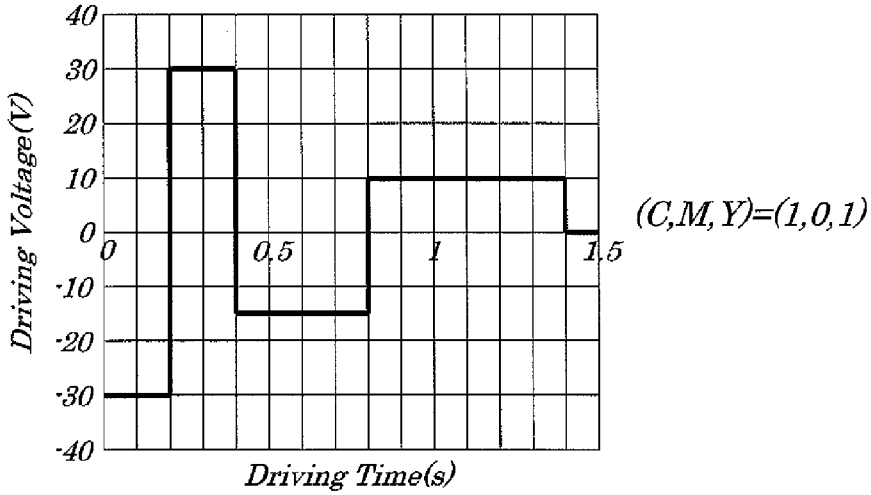
Figure 11A:
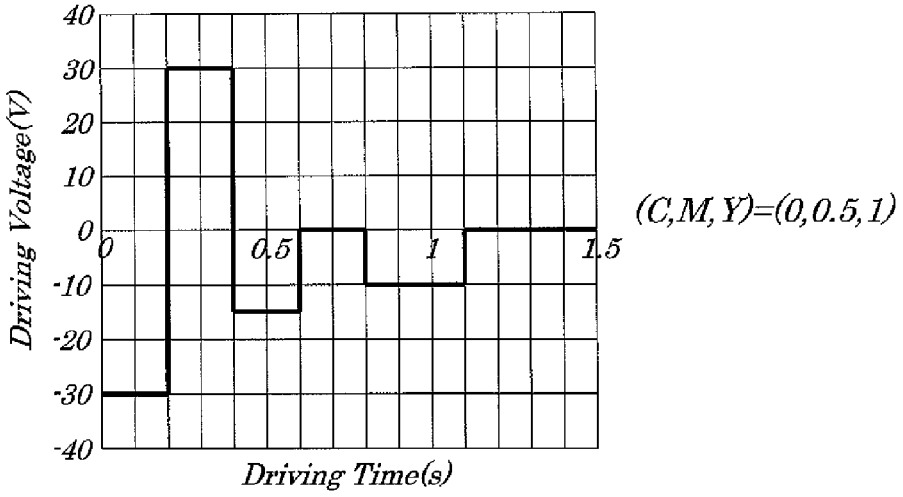
FIG. 11 is a waveform diagram showing the driving voltage waveform for explaining the driving method of the first embodiment.
Figure 11B:
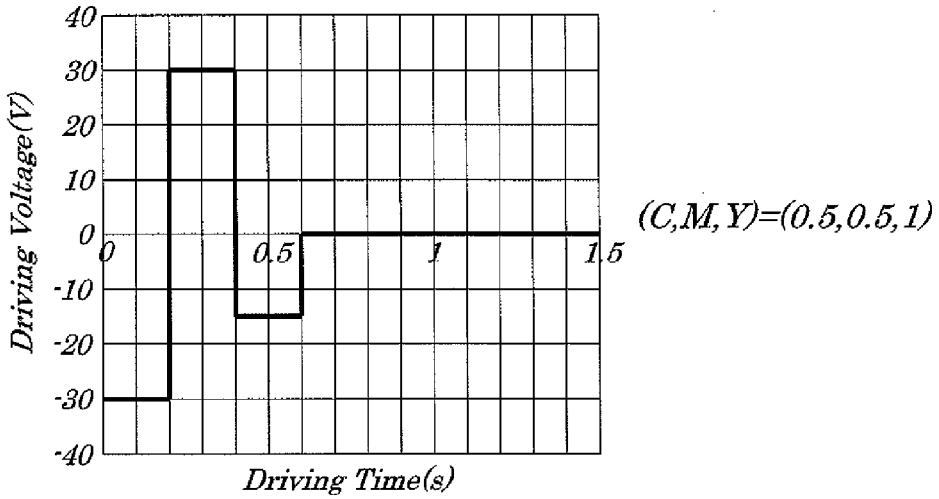
Figure 11C:
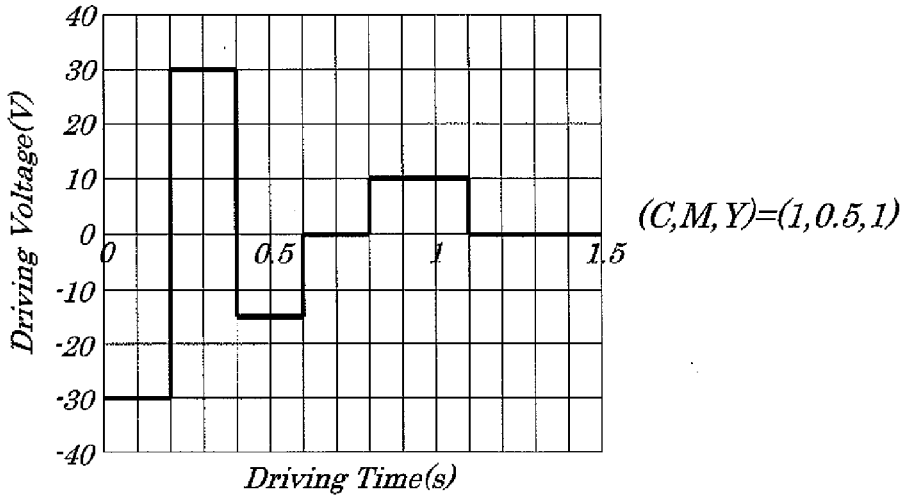
Figure 12A:
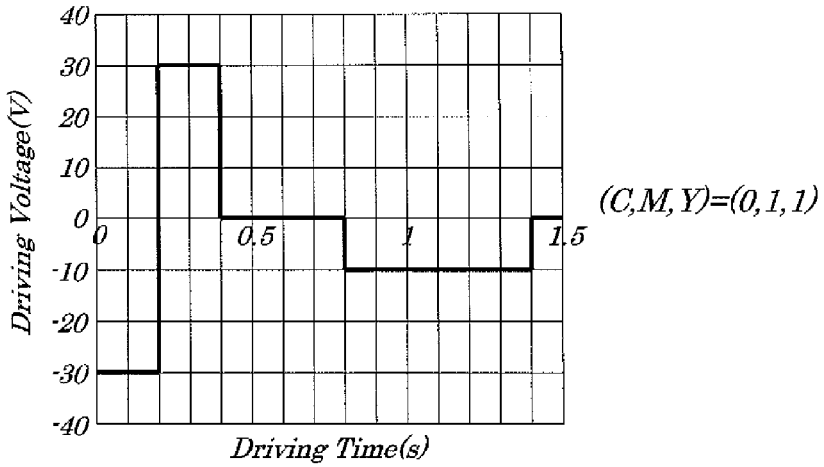
FIG. 12 is a waveform diagram showing the driving voltage waveform for explaining the driving method of the first embodiment.
Figure 12B:
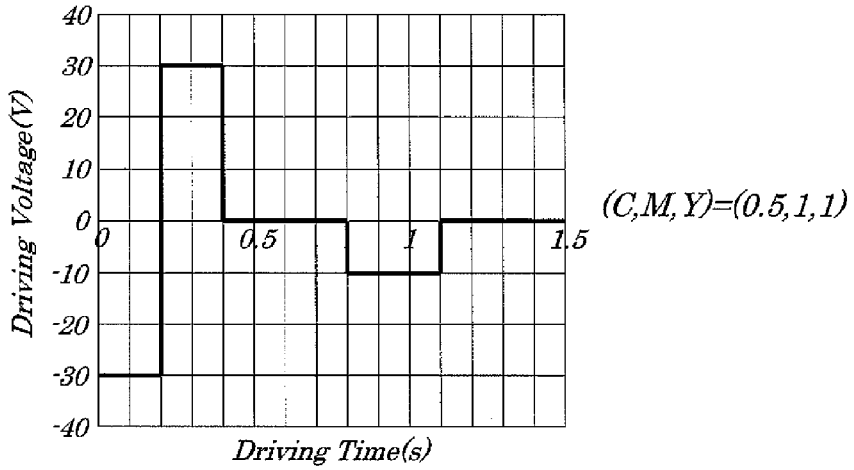
Figure 12C:
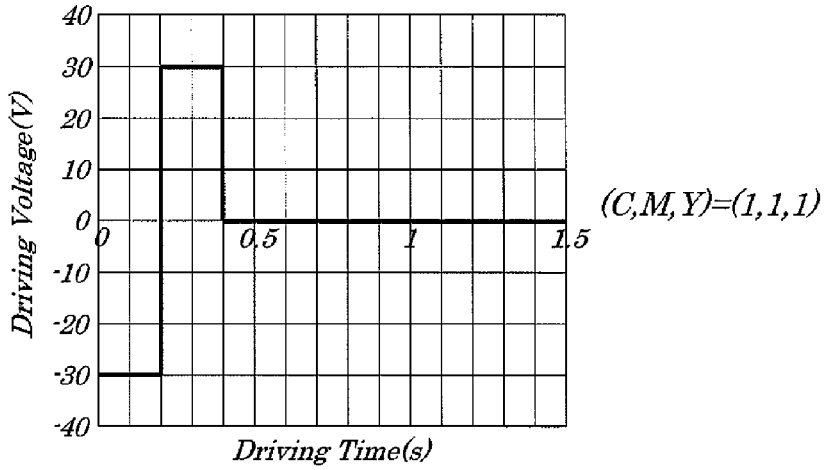
Figure 13:
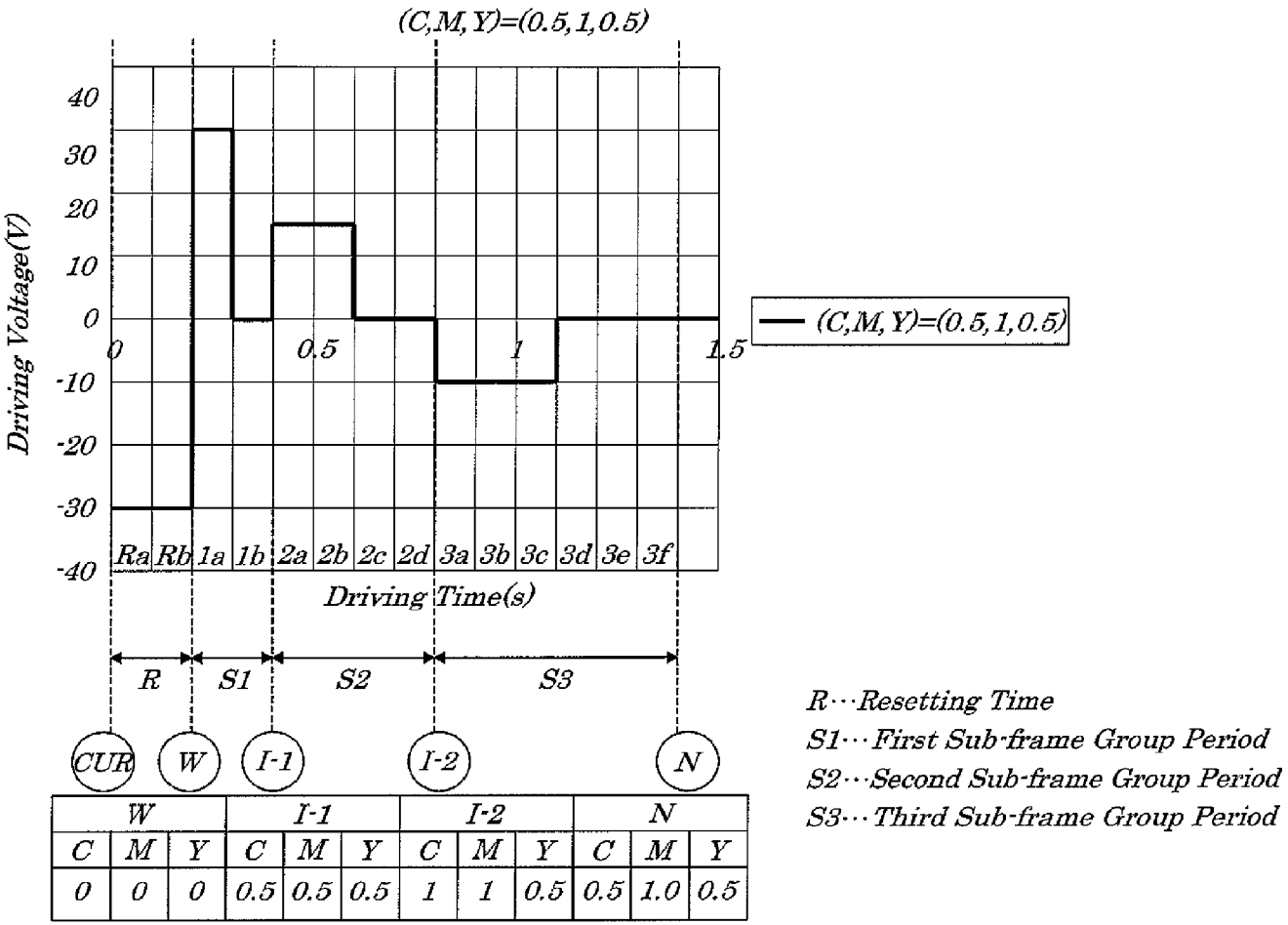
FIG. 13 is a waveform diagram for explaining operations of the first embodiment.

FIGS. 4 to 12 show specified display waveforms based on Table 1. For example, the driving waveforms to realize the display state, (C, M, Y)=(0.5, 1, 0.5) extracted from FIG. 9 are shown in FIG. 13. First, in order to delete a previous display state CUR (current screen), during the resetting period, a voltage of −30V is applied for 2 sub-frames (0.2 seconds) to cause a transition to the white display ground state W, (C, M, Y)=(0, 0, 0). Next, during the first sub-frame group period, the voltage of +30V is applied for one sub-frame period and then 0V is applied for one sub-frame period to cause a transition to the first intermediate transition state I-1, (C, M, Y)=(0.5, 0.5, 0.5). During the second sub-frame group period, by applying a voltage of +15V for 2 sub-frame periods and 0V for 2 sub-frame periods, a transition occurs to a second intermediate transition state I-2, (C, M, Y)=(1, 1, 0.5). During the third sub-frame group period, by applying a voltage of −10V for 3 sub-frame periods and 0V for 3 sub-frame periods, a transition occurs to a renewal display state I-2, (C, M, Y)=(0.5, 1.0, 0.5).

Figure 14:
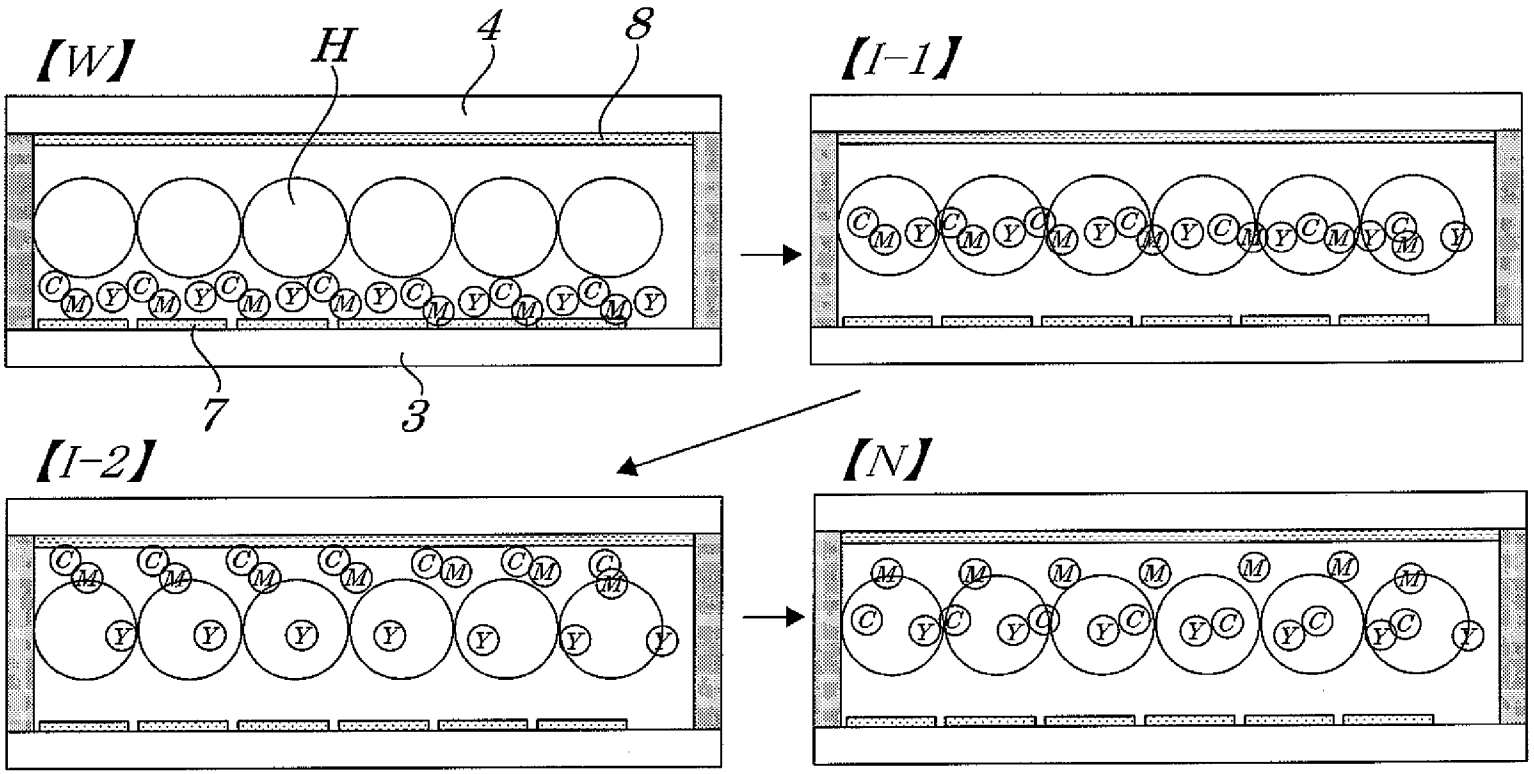
FIG. 14 is an intermediate transition state diagram for explaining the first embodiment.

The states of charged particles C, M, and Y during the occurrence of an intermediate transition are shown in FIG. 14. During the resetting period, when the charged particles C, M, and Y move to the TFT glass substrate 3 side, only the white holding body H is seen from the facing substrate 4 side and, therefore, the transition to the display state W occurs. Next, during the first sub-frame group period, the charged particles C, M, and Y move from the TFT glass substrate 3 side to an intermediate position between the TFT glass substrate 3 and facing substrate 4 and, therefore, a transition to the first intermediate transition state I-1 occurs. Then, during the second sub-frame group period, while the particle Y continues to stay in the intermediate position, the charged particles C and M move to the display surface side and a transition to the second intermediate transition state I-2 occurs. During the third sub-frame group period, while the charged particle M continues to stay on the display surface, only the charged particle C makes a transition to the intermediate transition state and, therefore, the transition to a predetermined renewal display state N is made possible.

For example, if, a targeted display state N is (C, M, Y)=(1.0, 1.0, 0.5), since the first intermediate transition state I-1 is (C, M, Y)=(0.5, 0.5, 0.5), and the second intermediate transition state I-2 is (C, M, Y)=(1.0, 1.0, 0.5), therefore the second intermediate transition state I-2 is, after all, the renewal display state (final transition state) N and, therefore, the third sub-frame group period can be omitted and the intermediate transition state I-2 is not required. Moreover, if a targeted display state N is (C, M, Y)=(0.5, 0.5, 0.5), since the first intermediate transition state I-1 is (C, M, Y)=(0.5, 0.5, 0.5), the first intermediate transition state I-1 is the renewal display state (final transition state) N and, therefore, the second and third sub-frame group periods can be omitted and the intermediate transition states I-1 and I-2 are not required.

Also, when a targeted display state N is (C, M, Y)=(0, 0, 0), only during the resetting period, the renewal display state (final transition state) can be realized. If a conclusion is to be generalized from the above case, when a ground state, or the intermediate transition state I-1, or the intermediate transition state I-2 agree with the renewal display state N, the sub-frame periods and beyond can be omitted.

In the above, it is described that the mobility of each of the charged particles C, M, Y is the same, however, if the mobility is different from one another, in the first intermediate transition state I-1, though the relative color density (Y) of the charged particle Y becomes "Ry", the relative color density (C and M) of charged particles C and M is different from the Ry. Also, in the second intermediate transition state I-2, though the relative color density (Y) of the charged particle Y is "Ry", the relative color density (M) of the charged particle M becomes Rm, and the relative color density (C) of the charged particle C is different from the "Rm". Therefore, if a conclusion is to be generalized from the above case, a relative color density (C, M, Y) in the first intermediate transition state I-1 is represented as (C, M, Y)=(X, X, and Ry) (X: arbitrary, X≠Ry), and the relative color density (C, M, Y) in the second intermediate transition state I-2 is represented as (C, M, Y)=(X, Rm, and Ry) (X: arbitrary, X≠Rm).

In the above description, the movement time ti of each of the charged particles C, M, and Y from the rear side to display surface side varies depending on an applied voltage V1 and when V1 is 30V, t1=0.2 seconds, when V2 is 15V, t2=0.4 seconds, and when V3 is 10V, t3=0.6 seconds. These principles can be generalized as below. Each of the sub-frame periods t1, t2, and t3 making up one sub-frame period is set so that, if an applied voltage provided during each sub-frame group period is V1, V2, V3, Vi×ti is constant (i=1, 2, 3). If a time assigned to each sub-frame period becomes constant (n=1, 2, 3), when the number of sub-frames for each period is ni, Vi×ni becomes constant (n=1, 2, 3). Moreover, by setting the number of sub-frames for each period to be constant, unit sub-frame time for each period may be varied in each sub-frame period.

Moreover, part of the second and third sub-frame group periods can be moved to the first sub-frame group period, however, even in this case, when the first sub-frame group is combined into one to apply a voltage continuously, a transition occurs from the ground state to the intermediate transition I-1. It is needless to say that, in the above description, the C, M, and Y are set to 3 gray levels, however, the same driving as above can be performed with multiple gray levels such as 2 gray levels or 3 gray levels or higher. Also, in the above descriptions, it is described that, in the ground state appearing after being reset, white (W) is displayed, however, even when black (K) is displayed, driving waveforms can be formed as well. Additionally, by making the period longer, it is made possible that cyan (C), magenta (M), yellow (Y), red (R), green (G), or blue (B) being primary colors can be displayed. (this is applied to other embodiments described below).

In the first embodiment, the voltage |V1| to be used in the first sub-frame group period and to satisfy the characteristic relationship of |Vth(y)|<|V1)| is set to be a single voltage |30|V, however, the voltage |V1| is not limited to such a single voltage and a plurality of applied voltages may be used. For example, by using a plurality of applied voltages Va1, Vb1 (|Va1|, |Vb1|>|Vth(y)|), the first sub-frame group period may be made up of a sub-frame period during which the voltages Va1, 0, and −Va1 are applied and a sub-frame period during which the voltages Va1, 0, and −Va1 are applied (the same for the embodiments hereinafter). This holds true for the second and third sub-frame group periods. Particularly, this is described in the tenth embodiment.

In summary, the electronic paper display device of the favorable embodiment is so configured as to operate in the resetting period during which, a targeted relative color density (C, M, Y) is set to be (Rc, Rm, Ry), a resetting voltage is applied to cause the transition to aground state during the screen renewing period, in the first sub-frame group period containing at least a sub-frame during which the first voltage V1 (or −V1) or 0V is applied and during which a transition is made to occur from the above ground state to the first intermediate transition state in which the charged particle Y becomes a relative color density Ry, in the second sub-frame group period containing at least a sub-frame during which the second voltage V2 (or −V2) or 0V are applied and during which, with the relative color density of the charged particle Y being held to be Ry, a transition is allowed to occur to the renewal display state in which the relative color density of the charged particle C becomes Rc, and in the third sub-frame group period containing at least a sub-frame during which the third voltage V3 (or −V3) and/or 0V are applied and during which a transition is allowed to occur to the renewal display state in which, with the relative color density of the charged particle Y being held to be Ry, and with the relative color density of the charged particle M being held to be Rm, the relative color density of the charged particle C becomes Rc.

Creation of Look-Up Table

The method for producing and converting of a look-up table (hereinafter "LUT" table) to obtain the driving voltage waveforms shown in FIGS. 4 to 12.

In the driving method of the embodiment, the screen renewing frame period is made up of 14 sub-frames with one sub-frame period being 100 ms and, actually, by applying 0V for one frame excessively in order to prevent power supply from being turned off while an excessive voltage is applied to a pixel electrode and, as a result, the screen renewing frame period is made up of 15 sub-frames in total. Therefore, in order to realize a targeted display state, the LUT having "m" rows and "l" columns corresponding to the screen renewal frame periods has to be provided for several sub-frames (in the present embodiment, the number of LUTs=15). Here, a matrix element of the LUT having "m" rows and l columns is expressed as WFn (m) where the matrix row number of the LUT representing a display state is "m". The "n" represents an n-th LUT defining an applied voltage in an n-th sub-frame period. As an index of the row number "m", a 6-bit binary number is used. When high-order two bits is for gray levels for Y, m[5:4]=[00], [01], and [10], when intermediate-order two bits are for gray levels for M. m[3:2]=[00], [01], and [10], and when lower-bit two bits are for gray levels for C, m[1:0]=[00], [01], and [10].

In the matrix element for each row, a driver data signal to be supplied to a data driver (described later) of the electronic paper display device when a transition to a gray level data state of a pixel of the renewed screen occurs in each of sub-frames is allowed to occur is represented. The driver data signal is represented by 3-bit binary numbers taking bit values [000], [001], [010], [011], [100], [101], [110] and [111]. The driver, after receiving the data [000], outputs 0V. Similarly, the driver, after receiving the data [001], [010], [011], [100], [101], [110] and [111], outputs 10V, 15V, 30V, 0V, −10V, −15V, and −30V, respectively. In the above configuration, in order to realize the driving waveforms shown in Table 1, the LUT group data is shown in Table 2.

For example, when the display state (C, M, Y)=(0.5, 1, 0.5), since the relative color density (C)=[01], the relative color density (M)=[10], and the relative color density (Y)=[01], and therefore, the row number of the LUT "m"=[011001]. At this point of time, according to Table 1, since the driving waveforms are obtained by being multiplied by −30 V for 2 sub-frames in the resetting period, WF1[011001]=[111] and WF2 [011001]=[111] and, in the first sub-frame group period, since the driving waveforms are obtained by being multiplied by 30V for one sub-frame and, then, 0V for one sub-frame, WF3[011001]=[011] and WF4 [011001]=[000]. In the second sub-frame group period, since the driving waveforms are obtained by being multiplied by 15V for 2 sub-frames and, then, by 0V for 2 sub-frames, as a result, WF5 [011001]=[010], WF6[011001]=[010], WF7[011001]=[000], and WF8 [011001]=[000], and, in the third sub-frame group period, the driving waveforms are obtained by being multiplied by −10V for sub-frames, WF9[011001]=[101], WF10[011001]=[101], WF11 [011001]=[101], WF12[011001]=[000], WF13 [011001]=[000], and WF14 [011001]=[000]. And then, finally the driving waveforms terminate at 0V and, therefore, WF15[011001]=[000]. The correspondence relation between other driving waveform and each element of the LUT is the same.

TABLE 2

LUT Configuration
[000] = 0 V, [001] = 10 V, [010] = 15 V, [011] = 30 V, [101] = −10 V, [110] = −15 V, [111] = −30 V

| Display State | | | | | | | | | | | | | | | | | |
|---|---|---|---|---|---|---|---|---|---|---|---|---|---|---|---|---|---|
| C | M | Y | m | WF1 | WF2 | WF3 | WF4 | WF5 | WF6 | WF7 | WF8 | WF9 | WF10 | WF11 | WF12 | WF13 | WF14 |
| 0 | 0 | 0 | [000000] | [111] | [111] | [000] | [000] | [000] | [000] | [000] | [000] | [000] | [000] | [000] | [000] | [000] | [000] |
| 0.5 | 0 | 0 | [000001] | [111] | [111] | [000] | [000] | [000] | [000] | [000] | [000] | [001] | [001] | [001] | [000] | [000] | [000] |
| 1 | 0 | 0 | [000010] | [111] | [111] | [000] | [000] | [000] | [000] | [000] | [000] | [001] | [001] | [001] | [001] | [001] | [001] |
| 0 | 0.5 | 0 | [000100] | [111] | [111] | [000] | [000] | [010] | [010] | [000] | [000] | [101] | [101] | [101] | [000] | [000] | [000] |
| 0.5 | 0.5 | 0 | [000101] | [111] | [111] | [000] | [000] | [010] | [010] | [000] | [000] | [000] | [000] | [000] | [000] | [000] | [000] |
| 1 | 0.5 | 0 | [000110] | [111] | [111] | [000] | [000] | [010] | [010] | [000] | [000] | [001] | [001] | [001] | [000] | [000] | [000] |
| 0 | 1 | 0 | [001000] | [111] | [111] | [000] | [000] | [010] | [010] | [010] | [010] | [101] | [101] | [101] | [101] | [101] | [101] |
| 0.5 | 1 | 0 | [001001] | [111] | [111] | [000] | [000] | [010] | [010] | [010] | [010] | [101] | [101] | [101] | [000] | [000] | [000] |
| 1 | 1 | 0 | [001010] | [111] | [111] | [000] | [000] | [010] | [010] | [010] | [010] | [000] | [000] | [000] | [000] | [000] | [000] |
| 0 | 0 | 0.5 | [010000] | [111] | [111] | [011] | [000] | [110] | [110] | [000] | [000] | [000] | [000] | [000] | [000] | [000] | [000] |
| 0.5 | 0 | 0.5 | [010001] | [111] | [111] | [011] | [000] | [110] | [110] | [000] | [000] | [001] | [001] | [001] | [000] | [000] | [000] |
| 1 | 0 | 0.5 | [010010] | [111] | [111] | [011] | [000] | [110] | [110] | [000] | [000] | [001] | [001] | [001] | [001] | [001] | [001] |
| 0 | 0.5 | 0.5 | [010100] | [111] | [111] | [011] | [000] | [000] | [000] | [000] | [000] | [101] | [101] | [101] | [000] | [000] | [000] |
| 0.5 | 0.5 | 0.5 | [010101] | [111] | [111] | [011] | [000] | [000] | [000] | [000] | [000] | [000] | [000] | [000] | [000] | [000] | [000] |
| 1 | 0.5 | 0.5 | [010110] | [111] | [111] | [011] | [000] | [000] | [000] | [000] | [000] | [001] | [001] | [001] | [000] | [000] | [000] |
| 0 | 1 | 0.5 | [011000] | [111] | [111] | [011] | [000] | [010] | [010] | [000] | [000] | [101] | [101] | [101] | [101] | [101] | [101] |
| 0.5 | 1 | 0.5 | [011001] | [111] | [111] | [011] | [000] | [010] | [010] | [000] | [000] | [101] | [101] | [101] | [000] | [000] | [000] |
| 1 | 1 | 0.5 | [011010] | [111] | [111] | [011] | [000] | [010] | [010] | [000] | [000] | [000] | [000] | [000] | [000] | [000] | [000] |
| 0 | 0 | 1 | [100000] | [111] | [111] | [011] | [011] | [110] | [110] | [110] | [110] | [000] | [000] | [000] | [000] | [000] | [000] |
| 0.5 | 0 | 1 | [100001] | [111] | [111] | [011] | [011] | [110] | [110] | [110] | [110] | [001] | [001] | [001] | [000] | [000] | [000] |
| 1 | 0 | 1 | [100010] | [111] | [111] | [011] | [011] | [110] | [110] | [110] | [110] | [001] | [001] | [001] | [001] | [001] | [001] |
| 0 | 0.5 | 1 | [100100] | [111] | [111] | [011] | [011] | [110] | [110] | [000] | [000] | [101] | [101] | [101] | [000] | [000] | [000] |
| 0.5 | 0.5 | 1 | [100101] | [111] | [111] | [011] | [011] | [110] | [110] | [000] | [000] | [000] | [000] | [000] | [000] | [000] | [000] |
| 1 | 0.5 | 1 | [100110] | [111] | [111] | [011] | [011] | [110] | [110] | [000] | [000] | [001] | [001] | [001] | [000] | [000] | [000] |
| 0 | 1 | 1 | [101000] | [111] | [111] | [011] | [011] | [000] | [000] | [000] | [000] | [101] | [101] | [101] | [101] | [101] | [101] |
| 0.5 | 1 | 1 | [101001] | [111] | [111] | [011] | [011] | [000] | [000] | [000] | [000] | [101] | [101] | [101] | [000] | [000] | [000] |
| 1 | 1 | 1 | [101010] | [111] | [111] | [011] | [011] | [000] | [000] | [000] | [000] | [000] | [000] | [000] | [000] | [000] | [000] |
| Number of Elements "m" | | | | | | | | | | 27 | | | | | | | |

Circuit Configurations

Figure 15:
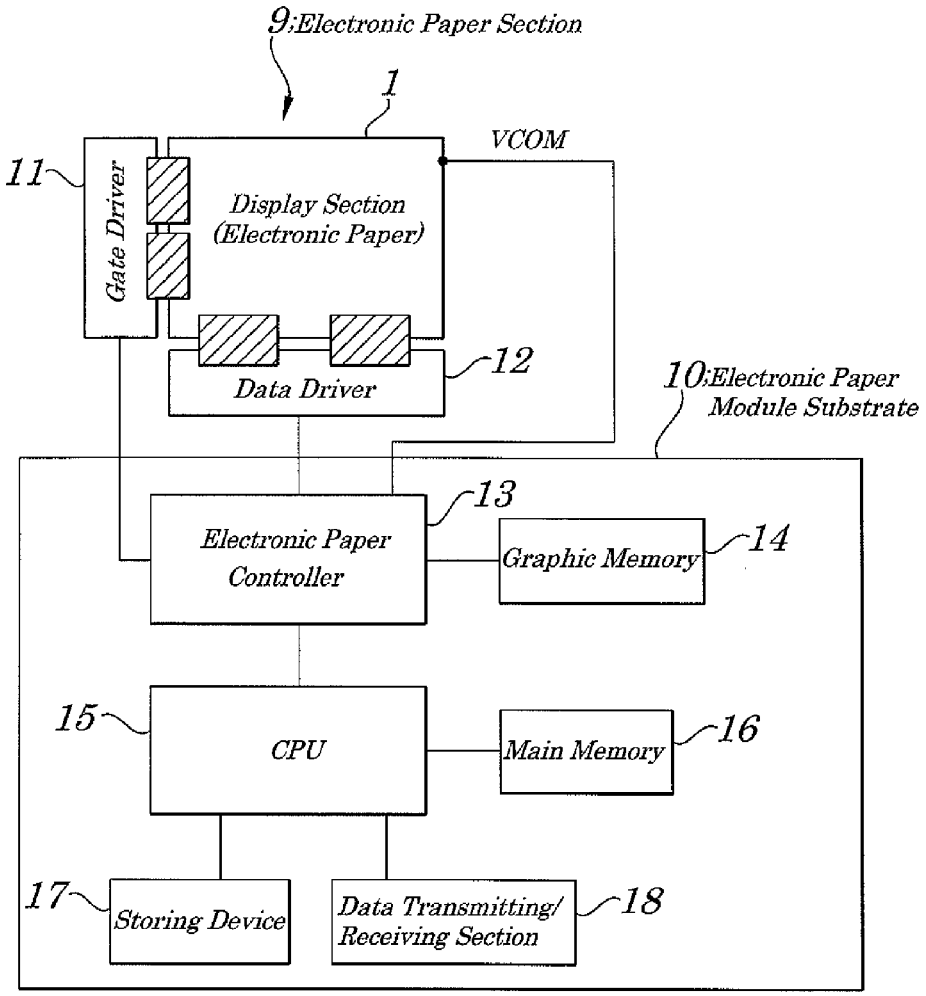
FIG. 15 is a block diagram showing electrical configurations of an electronic paper display device (image display device) of the first embodiment of the present invention.
Figure 16:
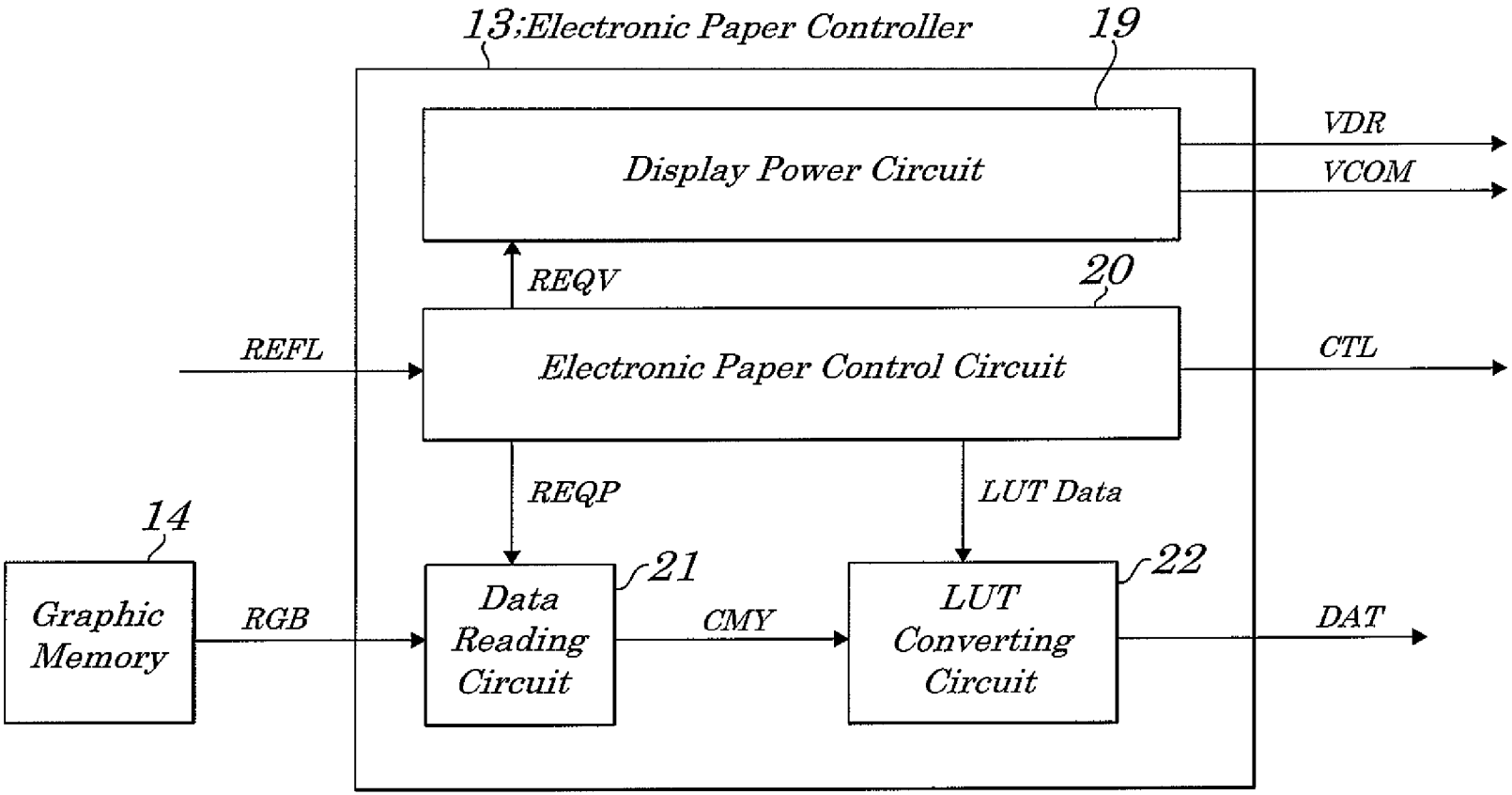
FIG. 16 is a block diagram showing, in detail, an electrophoretic paper controller making up the electronic display device of the first embodiment.
Figure 17:
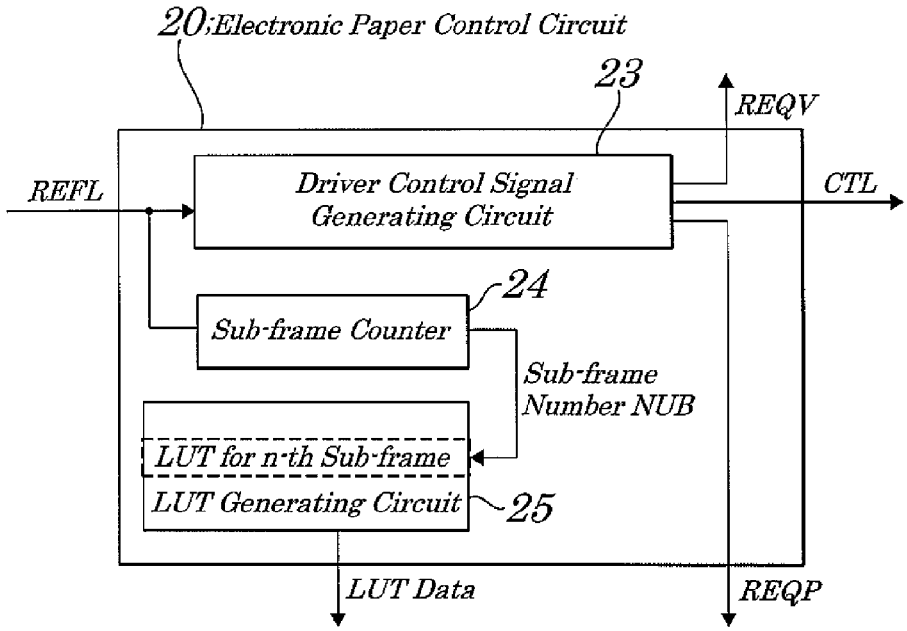
FIG. 17 is a block diagram showing, in detail, an electronic paper control circuit making up the electronic paper controller of the first embodiment.
Figure 18:
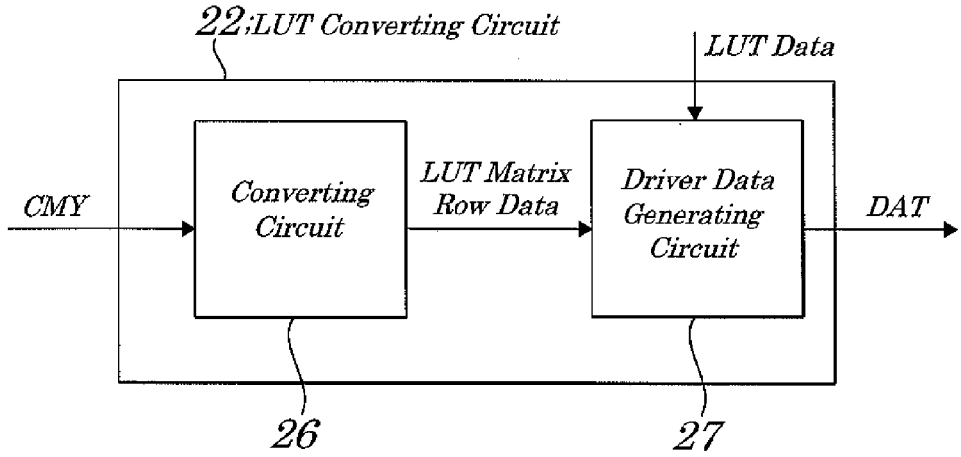
FIG. 18 is a block diagram showing, in detail, an LUT (Look Up Table) converting circuit making up the electronic paper controller of the first embodiment.

Next, circuit configurations of the embodiment are described. FIG. 15 is a block diagram showing electrical configurations of the electronic paper display device (image display device) of the first embodiment of the present invention. FIG. 16 is a block diagram showing, in detail, the electronic paper controller making up the electronic display device. FIG. 17 is a block diagram showing, in detail, an electronic paper control circuit making up the electronic paper controller. FIG. 18 is a block diagram showing, in detail, an LUT converting circuit making up the electronic paper controller.

The electronic paper display device is, as described above, an image display device to be driven by the driving method of the present embodiment and, as shown in FIG. 15, includes an electronic paper section 9 capable of displaying colors and an electronic paper module substrate 10. The electronic paper section 9 has a memory property and a display section (electronic paper) made up of the electrophoretic display device 2, 2, . . . , and a driver (voltage applying unit) to drive the display section 1. The driver is made up of a gate driver 11 to drive an shift register and a data driver 12 to output multiple values.

On the electronic paper module substrate 10, an electronic paper controller 13, a graphic memory 14 making up a frame buffer, a CPU (Central Processing Unit) 15 to control each section and to provide image data to the electronic paper controller 13, a main memory 16 such as ROM, RAM, and the like, a storing device (storage) 17 to store various image data and/or various programs, and a data transmitting/receiving section 18 made up of a wireless LAN and the like.

The electronic paper controller 13 has a circuit configuration serving as a control voltage control means to realize a driving waveform appearing at the time of renewal, as shown in FIG. 4 to FIG. 12, by using the LUT group WFn ("n" is 1 to 5, however, the WF15 is not shown in the drawing) and the voltage control means includes, as shown in FIG. 16, a display power circuit 19, an electronic paper control circuit 20, a data reading circuit 21, and an LUT converting circuit 22.

The data reading circuit 21 reads RGB data which represents color gray levels of pixels of a renewed image (next screen N) written by the CPU into the graphic memory 14 and, after converting once the RGB data into a given color La*b*, further converts the display color data into corresponding CMY relative color density data to transmit the data to the LUT converting circuit 22. The converted CMY relative color density data is expressed by 8-bit binary number and its high-order 2 bits take a value [00] and its subsequent 2 bits represent gray levels of a Y (yellow) color being set so as to take values [00], [01], and [10] and its subsequent 2 bits represents gray levels M (magenta color) being set so as to take values [00], [01], and [10] and, further, its low-order 2 bits represent gray levels of a C (cyan) color being set so as to take values [00], [01], and [10]. However, the relative color density data corresponding to gray levels of the CMY is not limited to the above and, so long as there is one to one relation therebetween, another different data may be used. Moreover, the CPU 15 may store, instead of RGB data, converted CMP relative color density data into the graphic memory 14.

The display power circuit 19, in response to a power output demand signal REQV transmitted from the electronic paper control circuit 20, provides a plurality of reference voltages VDR to the drivers 11 and 12 of the electronic paper section 9 and provides a COM voltage VCOM to be applied to a facing electrode (common electrode) to determine a reference potential of the electronic paper section 9.

The electronic paper control circuit 20, as shown in FIG. 17, is made up of a driver control signal generating circuit 23, a sub-frame counter 24, and an LUT generating circuit 25. The driver control signal generating circuit 23, when receiving a screen renewing command signal REFL from the CPU 15, outputs a driver control signal CQP to the gate driver 11 of the electronic paper section 9 and to the data driver 12 and, at the same time, outputs a gray level data reading demand signal REQP in every clock (for every pixel) to the data reading circuit 21. Moreover, the driver control signal generating circuit 23 outputs a power output demand signal REQV to the display power circuit 19.

The sub-frame counter 24, when receiving the screen renewing command signal, begins to count sub-frames and count up the sub-frames required for renewing a screen and outputs a sub-frame number NUB showing that the driving processing for the n-th sub-frame is now being performed.

The LUT generating circuit 25 stores the LUT group data shown in Table 2 and outputs LUT data corresponding to a current sub-frame number to the LUT converting circuit 22. Moreover, here, another circuit configuration is allowed in which a nonvolatile memory stores the LUT group data and the LUT generating circuit 25 reads the LUT data corresponding to the sub-frame number.

The LUT converting circuit 22, as shown in FIG. 18, is made up of a converting circuit 26 and a driver data generating circuit 27. The converting circuit 26 deletes high-order 2 bits of 8-bit CMY relative color density data transmitted from the data reading circuit 21 and converts the data into an LUT matrix row number "m" to output the converted data to the driver data generating circuit 27. The driver data generating circuit 27, by referring to the LUT data outputted from the electronic paper control circuit 20, outputs an LUT matrix element corresponding to the LUT matrix row number "m" outputted from the converting circuit 26, as driver data DAT, to the drivers 11 and 12 of the electronic paper section 9. Thus, the electronic paper controller 13 outputs the driver data DAT to realize driving waveforms shown in FIGS. 4 to 12.

Operations of Circuits

Figure 19:
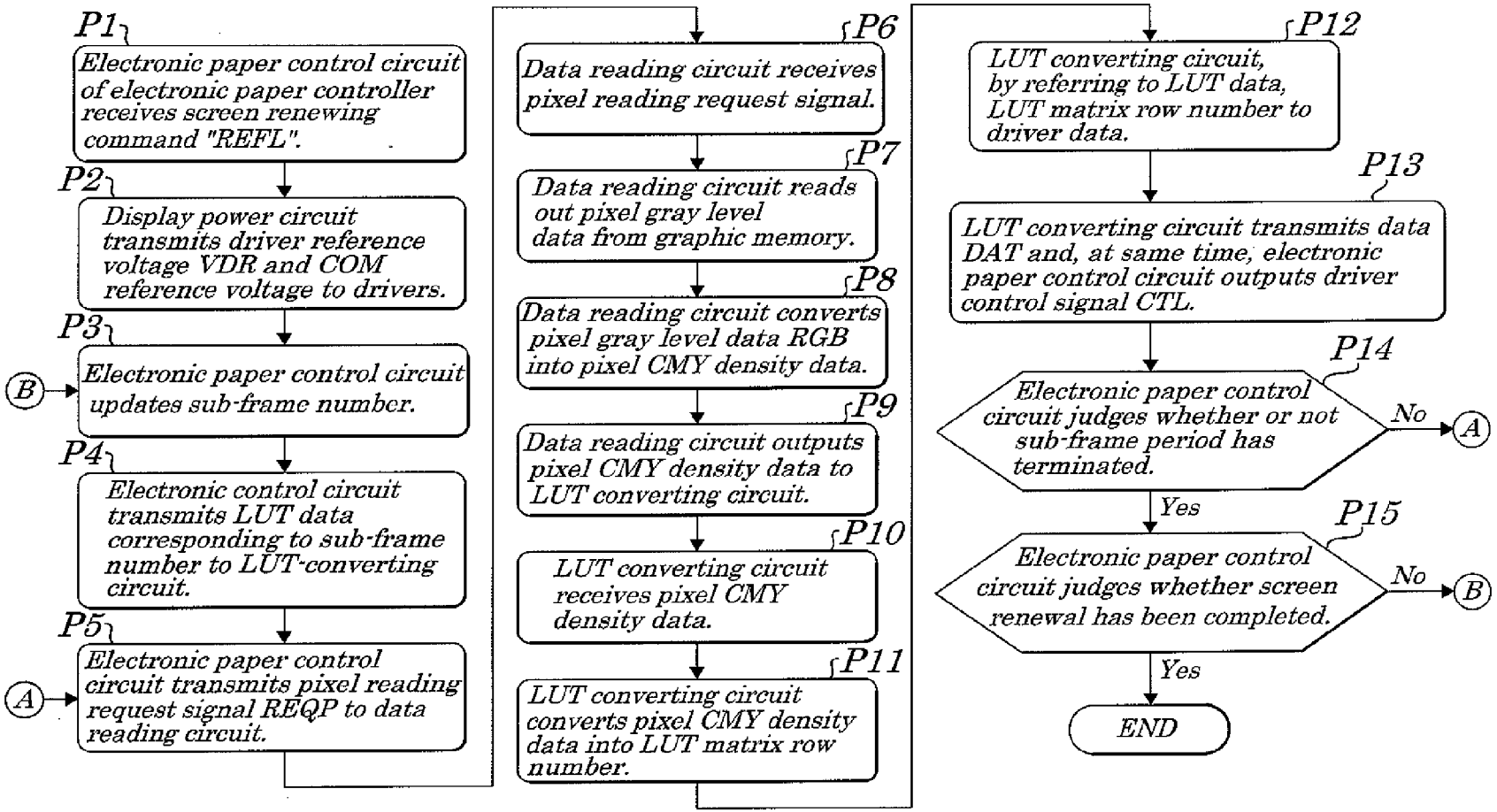
FIG. 19 is a flow-chart showing a flow of an image renewing operations to be performed by an electronic paper controller.

Next, by referring to FIG. 19, circuit operations of the electronic paper controller 13 having configurations described above are described. FIG. 19 is a flow chart showing a flow of screen renewing operations to be performed by the electronic paper controller 13.

The electronic paper controller 13, when the electronic paper control circuit 20 receives a screen renewing command signal REFL in a stand-by state, starts the screen renewing operations (Step P1). The display power circuit 19 transmits a driver reference voltage VDR and COM voltage VCOM to drivers 11 and 12 (Step P2).

The electronic paper control circuit 20 updates a sub-frame number by using the sub-frame counter 24. The electronic paper control circuit 20 transmits LUT data corresponding to the updated sub-frame number to the LUT converting circuit 22 (Step P4). Next, the electronic paper control circuit 20 transmits a pixel reading request signal REQP to the data reading circuit 21 (Step P5). Then, the data reading circuit 21 receives a pixel reading request signal REQP (Step P6) and reads pixel gray level data RGB from graphic memory 14 (Step P7). Further, the data reading circuit 21 converts pixel gray level data RGB into CMY density data (Step P8) and outputs the converted data to the LUT converting circuit 22 (Step P9).

Next, the LUT converting circuit 22 receives the pixel CMY density data (Step P10) and converts pixel CMY density data into the LUT matrix row number data "m" (Step P11). The LUT converting circuit 22, by referring to the LUT data, converts the LUT matrix row number into driver data DAT being element data of a corresponding LUT (Step P12). Then, the LUT converting circuit 22 transmits driver data DAT to the data driver and, at the same time, the electronic paper control circuit 22 transmits a driver control signal CTL to the gate driver 11 and to data driver 12 (Step P13). The electronic paper control circuit 20 judges whether or a sub-frame period has terminated and, if the sub-frame has not yet terminated, the process returns back to Step 5. At the time of termination of the sub-frame, the process proceeds to Step 15 (Step P14). Next, the electronic paper control circuit 20 judges whether or not the screen renewal has been completed and, if not completed yet, the process proceeds to Step P3 and, if completed, a termination process including power-off procedure is performed (Step P15). Thus, according to the present embodiment, by introducing a predetermined intermediate transition state, a given color (La*b*) containing an intermediate color and shades of gray can be displayed.

Second Embodiment

Next, the second embodiment of the present invention is described. In this embodiment, in order to realize the driving waveforms shown in Table 1, a method for creating a look-up table (LUT) being different from that used in the first embodiment.

TABLE 3

LUT Configuration
[000] = 0 V, [001] = 10 V, [010] = 15 V, [011] = 30 V,
[101] = −10 V, [110] = −15 V, [111] = −30 V

| Display State | | | m | | | | Display State | | | m | | |
|---|---|---|---|---|---|---|---|---|---|---|---|---|
| C | M | Y | | WF1 | WF2 | WF15 | C | M | Y | Y | WF3 | WF4 |
| 0 | 0 | 0 | | [111] | [111] | [000] | 0 | 0 | 0 | [00] | [000] | [000] |
| 0.5 | 0 | 0 | | [111] | [111] | [000] | 0.5 | 0 | 0 | [00] | [000] | [000] |
| 1 | 0 | 0 | | [111] | [111] | [000] | 1 | 0 | 0 | [00] | [000] | [000] |
| 0 | 0.5 | 0 | | [111] | [111] | [000] | 0 | 0.5 | 0 | [00] | [000] | [000] |
| 0.5 | 0.5 | 0 | | [111] | [111] | [000] | 0.5 | 0.5 | 0 | [00] | [000] | [000] |
| 1 | 0.5 | 0 | | [111] | [111] | [000] | 1 | 0.5 | 0 | [00] | [000] | [000] |
| 0 | 1 | 0 | | [111] | [111] | [000] | 0 | 1 | 0 | [00] | [000] | [000] |
| 0.5 | 1 | 0 | | [111] | [111] | [000] | 0.5 | 1 | 0 | [00] | [000] | [000] |
| 1 | 1 | 0 | | [111] | [111] | [000] | 1 | 1 | 0 | [00] | [000] | [000] |
| 0 | 0 | 0.5 | | [111] | [111] | [000] | 0 | 0 | 0.5 | [01] | [011] | [000] |
| 0.5 | 0 | 0.5 | | [111] | [111] | [000] | 0.5 | 0 | 0.5 | [01] | [011] | [000] |
| 1 | 0 | 0.5 | | [111] | [111] | [000] | 1 | 0 | 0.5 | [01] | [011] | [000] |
| 0 | 0.5 | 0.5 | | [111] | [111] | [000] | 0 | 0.5 | 0.5 | [01] | [011] | [000] |
| 0.5 | 0.5 | 0.5 | | [111] | [111] | [000] | 0.5 | 0.5 | 0.5 | [01] | [011] | [000] |
| 1 | 0.5 | 0.5 | | [111] | [111] | [000] | 1 | 0.5 | 0.5 | [01] | [011] | [000] |
| 0 | 1 | 0.5 | | [111] | [111] | [000] | 0 | 1 | 0.5 | [01] | [011] | [000] |
| 0.5 | 1 | 0.5 | | [111] | [111] | [000] | 0.5 | 1 | 0.5 | [01] | [011] | [000] |
| 1 | 1 | 0.5 | | [111] | [111] | [000] | 1 | 1 | 0.5 | [01] | [011] | [000] |
| 0 | 0 | 1 | | [111] | [111] | [000] | 0 | 0 | 1 | [11] | [011] | [011] |
| 0.5 | 0 | 1 | | [111] | [111] | [000] | 0.5 | 0 | 1 | [11] | [011] | [011] |
| 1 | 0 | 1 | | [111] | [111] | [000] | 1 | 0 | 1 | [11] | [011] | [011] |
| 0 | 0.5 | 1 | | [111] | [111] | [000] | 0 | 0.5 | 1 | [11] | [011] | [011] |
| 0.5 | 0.5 | 1 | | [111] | [111] | [000] | 0.5 | 0.5 | 1 | [11] | [011] | [011] |
| 1 | 0.5 | 1 | | [111] | [111] | [000] | 1 | 0.5 | 1 | [11] | [011] | [011] |
| 0 | 1 | 1 | | [111] | [111] | [000] | 0 | 1 | 1 | [11] | [011] | [011] |
| 0.5 | 1 | 1 | | [111] | [111] | [000] | 0.5 | 1 | 1 | [11] | [011] | [011] |
| 1 | 1 | 1 | | [111] | [111] | [000] | 1 | 1 | 1 | [11] | [011] | [011] |
| Number of Elements "m" | | | | | 1 | | Number of Elements "m" | | | | 3 | |

| Display State | | | M − Y | m M − Y | | | | |
|---|---|---|---|---|---|---|---|---|
| C | M | Y | | | WF5 | WF6 | WF7 | WF8 |
| 0 | 0 | 0 | 0 | [000] | [000] | [000] | [000] | [000] |
| 0.5 | 0 | 0 | 0 | [000] | [000] | [000] | [000] | [000] |
| 1 | 0 | 0 | 0 | [000] | [000] | [000] | [000] | [000] |
| 0 | 0.5 | 0 | 0.5 | [001] | [010] | [010] | [000] | [000] |
| 0.5 | 0.5 | 0 | 0.5 | [001] | [010] | [010] | [000] | [000] |
| 1 | 0.5 | 0 | 0.5 | [001] | [010] | [010] | [000] | [000] |
| 0 | 1 | 0 | 1 | [010] | [010] | [010] | [010] | [010] |
| 0.5 | 1 | 0 | 1 | [010] | [010] | [010] | [010] | [010] |
| 1 | 1 | 0 | 1 | [010] | [010] | [010] | [010] | [010] |
| 0 | 0 | 0.5 | −0.5 | [101] | [110] | [110] | [000] | [000] |
| 0.5 | 0 | 0.5 | −0.5 | [101] | [110] | [110] | [000] | [000] |
| 1 | 0 | 0.5 | −0.5 | [101] | [110] | [110] | [000] | [000] |
| 0 | 0.5 | 0.5 | 0 | [000] | [000] | [000] | [000] | [000] |
| 0.5 | 0.5 | 0.5 | 0 | [000] | [000] | [000] | [000] | [000] |
| 1 | 0.5 | 0.5 | 0 | [000] | [000] | [000] | [000] | [000] |
| 0 | 1 | 0.5 | 0.5 | [001] | [010] | [010] | [000] | [000] |
| 0.5 | 1 | 0.5 | 0.5 | [001] | [010] | [010] | [000] | [000] |
| 1 | 1 | 0.5 | 0.5 | [001] | [010] | [010] | [000] | [000] |
| 0 | 0 | 1 | −1 | [110] | [110] | [110] | [110] | [110] |
| 0.5 | 0 | 1 | −1 | [110] | [110] | [110] | [110] | [110] |
| 1 | 0 | 1 | −1 | [110] | [110] | [110] | [110] | [110] |
| 0 | 0.5 | 1 | −0.5 | [101] | [110] | [110] | [000] | [000] |
| 0.5 | 0.5 | 1 | −0.5 | [101] | [110] | [110] | [000] | [000] |
| 1 | 0.5 | 1 | −0.5 | [101] | [110] | [110] | [000] | [000] |
| 0 | 1 | 1 | 0 | [000] | [000] | [000] | [000] | [000] |

TABLE 3-continued

| LUT Configuration [000] = 0 V, [001] = 10 V, [010] = 15 V, [011] = 30 V, [101] = −10 V, [110] = −15 V, [111] = −30 V | | | | | | | | | | |
|---|---|---|---|---|---|---|---|---|---|---|
| | | 0.5 | 1 | 1 | 0 | [000] | [000] | [000] | [000] | [000] |
| | | 1 | 1 | 1 | 0 | [000] | [000] | [000] | [000] | [000] |
| | | Number of Elements "m" | | | | | 5 | | | |
| Display State | | | C − | m C − | | | | | | |
| C | M | Y | M | M | WF9 | WF10 | WF11 | WF12 | WF13 | WF14 |
| 0 | 0 | 0 | 0 | [000] | [000] | [000] | [000] | [000] | [000] | [000] |
| 0.5 | 0 | 0 | 0.5 | [001] | [001] | [001] | [001] | [000] | [000] | [000] |
| 1 | 0 | 0 | 1 | [010] | [001] | [001] | [001] | [001] | [001] | [001] |
| 0 | 0.5 | 0 | −0.5 | [101] | [101] | [101] | [101] | [000] | [000] | [000] |
| 0.5 | 0.5 | 0 | 0 | [000] | [000] | [000] | [000] | [0001 | [000] | [000] |
| 1 | 0.5 | 0 | 0.5 | [001] | [001] | [001] | [001] | [000] | [000] | [000] |
| 0 | 1 | 0 | −1 | [110] | [101] | [101] | [101] | [101] | [101] | [101] |
| 0.5 | 1 | 0 | −0.5 | [101] | [101] | [101] | [101] | [000] | [000] | [000] |
| 1 | 1 | 0 | 0 | [000] | [000] | [000] | [000] | [000] | [000] | [000] |
| 0 | 0 | 0.5 | 0 | [000] | [000] | [000] | [000] | [000] | [000] | [000] |
| 0.5 | 0 | 0.5 | 0.5 | [001] | [001] | [001] | [001] | [000] | [000] | [000] |
| 1 | 0 | 0.5 | 1 | [010] | [001] | [001] | [001] | [001] | [001] | [001] |
| 0 | 0.5 | 0.5 | −0.5 | [101] | [101] | [101] | [101] | [000] | [000] | [000] |
| 0.5 | 0.5 | 0.5 | 0 | [000] | [000] | [000] | [000] | [000] | [000] | [000] |
| 1 | 0.5 | 0.5 | 0.5 | [001] | [001] | [001] | [001] | [000] | [000] | [000] |
| 0 | 1 | 0.5 | −1 | [110] | [101] | [101] | [101] | [101] | [101] | [101] |
| 0.5 | 1 | 0.5 | −0.5 | [101] | [101] | [101] | [101] | [000] | [000] | [000] |
| 1 | 1 | 0.5 | 0 | [000] | [000] | [000] | [000] | [000] | [000] | [000] |
| 0 | 0 | 1 | 0 | [000] | [000] | [000] | [000] | [000] | [000] | [000] |
| 0.5 | 0 | 1 | 0.5 | [001] | [001] | [001] | [001] | [000] | [000] | [000] |
| 1 | 0 | 1 | 1 | [010] | [001] | [001] | [001] | [001] | [001] | [001] |
| 0 | 0.5 | 1 | −0.5 | [101] | [101] | [101] | [101] | [000] | [000] | [000] |
| 0.5 | 0.5 | 1 | 0 | [000] | [000] | [000] | [000] | [000] | [000] | [000] |
| 1 | 0.5 | 1 | 0.5 | [001] | [001] | [001] | [001] | [000] | [000] | [000] |
| 0 | 1 | 1 | −1 | [110] | [101] | [101] | [101] | [101] | [101] | [101] |
| 0.5 | 1 | 1 | −0.5 | [101] | [101] | [101] | [101] | [000] | [000] | [000] |
| 1 | 1 | 1 | 0 | [000] | [000] | [000] | [000] | [000] | [000] | [000] |
| Number of Elements "m" | | | | | | | 5 | | | |

As is understood from Table 1, during resetting periods (Ra, Rb) (and during 0V terminating sub-frame), irrespective of a targeted renewal display state (C, M, Y), a constant voltage is being applied. During the first sub-frame group periods (1*a*, 1*b*), out of renewed display states (C, M, Y), the applied voltages change depending on a relative color density (Y) of the charged particle Y and not on the relative color density (C) and (M) of charged particles C and M. Moreover, during the second sub-frame group periods (2*a*, 2*b*, 2*c*, and 2*d*), out of renewed display states (C, M, Y), applied voltages change depending on a relative color density difference (M−Y) between the charged particle M and charged particle Y and not on the relative color density of the charged particle C. Moreover, during the third sub-frame periods (3*a*, 3*b*, 3*c*, 3*d*, 3*e*, and 3*f*), out of the renewed display states, applied voltages change depending on a relative color density difference (C−M) between the charged particle C and charged particle M and not on the relative color density (Y) of the charged particle Y.

Therefore, by preparing, as shown in Table 3, an LUT group R_WF (n=1, 2, 15) of the resetting period, the LUT group S1_WF of the first sub-frame period, LUT group S2_WF of the second sub-frame period, LUT group S3_WF of the third sub-frame, the simplification of the LUTs is made possible.

The LUT group R_WFn is set to be [000] in the resetting period (and 0V terminating sub-frame), irrespective of a targeted renewal display state, the LUT group R_WF1 is set to be [111] in the first sub-frame, LUT group R_WF2 is set to be [111] in the second sub-frame, and LUT group R_WF15 is set to be [000] in the fifteenth frame. The R_WFn being the LUT corresponding to the resetting period has only one matrix element.

The LUT group S1_WFn (n=3, 4) in the first sub-frame group period has a matrix element corresponding to the relative color density (Y) of the charged particle Y of the targeted renewal display state and, if the relative color density (Y) is 0, 0.5, 1 and the element is [00], [01], [10], S1_WF3 ([10])=[000] in the first sub-frame (third sub-frame counted from a start of renewing) and S1_WF3 ([01])=[011] and S1_WF3 ([10])=[011], and, in the second sub-frames, for driver signal, S1_WF4 ([01])=[000], S1_WF4 ([10])=[011]. As a result, the number of matrix elements of the S1_WFn is 3.

Similarly, the LUT group S2_WFn (n=5 to 8) in the second sub-frame group period has a matrix element corresponding to the relative color density (M−Y) of the targeted renewal display state of pixels and, if the M−Y value is 0, 0.5, 1, −0.5, −1, the element is [010], [101], [110], the value in each sub-frame becomes the value shown in Table 1 and, as a result, the number of matrix elements of the S1_WFn is 5.

Also, similarly, the LUT group S3_WFn (n=9 to 14) in the third sub-frame group period has a matrix element corresponding to the relative color density (C−M) of the targeted renewal display state of pixels and, if the C-M value is 0, 0.5, 1, −0.5, −1, its element is [000], [001], [010] and [110], and the value in each sub-frame becomes as shown in Table 1 and, as a result, the number of matrix elements of the S3_WFn is 5.

Figure 20:
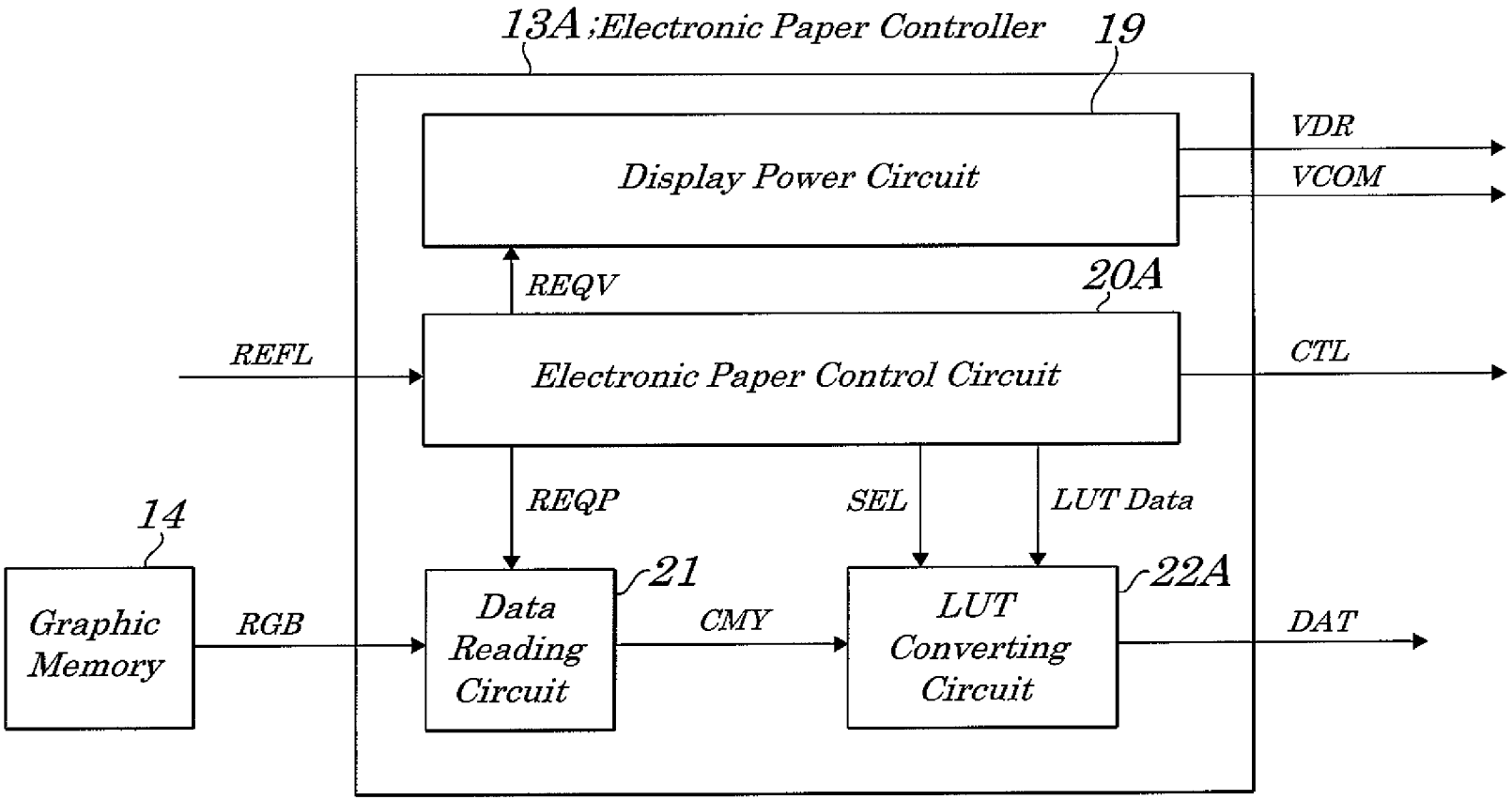
FIG. 20 is a block diagram showing, in detail, an electronic paper controller making up an electronic paper display device according to a second embodiment of the present invention.
Figure 21:
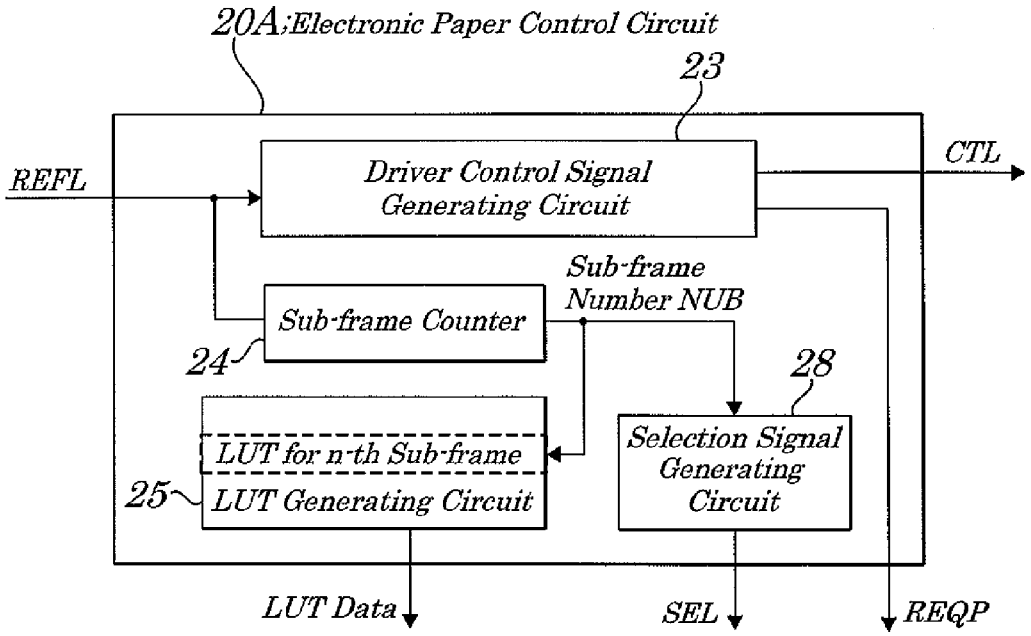
FIG. 21 is a block diagram showing, in detail, an electronic paper control circuit making up the electronic paper controller.
Figure 22:
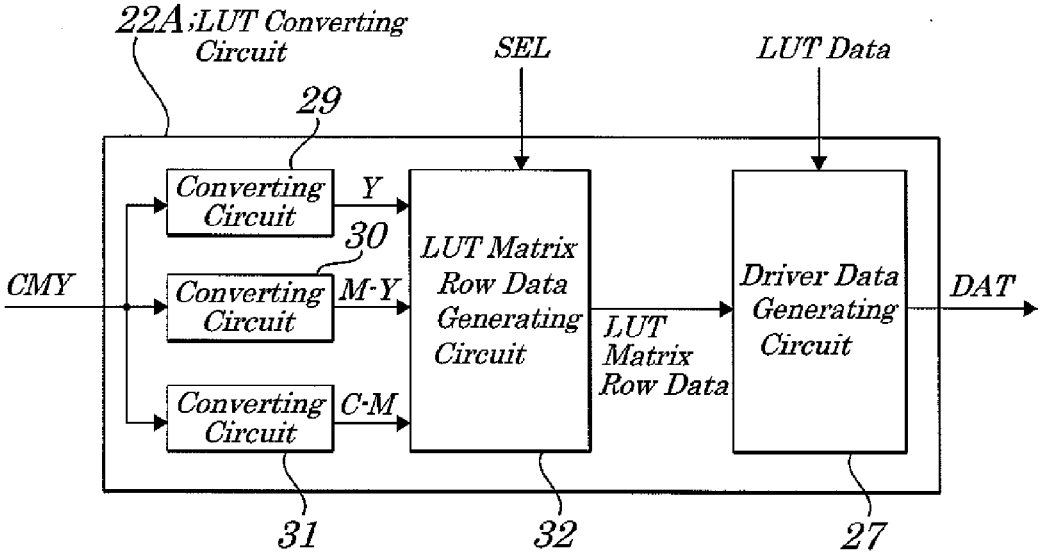
FIG. 22 is a block diagram showing, in detail, an LUT converting circuit making up the electronic paper controller.

FIG. 20 is a block diagram showing, in detail, an electronic paper controller making up an electronic paper display device of the second embodiment of the present invention. FIG. 21 is a block diagram showing, in detail, the electronic paper control circuit of the second embodiment. FIG. 22 is a block diagram showing, in detail, the LUT converting circuit making up the electronic paper controller of the second embodiment.

The electronic paper controller 13A has circuit configurations serving as an voltage control means to obtain the driving waveforms shown in FIGS. 4 to 12, using the LUT groups R_EFn, S1_WFn, specifically, as shown in FIG. 20, a display power circuit 19, an electronic paper control circuit 20A, a data reading circuit 21, and an LUT converting circuit 22*a*. Moreover, in FIG. 20, same reference numbers are assigned to same configuration components as those in FIG. 16 (First Embodiment) to omit or simplify their descriptions. As a result, the LUT group R_WFn, S1_WFn, . . . , since their matrix element is maximum 5 rows and 1 column, are united to be 5 rows and 1 columns.

The electronic paper control circuit 20A, as shown in FIG. 21, is made up of a driver control signal generating circuit 23, a sub-frame counter 24, an LUT generating circuit 25, and a selection signal generating circuit 28. The electronic paper control circuit 20A is different from the electronic paper control circuit 20 described above in that the circuit 20A is provided with the selection signal generation circuit 20A. The above selection signal generation circuit 28 receives a sub-frame number NUB from the sub-frame counter 24 and outputs a selection signal SEL to show to which period, out of the resetting period, first sub-frame group period, second sub-frame group period, and third sub-frame group period, the current sub-frame number NUB belongs, to the LUT converting circuit 22A.

The LUT converting circuit 22A, as shown in FIG. 22, includes a converting circuit 29, a converting circuit 30, a converting circuit 31, an LUT matrix row data generating circuit 32, and a driver data generating circuit 27. The converting circuit 29 reads fifth and sixth bits CMY [4:5] making up CMY being data representing a density value of Y (yellow) from CMY relative color density data and outputs the data as a Y signal. Similarly, the converting circuit 30 reads third and fourth bits CMY [2:3] making up the CMY being data representing a density value of M (Magenta) of CMY relative color density data and fifth and sixth bits CMY [4:5] representing a density value of Y (yellow) and, according to Table 3, calculates a (M−Y) signal and outputs the calculation result. Further, the converting circuit 31 reads first and second bits CMY [0:1] making up CMY being data representing a density value of cyan C of CMY relative color density data and the fourth bit [2:3] representing a density value of M (magenta) in accordance with Table 3, calculates a [C−M] signal and outputs the calculation result.

The LUT matrix row data generating circuit 32, judges, according to a selection signal SEL, to which period, out of the resetting period, first sub-frame group period, second sub-frame group period, and the sub-frame group period, the present period belongs to and, when the present period belongs to the resetting period, the LUT matrix row data "m" is to be [000] and, when the present period belongs to the first sub-frame, "m" corresponding to Y data is outputted as LUT matrix row data and, when the present period belongs to the second sub-frame group period, "m" corresponding to (M−Y) data is outputted as the LUT matrix row data and, when the present period belongs to the third sub-frame group period, "m" corresponding to (C−M) data is outputted as the LUT matrix row data.

The driver data generating circuit 27, by referring to the LUT data outputted from the electronic paper control circuit 20A, outputs an LUT matrix element corresponding to the LUT matrix row number "m" outputted from the LUT matrix row data generating circuit 32, as driver DAT. Thus, the electronic paper controller 13A outputs driver data DAT to realize the driving waveforms shown in FIGS. 4 to 12.

Operations of Circuits

Operations of circuits of the second embodiment are basically the same as those shown in FIG. 19 (first embodiment), that is, though, in the first embodiment, the LUT converting circuit converts the pixel CMY density data into the LUT matrix row number "m", in the second embodiment, during a part of the period in which the LUT converting circuit 22*a* converts pixel CMY density into the ULT matrix row number s in Step P1, the selection method is selected depending on whether or not the present period is a resetting period or the first to third sub-frame group periods, except in the case where the conversion to LUT matrix row number is necessary, the operations are basically the same as in the first embodiment and, therefore, descriptions are simply made in the second embodiment.

Thus, according to the second embodiment, the driving device having the same look-up table size and being simple as that in the first embodiment can be realized, thereby capable of simplifying the LUT configuration or the circuit configuration of the second embodiment.

Third Embodiment

Next, the third embodiment is described below. In the third embodiment, some devices are allowed to decrease the number of the sub-frames based on the driving method employed in the first embodiment. As is understood from Table 3, in the sub-frames for applying 0V, particles are not moved and, therefore, the decreasing the number of sub-frames is made possible. Table 4 shows that the number of sub-frames is decreased during which 0V is applied and necessary number of sub-frames is described. In this case, the number of effective sub-frames during which voltages other than 0V are applied varies depending on the targeted renewing state and the number of the first sub-frame group periods and second sub-frame group periods also vary depending on the targeted renewal display state.

TABLE 4

| Targeted Renewing Display | | | Ground State W Resetting Period Applied Voltage | | Ground State | | | First Sub-frame Group Period Applied Voltage | | Intermediate Transition State I-1 | | | Second Sub-frame Group Period Applied Voltage | | | | Intermediate Transition State I-2 | | |
|---|---|---|---|---|---|---|---|---|---|---|---|---|---|---|---|---|---|---|---|
| C | M | Y | | | C | M | Y | | | C | M | Y | | | | | C | M | Y |
| 0 | 0 | 0 | −30 | −30 | 0 | 0 | 0 | | | 0 | 0 | 0 | | | | | 0 | 0 | 0 |
| 0.5 | 0 | 0 | −30 | −30 | 0 | 0 | 0 | | | 0 | 0 | 0 | | | | | 0 | 0 | 0 |
| 1 | 0 | 0 | −30 | −30 | 0 | 0 | 0 | | | 0 | 0 | 0 | | | | | 0 | 0 | 0 |
| 0 | 0.5 | 0 | −30 | −30 | 0 | 0 | 0 | | | 0 | 0 | 0 | 15 | 15 | | | 0.5 | 0.5 | 0 |
| 0.5 | 0.5 | 0 | −30 | −30 | 0 | 0 | 0 | | | 0 | 0 | 0 | 15 | 15 | | | 0.5 | 0.5 | 0 |
| 1 | 0.5 | 0 | −30 | −30 | 0 | 0 | 0 | | | 0 | 0 | 0 | 15 | 15 | | | 0.5 | 0.5 | 0 |
| 0 | 1 | 0 | −30 | −30 | 0 | 0 | 0 | | | 0 | 0 | 0 | 15 | 15 | 15 | 15 | 1 | 1 | 0 |
| 0.5 | 1 | 0 | −30 | −30 | 0 | 0 | 0 | | | 0 | 0 | 0 | 15 | 15 | 15 | 15 | 1 | 1 | 0 |
| 1 | 1 | 0 | −30 | −30 | 0 | 0 | 0 | | | 0 | 0 | 0 | 15 | 15 | 15 | 15 | 1 | 1 | 0 |
| 0 | 0 | 0.5 | −30 | −30 | 0 | 0 | 0 | 30 | | 0.5 | 0.5 | 0.5 | −15 | −15 | | | 0 | 0 | 0.5 |
| 0.5 | 0 | 0.5 | −30 | −30 | 0 | 0 | 0 | 30 | | 0.5 | 0.5 | 0.5 | −15 | −15 | | | 0 | 0 | 0.5 |
| 1 | 0 | 0.5 | −30 | −30 | 0 | 0 | 0 | 30 | | 0.5 | 0.5 | 0.5 | −15 | −15 | | | 0 | 0 | 0.5 |
| 0 | 0.5 | 0.5 | −30 | −30 | 0 | 0 | 0 | 30 | | 0.5 | 0.5 | 0.5 | | | | | 0.5 | 0.5 | 0.5 |
| 0.5 | 0.5 | 0.5 | −30 | −30 | 0 | 0 | 0 | 30 | | 0.5 | 0.5 | 0.5 | | | | | 0.5 | 0.5 | 0.5 |
| 1 | 0.5 | 0.5 | −30 | −30 | 0 | 0 | 0 | 30 | | 0.5 | 0.5 | 0.5 | | | | | 0.5 | 0.5 | 0.5 |
| 0 | 1 | 0.5 | −30 | −30 | 0 | 0 | 0 | 30 | | 0.5 | 0.5 | 0.5 | 15 | 15 | | | 1 | 1 | 0.5 |
| 0.5 | 1 | 0.5 | −30 | −30 | 0 | 0 | 0 | 30 | | 0.5 | 0.5 | 0.5 | 15 | 15 | | | 1 | 1 | 0.5 |
| 1 | 1 | 0.5 | −30 | −30 | 0 | 0 | 0 | 30 | | 0.5 | 0.5 | 0.5 | 15 | 15 | | | 1 | 1 | 0.5 |
| 0 | 0 | 1 | −30 | −30 | 0 | 0 | 0 | 30 | 30 | 1 | 1 | 1 | −15 | −15 | −15 | −15 | 0 | 0 | 1 |
| 0.5 | 0 | 1 | −30 | −30 | 0 | 0 | 0 | 30 | 30 | 1 | 1 | 1 | −15 | −15 | −15 | −15 | 0 | 0 | 1 |
| 1 | 0 | 1 | −30 | −30 | 0 | 0 | 0 | 30 | 30 | 1 | 1 | 1 | −15 | −15 | −15 | −15 | 0 | 0 | 1 |
| 0 | 0.5 | 1 | −30 | −30 | 0 | 0 | 0 | 30 | 30 | 1 | 1 | 1 | −15 | −15 | | | 0.5 | 0.5 | 1 |
| 0.5 | 0.5 | 1 | −30 | −30 | 0 | 0 | 0 | 30 | 30 | 1 | 1 | 1 | −15 | −15 | | | 0.5 | 0.5 | 1 |
| 1 | 0.5 | 1 | −30 | −30 | 0 | 0 | 0 | 30 | 30 | 1 | 1 | 1 | −15 | −15 | | | 0.5 | 0.5 | 1 |
| 0 | 1 | 1 | −30 | −30 | 0 | 0 | 0 | 30 | 30 | 1 | 1 | 1 | | | | | 1 | 1 | 1 |
| 0.5 | 1 | 1 | −30 | −30 | 0 | 0 | 0 | 30 | 30 | 1 | 1 | 1 | | | | | 1 | 1 | 1 |
| 1 | 1 | 1 | −30 | −30 | 0 | 0 | 0 | 30 | 30 | 1 | 1 | 1 | | | | | 1 | 1 | 1 |

| Targeted Renewing Display | | | Third Sub-frame Group Period Applied Voltage | | | | | | Renewal Display N | | | Required Number of |
|---|---|---|---|---|---|---|---|---|---|---|---|---|
| C | M | Y | | | | | | | C | M | Y | Sub-frames |
| 0 | 0 | 0 | | | | | | | 0 | 0 | 0 | 2 |
| 0.5 | 0 | 0 | 10 | 10 | 10 | | | | 0.5 | 0 | 0 | 5 |
| 1 | 0 | 0 | 10 | 10 | 10 | 10 | 10 | 10 | 1 | 0 | 0 | 8 |
| 0 | 0.5 | 0 | −10 | −10 | −10 | | | | 0 | 0.5 | 0 | 7 |
| 0.5 | 0.5 | 0 | | | | | | | 0.5 | 0.5 | 0 | 4 |
| 1 | 0.5 | 0 | 10 | 10 | 10 | | | | 1 | 0.5 | 0 | 7 |
| 0 | 1 | 0 | −10 | −10 | −10 | −10 | −10 | −10 | 0 | 1 | 0 | 12 |
| 0.5 | 1 | 0 | −10 | −10 | −10 | | | | 0.5 | 1 | 0 | 9 |
| 1 | 1 | 0 | | | | | | | 1 | 1 | 0 | 6 |
| 0 | 0 | 0.5 | | | | | | | 0 | 0 | 0.5 | 5 |
| 0.5 | 0 | 0.5 | 10 | 10 | 10 | | | | 0.5 | 0 | 0.5 | 8 |
| 1 | 0 | 0.5 | 10 | 10 | 10 | 10 | 10 | 10 | 1 | 0 | 0.5 | 11 |
| 0 | 0.5 | 0.5 | −10 | −10 | −10 | | | | 0 | 0.5 | 0.5 | 6 |
| 0.5 | 0.5 | 0.5 | | | | | | | 0.5 | 0.5 | 0.5 | 3 |
| 1 | 0.5 | 0.5 | 10 | 10 | 10 | | | | 1 | 0.5 | 0.5 | 6 |
| 0 | 1 | 0.5 | −10 | −10 | −10 | −10 | −10 | −10 | 0 | 1 | 0.5 | 11 |
| 0.5 | 1 | 0.5 | −10 | −10 | −10 | | | | 0.5 | 1 | 0.5 | 8 |
| 1 | 1 | 0.5 | | | | | | | 1 | 1 | 0.5 | 5 |
| 0 | 0 | 1 | | | | | | | 0 | 0 | 1 | 8 |
| 0.5 | 0 | 1 | 10 | 10 | 10 | | | | 0.5 | 0 | 1 | 11 |
| 1 | 0 | 1 | 10 | 10 | 10 | 10 | 10 | 10 | 1 | 0 | 1 | 14 |
| 0 | 0.5 | 1 | −10 | −10 | −10 | | | | 0 | 0.5 | 1 | 9 |
| 0.5 | 0.5 | 1 | | | | | | | 0.5 | 0.5 | 1 | 6 |
| 1 | 0.5 | 1 | 10 | 10 | 10 | | | | 1 | 0.5 | 1 | 9 |
| 0 | 1 | 1 | −10 | −10 | −10 | −10 | −10 | −10 | 0 | 1 | 1 | 10 |
| 0.5 | 1 | 1 | −10 | −10 | −10 | | | | 0.5 | 1 | 1 | 7 |
| 1 | 1 | 1 | | | | | | | 1 | 1 | 1 | 4 |

Figure 4A:
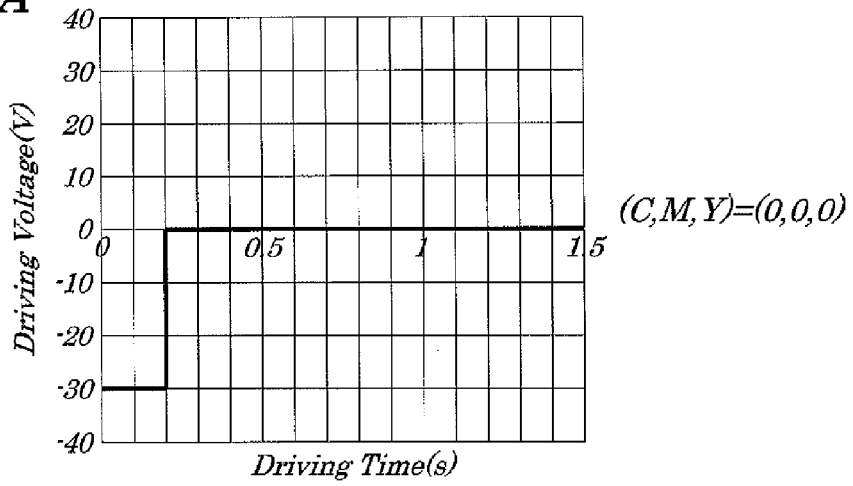
FIG. 4 is a waveform diagram showing a driving voltage waveform for explaining the driving method of displaying of intermediate colors and shades of gray according to the first embodiment.
Figure 4B:
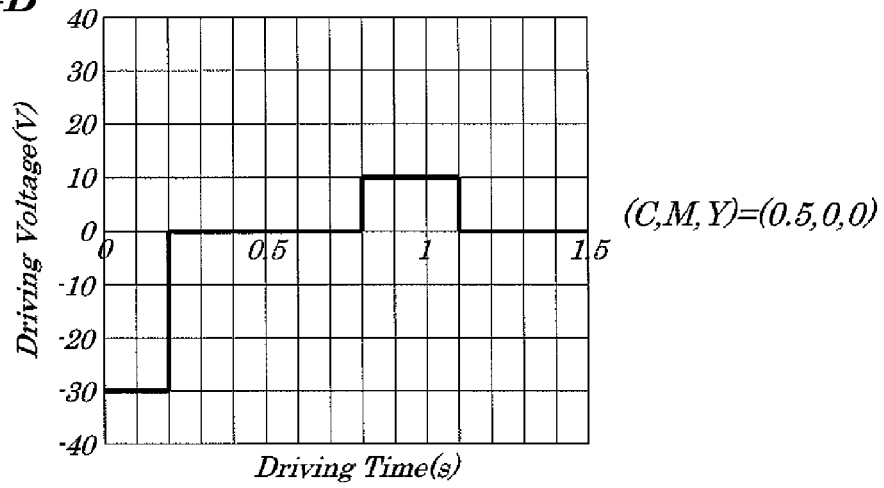
Figure 4C:
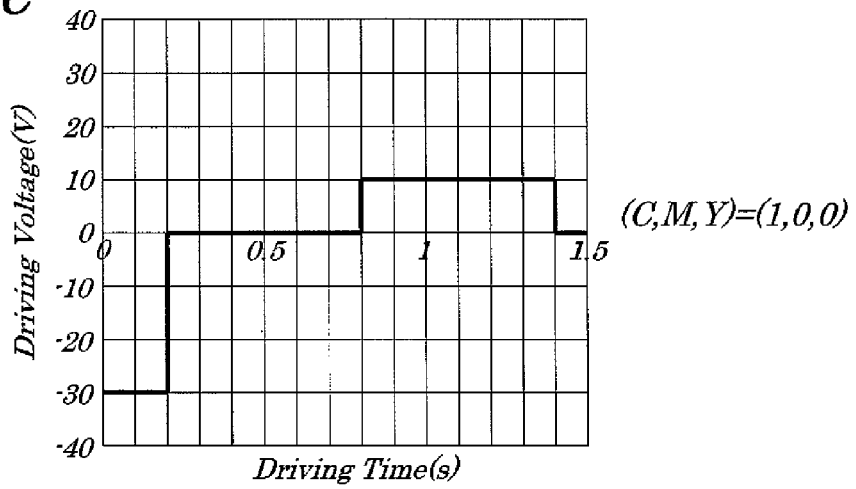
Figure 5A:
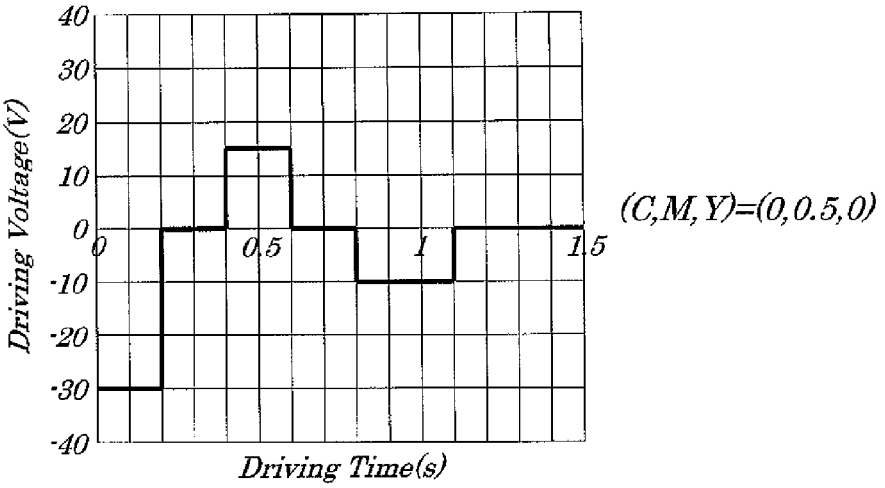
FIG. 5 is a waveform diagram showing a driving voltage waveform for explaining the driving method of the first embodiment.
Figure 5B:
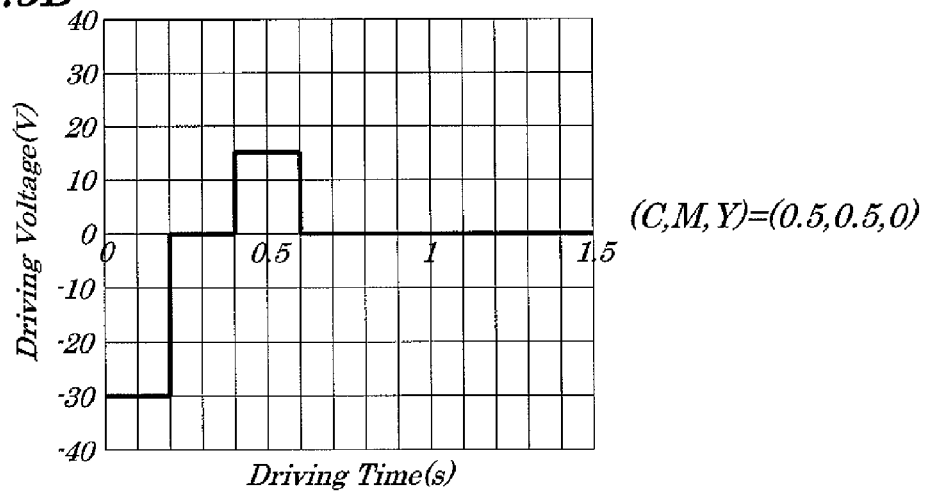
Figure 5C:
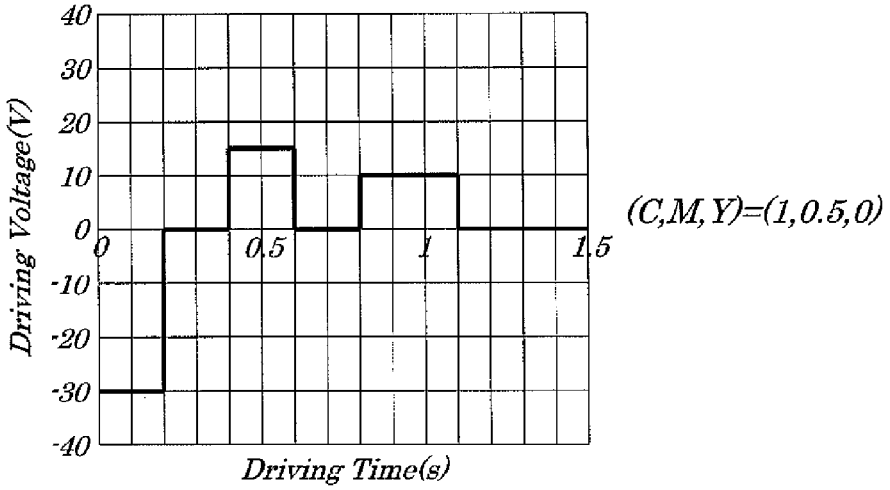

Here, as shown in FIG. 4, the required number of sub-frames becomes maximum in a case where the renewal display state has a relative color density (C, M, Y)=(1, 0, 1) and required number of sub-frames becomes 14. That is, even when the process of application of 0V is deleted, the maximum number of sub-frames is not decreased and, therefore, no effect of shortening the renewing period cannot be obtained. In Table 5, driving waveforms that can be obtained in the case where black (K) is displayed in the ground state.

TABLE 5

| Targeted Renewing Display | | | Ground State K Resetting Period: Applied Voltage | | Ground State | | | First Sub-frame Group Period: Applied Voltage | | Intermediate Transition State I-1 | | | Second Sub-frame Group Period: Applied Voltage | | | | Intermediate Transition State I-2 | | |
|---|---|---|---|---|---|---|---|---|---|---|---|---|---|---|---|---|---|---|---|
| C | M | Y | Ra | Rb | C | M | Y | 1a | 1b | C | M | Y | 2a | 2b | 2c | 2d | C | M | Y |
| 0 | 0 | 0 | 30 | 30 | 1 | 1 | 1 | −30 | −30 | 0 | 0 | 0 | | | | | 0 | 0 | 0 |
| 0.5 | 0 | 0 | 30 | 30 | 1 | 1 | 1 | −30 | −30 | 0 | 0 | 0 | | | | | 0 | 0 | 0 |
| 1 | 0 | 0 | 30 | 30 | 1 | 1 | 1 | −30 | −30 | 0 | 0 | 0 | | | | | 0 | 0 | 0 |
| 0 | 0.5 | 0 | 30 | 30 | 1 | 1 | 1 | −30 | −30 | 0 | 0 | 0 | 15 | 15 | | | 0.5 | 0.5 | 0 |
| 0.5 | 0.5 | 0 | 30 | 30 | 1 | 1 | 1 | −30 | −30 | 0 | 0 | 0 | 15 | 15 | | | 0.5 | 0.5 | 0 |
| 1 | 0.5 | 0 | 30 | 30 | 1 | 1 | 1 | −30 | −30 | 0 | 0 | 0 | 15 | 15 | | | 0.5 | 0.5 | 0 |
| 0 | 1 | 0 | 30 | 30 | 1 | 1 | 1 | −30 | −30 | 0 | 0 | 0 | 15 | 15 | 15 | 15 | 1 | 1 | 0 |
| 0.5 | 1 | 0 | 30 | 30 | 1 | 1 | 1 | −30 | −30 | 0 | 0 | 0 | 15 | 15 | 15 | 15 | 1 | 1 | 0 |
| 1 | 1 | 0 | 30 | 30 | 1 | 1 | 1 | −30 | −30 | 0 | 0 | 0 | 15 | 15 | 15 | 15 | 1 | 1 | 0 |
| 0 | 0 | 0.5 | 30 | 30 | 1 | 1 | 1 | −30 | | 0.5 | 0.5 | 0.5 | −15 | −15 | | | 0 | 0 | 0.5 |
| 0.5 | 0 | 0.5 | 30 | 30 | 1 | 1 | 1 | −30 | | 0.5 | 0.5 | 0.5 | −15 | −15 | | | 0 | 0 | 0.5 |
| 1 | 0 | 0.5 | 30 | 30 | 1 | 1 | 1 | −30 | | 0.5 | 0.5 | 0.5 | −15 | −15 | | | 0 | 0 | 0.5 |
| 0 | 0.5 | 0.5 | 30 | 30 | 1 | 1 | 1 | −30 | | 0.5 | 0.5 | 0.5 | | | | | 0.5 | 0.5 | 0.5 |
| 0.5 | 0.5 | 0.5 | 30 | 30 | 1 | 1 | 1 | −30 | | 0.5 | 0.5 | 0.5 | | | | | 0.5 | 0.5 | 0.5 |
| 1 | 0.5 | 0.5 | 30 | 30 | 1 | 1 | 1 | −30 | | 0.5 | 0.5 | 0.5 | | | | | 0.5 | 0.5 | 0.5 |
| 0 | 1 | 0.5 | 30 | 30 | 1 | 1 | 1 | −30 | | 0.5 | 0.5 | 0.5 | 15 | 15 | | | 1 | 1 | 0.5 |
| 0.5 | 1 | 0.5 | 30 | 30 | 1 | 1 | 1 | −30 | | 0.5 | 0.5 | 0.5 | 15 | 15 | | | 1 | 1 | 0.5 |
| 1 | 1 | 0.5 | 30 | 30 | 1 | 1 | 1 | −30 | | 0.5 | 0.5 | 0.5 | 15 | 15 | | | 1 | 1 | 0.5 |
| 0 | 0 | 1 | 30 | 30 | 1 | 1 | 1 | | | 1 | 1 | 1 | −15 | −15 | −15 | −15 | 0 | 0 | 1 |
| 0.5 | 0 | 1 | 30 | 30 | 1 | 1 | 1 | | | 1 | 1 | 1 | −15 | −15 | −15 | −15 | 0 | 0 | 1 |
| 1 | 0 | 1 | 30 | 30 | 1 | 1 | 1 | | | 1 | 1 | 1 | −15 | −15 | −15 | −15 | 0 | 0 | 1 |
| 0 | 0.5 | 1 | 30 | 30 | 1 | 1 | 1 | | | 1 | 1 | 1 | −15 | −15 | | | 0.5 | 0.5 | 1 |
| 0.5 | 0.5 | 1 | 30 | 30 | 1 | 1 | 1 | | | 1 | 1 | 1 | −15 | −15 | | | 0.5 | 0.5 | 1 |
| 1 | 0.5 | 1 | 30 | 30 | 1 | 1 | 1 | | | 1 | 1 | 1 | −15 | −15 | | | 0.5 | 0.5 | 1 |
| 0 | 1 | 1 | 30 | 30 | 1 | 1 | 1 | | | 1 | 1 | 1 | | | | | 1 | 1 | 1 |
| 0.5 | 1 | 1 | 30 | 30 | 1 | 1 | 1 | | | 1 | 1 | 1 | | | | | 1 | 1 | 1 |
| 1 | 1 | 1 | 30 | 30 | 1 | 1 | 1 | | | 1 | 1 | 1 | | | | | 1 | 1 | 1 |

| Targeted Renewing Display | | | Third Sub-frame Group Period: Applied Voltage | | | | | | Renewal Display N | | | Required Number of Sub-frames |
|---|---|---|---|---|---|---|---|---|---|---|---|---|
| C | M | Y | 3a | 3b | 3c | 3d | 3e | 3f | C | M | Y | |
| 0 | 0 | 0 | | | | | | | 0 | 0 | 0 | 4 |
| 0.5 | 0 | 0 | 10 | 10 | 10 | | | | 0.5 | 0 | 0 | 7 |
| 1 | 0 | 0 | 10 | 10 | 10 | 10 | 10 | 10 | 1 | 0 | 0 | 10 |
| 0 | 0.5 | 0 | −10 | −10 | −10 | | | | 0 | 0.5 | 0 | 9 |
| 0.5 | 0.5 | 0 | | | | | | | 0.5 | 0.5 | 0 | 6 |
| 1 | 0.5 | 0 | 10 | 10 | 10 | | | | 1 | 0.5 | 0 | 9 |
| 0 | 1 | 0 | −10 | −10 | −10 | −10 | −10 | −10 | 0 | 1 | 0 | 14 |
| 0.5 | 1 | 0 | −10 | −10 | −10 | | | | 0.5 | 1 | 0 | 11 |
| 1 | 1 | 0 | | | | | | | 1 | 1 | 0 | 8 |
| 0 | 0 | 0.5 | | | | | | | 0 | 0 | 0.5 | 5 |
| 0.5 | 0 | 0.5 | 10 | 10 | 10 | | | | 0.5 | 0 | 0.5 | 8 |
| 1 | 0 | 0.5 | 10 | 10 | 10 | 10 | 10 | 10 | 1 | 0 | 0.5 | 11 |
| 0 | 0.5 | 0.5 | −10 | −10 | −10 | | | | 0 | 0.5 | 0.5 | 6 |
| 0.5 | 0.5 | 0.5 | | | | | | | 0.5 | 0.5 | 0.5 | 3 |
| 1 | 0.5 | 0.5 | 10 | 10 | 10 | | | | 1 | 0.5 | 0.5 | 6 |
| 0 | 1 | 0.5 | −10 | −10 | −10 | −10 | −10 | −10 | 0 | 1 | 0.5 | 11 |
| 0.5 | 1 | 0.5 | −10 | −10 | −10 | | | | 0.5 | 1 | 0.5 | 8 |
| 1 | 1 | 0.5 | | | | | | | 1 | 1 | 0.5 | 5 |
| 0 | 0 | 1 | | | | | | | 0 | 0 | 1 | 7 |
| 0.5 | 0 | 1 | 10 | 10 | 10 | | | | 0.5 | 0 | 1 | 9 |
| 1 | 0 | 1 | 10 | 10 | 10 | 10 | 10 | 10 | 1 | 0 | 1 | 12 |
| 0 | 0.5 | 1 | −10 | −10 | −10 | | | | 0 | 0.5 | 1 | 7 |
| 0.5 | 0.5 | 1 | | | | | | | 0.5 | 0.5 | 1 | 4 |
| 1 | 0.5 | 1 | 10 | 10 | 10 | | | | 1 | 0.5 | 1 | 7 |
| 0 | 1 | 1 | −10 | −10 | −10 | −10 | −10 | −10 | 0 | 1 | 1 | 8 |
| 0.5 | 1 | 1 | −10 | −10 | −10 | | | | 0.5 | 1 | 1 | 5 |
| 1 | 1 | 1 | | | | | | | 1 | 1 | 1 | 2 |

As is understood from table 5, a maximum number of sub-frames is required in a case where the renewal display state has a relative color density (C, M, Y)=(0, 1, 0) and, here, the required number of sub-frames is 14. In Tables 4 and 5, either of white (W) or black (K) is displayed during the ground state, irrespective of the renewal display state, however, in Table 6, depending on a renewal display state, the ground state is determined to be the case where the number of sub-frames is decreasing and driving waveforms are produced. As is shown in Table 6, the maximum number of sub-frames is 12 in a case where the renewal display state has a relative color density (C, M, Y)=(0, 1, 0) or (1, 0, 1). Thus, by shortening the 0V applying period and by determining the ground state where either of white (W) or black (K) is displayed on the renewal display state, it is made possible to decrease the number of sub-frames and to shorten the renewing state. Table 7 shows a look-up table corresponding to the driving waveforms.

TABLE 6

| Targeted Renewing Display | | | Resetting Period Applied Voltage | | Ground State | | | First Sub-frame Group Period Applied Voltage | Intermediate Transition State I-1 | | | Second Sub-frame Group Period Applied Voltage | | | | Intermediate Transition State I-2 | | |
|---|---|---|---|---|---|---|---|---|---|---|---|---|---|---|---|---|---|---|
| C | M | Y | | | C | M | Y | | C | M | Y | | | | | C | M | Y |
| 0 | 0 | 0 | −30 | −30 | 0 | 0 | 0 | | 0 | 0 | 0 | | | | | 0 | 0 | 0 |
| 0.5 | 0 | 0 | −30 | −30 | 0 | 0 | 0 | | 0 | 0 | 0 | | | | | 0 | 0 | 0 |
| 1 | 0 | 0 | −30 | −30 | 0 | 0 | 0 | | 0 | 0 | 0 | | | | | 0 | 0 | 0 |
| 0 | 0.5 | 0 | −30 | −30 | 0 | 0 | 0 | | 0 | 0 | 0 | 15 | 15 | | | 0.5 | 0.5 | 0 |
| 0.5 | 0.5 | 0 | −30 | −30 | 0 | 0 | 0 | | 0 | 0 | 0 | 15 | 15 | | | 0.5 | 0.5 | 0 |
| 1 | 0.5 | 0 | −30 | −30 | 0 | 0 | 0 | | 0 | 0 | 0 | 15 | 15 | | | 0.5 | 0.5 | 0 |
| 0 | 1 | 0 | −30 | −30 | 0 | 0 | 0 | | 0 | 0 | 0 | 15 | 15 | 15 | 15 | 1 | 1 | 0 |
| 0.5 | 1 | 0 | −30 | −30 | 0 | 0 | 0 | | 0 | 0 | 0 | 15 | 15 | 15 | 15 | 1 | 1 | 0 |
| 1 | 1 | 0 | −30 | −30 | 0 | 0 | 0 | | 0 | 0 | 0 | 15 | 15 | 15 | 15 | 1 | 1 | 0 |
| 0 | 0 | 0.5 | −30 | −30 | 0 | 0 | 0 | 30 | 0.5 | 0.5 | 0.5 | −15 | −15 | | | 0 | 0 | 0.5 |
| 0.5 | 0 | 0.5 | −30 | −30 | 0 | 0 | 0 | 30 | 0.5 | 0.5 | 0.5 | −15 | −15 | | | 0 | 0 | 0.5 |
| 1 | 0 | 0.5 | −30 | −30 | 0 | 0 | 0 | 30 | 0.5 | 0.5 | 0.5 | −15 | −15 | | | 0 | 0 | 0.5 |
| 0 | 0.5 | 0.5 | −30 | −30 | 0 | 0 | 0 | 30 | 0.5 | 0.5 | 0.5 | | | | | 0.5 | 0.5 | 0.5 |
| 0.5 | 0.5 | 0.5 | −30 | −30 | 0 | 0 | 0 | 30 | 0.5 | 0.5 | 0.5 | | | | | 0.5 | 0.5 | 0.5 |
| 1 | 0.5 | 0.5 | −30 | −30 | 0 | 0 | 0 | 30 | 0.5 | 0.5 | 0.5 | | | | | 0.5 | 0.5 | 0.5 |
| 0 | 1 | 0.5 | −30 | −30 | 0 | 0 | 0 | 30 | 0.5 | 0.5 | 0.5 | 15 | 15 | | | 1 | 1 | 0.5 |
| 0.5 | 1 | 0.5 | −30 | −30 | 0 | 0 | 0 | 30 | 0.5 | 0.5 | 0.5 | 15 | 15 | | | 1 | 1 | 0.5 |
| 1 | 1 | 0.5 | −30 | −30 | 0 | 0 | 0 | 30 | 0.5 | 0.5 | 0.5 | 15 | 15 | | | 1 | 1 | 0.5 |
| 0 | 0 | 1 | 30 | 30 | 1 | 1 | 1 | | 1 | 1 | 1 | −15 | −15 | −15 | −15 | 0 | 0 | 1 |
| 0.5 | 0 | 1 | 30 | 30 | 1 | 1 | 1 | | 1 | 1 | 1 | −15 | −15 | −15 | −15 | 0 | 0 | 1 |
| 1 | 0 | 1 | 30 | 30 | 1 | 1 | 1 | | 1 | 1 | 1 | −15 | −15 | −15 | −15 | 0 | 0 | 1 |
| 0 | 0.5 | 1 | 30 | 30 | 1 | 1 | 1 | | 1 | 1 | 1 | −15 | −15 | | | 0.5 | 0.5 | 1 |
| 0.5 | 0.5 | 1 | 30 | 30 | 1 | 1 | 1 | | 1 | 1 | 1 | −15 | −15 | | | 0.5 | 0.5 | 1 |
| 1 | 0.5 | 1 | 30 | 30 | 1 | 1 | 1 | | 1 | 1 | 1 | −15 | −15 | | | 0.5 | 0.5 | 1 |
| 0 | 1 | 1 | 30 | 30 | 1 | 1 | 1 | | 1 | 1 | 1 | | | | | 1 | 1 | 1 |
| 0.5 | 1 | 1 | 30 | 30 | 1 | 1 | 1 | | 1 | 1 | 1 | | | | | 1 | 1 | 1 |
| 1 | 1 | 1 | 30 | 30 | 1 | 1 | 1 | | 1 | 1 | 1 | | | | | 1 | 1 | 1 |

| Targeted Renewing Display | | | Third Sub-frame Group Period Applied Voltage | | | | | | Renewal Display N | | | Required Number of Sub-frames |
|---|---|---|---|---|---|---|---|---|---|---|---|---|
| C | M | Y | | | | | | | C | M | Y | |
| 0 | 0 | 0 | | | | | | | 0 | 0 | 0 | 2 |
| 0.5 | 0 | 0 | 10 | 10 | 10 | | | | 0.5 | 0 | 0 | 5 |
| 1 | 0 | 0 | 10 | 10 | 10 | 10 | 10 | 10 | 1 | 0 | 0 | 8 |
| 0 | 0.5 | 0 | −10 | −10 | −10 | | | | 0 | 0.5 | 0 | 7 |
| 0.5 | 0.5 | 0 | | | | | | | 0.5 | 0.5 | 0 | 4 |
| 1 | 0.5 | 0 | 10 | 10 | 10 | | | | 1 | 0.5 | 0 | 7 |
| 0 | 1 | 0 | −10 | −10 | −10 | −10 | −10 | −10 | 0 | 1 | 0 | 12 |
| 0.5 | 1 | 0 | −10 | −10 | −10 | | | | 0.5 | 1 | 0 | 9 |
| 1 | 1 | 0 | | | | | | | 1 | 1 | 0 | 6 |
| 0 | 0 | 0.5 | | | | | | | 0 | 0 | 0.5 | 5 |
| 0.5 | 0 | 0.5 | 10 | 10 | 10 | | | | 0.5 | 0 | 0.5 | 8 |
| 1 | 0 | 0.5 | 10 | 10 | 10 | 10 | 10 | 10 | 1 | 0 | 0.5 | 11 |
| 0 | 0.5 | 0.5 | −10 | −10 | −10 | | | | 0 | 0.5 | 0.5 | 6 |
| 0.5 | 0.5 | 0.5 | | | | | | | 0.5 | 0.5 | 0.5 | 3 |
| 1 | 0.5 | 0.5 | 10 | 10 | 10 | | | | 1 | 0.5 | 0.5 | 6 |
| 0 | 1 | 0.5 | −10 | −10 | −10 | −10 | −10 | −10 | 0 | 1 | 0.5 | 11 |
| 0.5 | 1 | 0.5 | −10 | −10 | −10 | | | | 0.5 | 1 | 0.5 | 8 |
| 1 | 1 | 0.5 | | | | | | | 1 | 1 | 0.5 | 5 |
| 0 | 0 | 1 | | | | | | | 0 | 0 | 1 | 7 |
| 0.5 | 0 | 1 | 10 | 10 | 10 | | | | 0.5 | 0 | 1 | 9 |
| 1 | 0 | 1 | 10 | 10 | 10 | 10 | 10 | 10 | 1 | 0 | 1 | 12 |
| 0 | 0.5 | 1 | −10 | −10 | −10 | | | | 0 | 0.5 | 1 | 7 |
| 0.5 | 0.5 | 1 | | | | | | | 0.5 | 0.5 | 1 | 4 |
| 1 | 0.5 | 1 | 10 | 10 | 10 | | | | 1 | 0.5 | 1 | 7 |

TABLE 6-continued

| | | | | | | | | | | | | |
|---|---|---|---|---|---|---|---|---|---|---|---|---|
| 0 | 1 | 1 | −10 | −10 | −10 | −10 | −10 | −10 | 0 | 1 | 1 | 8 |
| 0.5 | 1 | 1 | −10 | −10 | −10 | | | | 0.5 | 1 | 1 | 5 |
| 1 | 1 | 1 | | | | | | | 1 | 1 | 1 | 2 |

TABLE 7

| Display State | | | | | | | | | | | | | | | | |
|---|---|---|---|---|---|---|---|---|---|---|---|---|---|---|---|---|
| C | M | Y | m | WF1 | WF2 | WF3 | WF4 | WF5 | WF6 | WF7 | WF8 | WF9 | WF10 | WF11 | WF12 | WF13 |
| 0 | 0 | 0 | [000000] | [111] | [111] | | | | | | | | | | | [000] |
| 0.5 | 0 | 0 | [000001] | [111] | [111] | [001] | [001] | [001] | | | | | | | | [000] |
| 1 | 0 | 0 | [000010] | [111] | [111] | [001] | [001] | [001] | [001] | [001] | [001] | | | | | [000] |
| 0 | 0.5 | 0 | [000100] | [111] | [111] | [010] | [010] | [101] | [101] | [101] | | | | | | [000] |
| 0.5 | 0.5 | 0 | [000101] | [111] | [111] | [010] | [010] | | | | | | | | | [000] |
| 1 | 0.5 | 0 | [000110] | [111] | [111] | [010] | [010] | [001] | [001] | [001] | | | | | | [000] |
| 0 | 1 | 0 | [001000] | [111] | [111] | [010] | [010] | [010] | [010] | [101] | [101] | [101] | [101] | [101] | [101] | [000] |
| 0.5 | 1 | 0 | [001001] | [111] | [111] | [010] | [010] | [010] | [010] | [101] | [101] | [101] | | | | [000] |
| 1 | 1 | 0 | [001010] | [111] | [111] | [010] | [010] | [010] | [010] | | | | | | | [000] |
| 0 | 0 | 0.5 | [010000] | [111] | [111] | [011] | [110] | [110] | | | | | | | | [000] |
| 0.5 | 0 | 0.5 | [010001] | [111] | [111] | [011] | [110] | [110] | [001] | [001] | [001] | | | | | [000] |
| 1 | 0 | 0.5 | [010010] | [111] | [111] | [011] | [110] | [110] | [001] | [001] | [001] | [001] | [001] | [001] | | [000] |
| 0 | 0.5 | 0.5 | [010100] | [111] | [111] | [011] | [101] | [101] | [101] | | | | | | | [000] |
| 0.5 | 0.5 | 0.5 | [010101] | [111] | [111] | [011] | | | | | | | | | | [000] |
| 1 | 0.5 | 0.5 | [010110] | [111] | [111] | [011] | [001] | [001] | [001] | | | | | | | [000] |
| 0 | 1 | 0.5 | [011000] | [111] | [111] | [011] | [010] | [010] | [101] | [101] | [101] | [101] | [101] | [101] | | [000] |
| 0.5 | 1 | 0.5 | [011001] | [111] | [111] | [011] | [010] | [010] | [101] | [101] | [101] | | | | | [000] |
| 1 | 1 | 0.5 | [011010] | [111] | [111] | [011] | [010] | [010] | | | | | | | | [000] |
| 0 | 0 | 1 | [100000] | [001] | [001] | [110] | [110] | [110] | [110] | | | | | | | [000] |
| 0.5 | 0 | 1 | [100001] | [001] | [001] | [110] | [110] | [110] | [110] | [001] | [001] | [001] | | | | [000] |
| 1 | 0 | 1 | [100010] | [001] | [001] | [110] | [110] | [110] | [110] | [001] | [001] | [001] | [001] | [001] | [001] | [000] |
| 0 | 0.5 | 1 | [100100] | [001] | [001] | [110] | [110] | [101] | [101] | [101] | | | | | | [000] |
| 0.5 | 0.5 | 1 | [100101] | [001] | [001] | [110] | [110] | | | | | | | | | [000] |
| 1 | 0.5 | 1 | [100110] | [001] | [001] | [110] | [110] | [001] | [001] | [001] | | | | | | [000] |
| 0 | 1 | 1 | [101000] | [001] | [001] | [101] | [101] | [101] | [101] | [101] | [101] | | | | | [000] |
| 0.5 | 1 | 1 | [101001] | [001] | [001] | [101] | [101] | [101] | | | | | | | | [000] |
| 1 | 1 | 1 | [101010] | [001] | [001] | | | | | | | | | | | [000] |

In Table 7, in a black space, the description of [000] is omitted. In Table 7, the sub-frames during which effective voltages other than 0V are applied are expressed in a manner to be left justified, however, so long as the order of being big or small of applied voltage (absolute value) is maintained, actually, the sub-frames may be arranged in a given position between WF1 to WF12.

The thinking way shown in Table 6 can be generalized as follows: In every targeted display state, the ground state is determined to be a ground state to which a relative color density Y in the renewal display state is near. That is, if a relative color density (Y) is 0, a color to be displayed in the ground state is determined to be white and, if the relative color density of Y is 1, the color to be displayed in the ground state is determined to be black. If the relative color density (Y) is 0.5 (intermediate color), the color to be displayed in the ground state may be either white or black. However, the above determination is true when 3 gray levels are provided, and if the gray level is 4 or more, when the density value of Y is at faint gray level, a white color is to be displayed in the ground state and, if the gray level is 4 or more, when the density value of Y is at faint gray color, a white color is displayed and, when the gray level is at faint level, a black is to be displayed in the ground state.

Even in the case of the third embodiment, as in the case of the first embodiment described above, if the ground state or intermediate transition state I-1 or intermediate transition state I-2 coincides with the renewal display state N, the sub-frames and beyond may be omitted. Also, in the above description, as in the case of the first embodiment, the mobility of charged particles C, M, Y are the same, however, if the mobility of the charged particles C, M, Y are different from one another, in the first intermediate transition state I-1, a relative color density (Y) of the charged particle becomes Ry, but the relative color density of the charged C and M are different from Ry. Moreover, in the second intermediate transition state I-2, the relative color density (Y) of the charged particle is Ry, however, the relative color density (Y) of charged particle M is Rm and the relative color density of charged particles C is different from Rm. However, even in the case where the mobility of charged particles is different from one another, the driving method of the second embodiment can be realized. Therefore, if a conclusion is to be generalized from the above case, a color density (C, M, Y) of the first intermediate transition state I-1 is represented as (C, M, Y)=(X, X, Ry) (X=arbitrary, X≠Ry), and a color density (C, M, Y) of the second intermediate transition state I-2 is represented as (C, M, Y)=(X, Rm, Ry) (X=arbitrary, X≠Rm). In the above descriptions, the number of gray levels for the CMY is 3, however, the number of gray levels is not limited to this and, even if the gray level is multiple, the same driving method may be employed. Additionally, in the third embodiment, circuit configurations and operations of the circuits are the same as for the first embodiment and, therefore, the descriptions of their operations are omitted.

By configuring as above, the reduction of the number of frames is made possible and, as a result, screen renewing time can be shortened and stand-by time of screen renewing is made small and, therefore, display renewal without stress is made possible.

Fourth Embodiment

Next, displaying with 4 gray-levels according to the fourth embodiment is described below. The image display device of the fourth embodiment is the same as that of the first embodiment in that the image display device of the fourth embodiment is an electronic paper display device in which, at time of screen renewal, a specified voltage is applied, for a predetermined period, to the charged particles between the pixel electrodes and facing electrodes to renew a current display state of a display section from a current screen to a next screen having a predetermined color density. Moreover, charged particles of the fourth embodiment are the same as that in the first embodiment in that the charged particles of the fourth embodiment are made up of three kinds of charged particles C, M, Y having colors and threshold voltage each being different from one another and each of the charged particles C, M, Y has a characteristic relationship of $|Vth(c)|<|Vth(m)|<|Vth(y)|$, where $|Vth(c)|$ is a threshold value voltage of a charged particle C, $|Vth(m)|$ is a threshold value voltage of a charged particle M, and $|Vth(y)|$ is a threshold value voltage of a charged particle Y. Moreover, the fourth embodiment is the same as in the first embodiment in that the following formula of a characteristic relationship between the threshold voltage of each of the charged particles C, M, Y and the voltages applied during each of voltage applying periods is satisfied: $|Vth(c)|<|V3|<|Vth(m)|<|V2|<|Vth(y)<|V1|$.

However, the fourth embodiment is different from the first embodiment in that, when a relative color density of the charged particle C of each of pixels making up a next screen in which a display state is renewed is Rc, a relative color density of the charged particle M is Rm, and the relative color density of the charged particle Y are Ry, the predetermined period during which a voltage is applied is made up of, at least, [1] a resetting period during which a voltage is applied and white or black is reset in the ground state, [2] a first sub-frame group period (voltage application period) during which a first voltage V1 (or −V1) and/or 0V are applied to cause a transition from the ground state to a first intermediate transition state I-1 in which the relative color density of charged particles C, M, Y become Ry, and [3] a third sub-frame group period (voltage applying period) during which a transition is allowed to occur by the application of a second voltage −2V (or V2) from the first intermediate transition state I-1, with a relative color density of charged particle Y being held to be Ry, to a second intermediate transition state I-2*a* in which the relative color density of the charged particles C and M becomes 0 or 1 for the ground state, a second voltage V2 (or −V2) and/or 0V are applied from the intermediate transition state I-2*a*, with the relative color density of the charged particle Y being held to be Ry, to a third intermediate transition state I-2*b* where the relative color density of charged particle C and M becomes Rm, and [4] a third sub-frame group period (voltage applying period) during which, after a third voltage −V3 (or V3) is applied to cause a transition from the third intermediate transition state I-2*b*, with the relative color density of charged particles M and Y being held to be Rm and Ry, to an intermediate transition state I-3*a* in which the relative color density of the charged particle C becomes 0 or 1 for the ground state, a third voltage V3 (or −V3) and/or 0V are applied to cause a transition from a fourth intermediate transition state I-3*a*, with the relative color density of charged particles M and Y being held to be Rm and Ry, to a third sub-frame group period which causes a transition to a renewal display state (final transition state) in which the relative color density of charged particle C becomes Rc.

First of all, when the number of gray levels is 3 or more, during the process of the intermediate transition, a transition may occur from a state in which an intermediate color is displayed to a state in which a predetermined intermediate color is displayed and, at this point of time, however, it is difficult to adjust driving waveforms described in the first to third embodiments to coincide with these color densities and, due to variations in charged amount of particles, there is a fear of variations in characteristics in every display section (electronic paper) and, for example, when the renewal display state N, that is, (C, M, Y)=(0.33, 0.66, 1) with 4 gray levels is to be realized, a transition occurs from a ground state (C, M, Y)=(0, 0, 0) to an intermediate transition state I-1, that is, (C, M, Y)=(1, 1, 1) during the first sub-frame group period and, further, to the intermediate transition state I-2, that is, (C, M, Y)=(0.66, 0.66, 1) during the second sub-frame group period, from the intermediate transition state I-2 to the renewal display state N, that is, (C, M, Y)=(0.33, 0.66, 1) during the third sub-frame group period, however, during the third sub-frame group period, in the charged particle C, a transition occurs from intermediate color density 0.66 to intermediate color density 0.33 and these variations in density within a surface occur, which cause degradation of display quality.

To avoid this problem, according to the above driving method of the embodiment, by providing the second intermediate transition state I-2*a* to return the state of charged particles C and M back to the ground state, and a fourth intermediate transition state I-3*a* to return the state of charged particles C back to the ground state and a transition is allowed to sequentially occur from the first intermediate transition state I-1, that is, (C, M, Y)=(1, 1, 1) to the second intermediate transition state I-2*a*, that is, (C, M, Y)=(0, 0, 1) to the third intermediate transition state I-2*b*, that is, (C, M, Y)=(0.66, 0.66, 1), to the fourth intermediate transition state I-3*a*, that is, (C, M, Y)=(0, 0.66, 1) and, to the renewal display state N, that is, (C, M, Y)=(0.33, 0.66, 1).

Thus, according to the driving method of the fourth embodiment, to display from a previous screen to a renewed screen (next screen N), by introducing intermediate transition states (WK, I-1, I-2*a*, I-2*b*, I-3*a*), systematic simple driving method for displaying including an intermediate color and shades of gray is realized.

Hereinafter, driving waveforms with 4 gray levels are specifically described. The applied voltage is set under the same condition as described in the first embodiment, however, during each of sub-frame group periods, there is a characteristic relationship between unit sub-frame time and each of applied voltages that a unit sub-frame time is reversely proportional to each voltage and unit sub-frame time during each sub-frame group period is 100 ms during the first sub-frame group period is 100 ms, that in the second sub-frame group period is 200 ms and 300 ms in the third frame group period.

TABLE 8

| Targeted | | | Resetting Period | | | | | | First Sub-frame Group Period | | | | | | Second Sub-frame Group Period A | | |
|---|---|---|---|---|---|---|---|---|---|---|---|---|---|---|---|---|---|
| Renewing Display | | | Applied Voltage | | | Ground State | | | Applied Voltage | | | Intermediate Transition State I-1 | | | Applied Voltage | | |
| C | M | Y | Ra | Rb | Rc | C | M | Y | 1a | 1b | 1c | C | M | Y | 2a | 2b | 2c |
| 0 | 0 | 0 | −30 | −30 | −30 | 0 | 0 | 0 | 0 | 0 | 0 | 0 | 0 | 0 | 0 | 0 | 0 |
| 0.33 | 0 | 0 | −30 | −30 | −30 | 0 | 0 | 0 | 0 | 0 | 0 | 0 | 0 | 0 | 0 | 0 | 0 |
| 0.66 | 0 | 0 | −30 | −30 | −30 | 0 | 0 | 0 | 0 | 0 | 0 | 0 | 0 | 0 | 0 | 0 | 0 |
| 1 | 0 | 0 | −30 | −30 | −30 | 0 | 0 | 0 | 0 | 0 | 0 | 0 | 0 | 0 | 0 | 0 | 0 |
| 0 | 0.33 | 0 | −30 | −30 | −30 | 0 | 0 | 0 | 0 | 0 | 0 | 0 | 0 | 0 | 0 | 0 | 0 |
| 0.33 | 0.33 | 0 | −30 | −30 | −30 | 0 | 0 | 0 | 0 | 0 | 0 | 0 | 0 | 0 | 0 | 0 | 0 |
| 0.66 | 0.33 | 0 | −30 | −30 | −30 | 0 | 0 | 0 | 0 | 0 | 0 | 0 | 0 | 0 | 0 | 0 | 0 |
| 1 | 0.33 | 0 | −30 | −30 | −30 | 0 | 0 | 0 | 0 | 0 | 0 | 0 | 0 | 0 | 0 | 0 | 0 |
| 0 | 0.66 | 0 | −30 | −30 | −30 | 0 | 0 | 0 | 0 | 0 | 0 | 0 | 0 | 0 | 0 | 0 | 0 |
| 0.33 | 0.66 | 0 | −30 | −30 | −30 | 0 | 0 | 0 | 0 | 0 | 0 | 0 | 0 | 0 | 0 | 0 | 0 |
| 0.66 | 0.66 | 0 | −30 | −30 | −30 | 0 | 0 | 0 | 0 | 0 | 0 | 0 | 0 | 0 | 0 | 0 | 0 |
| 1 | 0.66 | 0 | −30 | −30 | −30 | 0 | 0 | 0 | 0 | 0 | 0 | 0 | 0 | 0 | 0 | 0 | 0 |
| 0 | 1 | 0 | −30 | −30 | −30 | 0 | 0 | 0 | 0 | 0 | 0 | 0 | 0 | 0 | 0 | 0 | 0 |
| 0.33 | 1 | 0 | −30 | −30 | −30 | 0 | 0 | 0 | 0 | 0 | 0 | 0 | 0 | 0 | 0 | 0 | 0 |
| 0.66 | 1 | 0 | −30 | −30 | −30 | 0 | 0 | 0 | 0 | 0 | 0 | 0 | 0 | 0 | 0 | 0 | 0 |
| 1 | 1 | 0 | −30 | −30 | −30 | 0 | 0 | 0 | 0 | 0 | 0 | 0 | 0 | 0 | 0 | 0 | 0 |
| 0 | 0 | 0.33 | −30 | −30 | −30 | 0 | 0 | 0 | 30 | 0 | 0 | 0.33 | 0.33 | 0.33 | −15 | 0 | 0 |
| 0.33 | 0 | 0.33 | −30 | −30 | −30 | 0 | 0 | 0 | 30 | 0 | 0 | 0.33 | 0.33 | 0.33 | −15 | 0 | 0 |
| 0.66 | 0 | 0.33 | −30 | −30 | −30 | 0 | 0 | 0 | 30 | 0 | 0 | 0.33 | 0.33 | 0.33 | −15 | 0 | 0 |
| 1 | 0 | 0.33 | −30 | −30 | −30 | 0 | 0 | 0 | 30 | 0 | 0 | 0.33 | 0.33 | 0.33 | −15 | 0 | 0 |
| 0 | 0.33 | 0.33 | −30 | −30 | −30 | 0 | 0 | 0 | 30 | 0 | 0 | 0.33 | 0.33 | 0.33 | −15 | 0 | 0 |
| 0.33 | 0.33 | 0.33 | −30 | −30 | −30 | 0 | 0 | 0 | 30 | 0 | 0 | 0.33 | 0.33 | 0.33 | −15 | 0 | 0 |
| 0.66 | 0.33 | 0.33 | −30 | −30 | −30 | 0 | 0 | 0 | 30 | 0 | 0 | 0.33 | 0.33 | 0.33 | −15 | 0 | 0 |
| 1 | 0.33 | 0.33 | −30 | −30 | −30 | 0 | 0 | 0 | 30 | 0 | 0 | 0.33 | 0.33 | 0.33 | −15 | 0 | 0 |
| 0 | 0.66 | 0.33 | −30 | −30 | −30 | 0 | 0 | 0 | 30 | 0 | 0 | 0.33 | 0.33 | 0.33 | −15 | 0 | 0 |
| 0.33 | 0.66 | 0.33 | −30 | −30 | −30 | 0 | 0 | 0 | 30 | 0 | 0 | 033 | 0.33 | 0.33 | −15 | 0 | 0 |
| 0.66 | 0.66 | 0.33 | −30 | −30 | −30 | 0 | 0 | 0 | 30 | 0 | 0 | 0.33 | 0.33 | 0.33 | −15 | 0 | 0 |
| 1 | 0.66 | 0.33 | −30 | −30 | −30 | 0 | 0 | 0 | 30 | 0 | 0 | 0.33 | 0.33 | 0.33 | −15 | 0 | 0 |
| 0 | 1 | 0.33 | −30 | −30 | −30 | 0 | 0 | 0 | 30 | 0 | 0 | 0.33 | 0.33 | 0.33 | −15 | 0 | 0 |
| 0.33 | 1 | 0.33 | −30 | −30 | −30 | 0 | 0 | 0 | 30 | 0 | 0 | 0.33 | 0.33 | 0.33 | −15 | 0 | 0 |
| 0.66 | 1 | 0.33 | −30 | −30 | −30 | 0 | 0 | 0 | 30 | 0 | 0 | 0.33 | 0.33 | 0.33 | −15 | 0 | 0 |
| 1 | 1 | 0.33 | −30 | −30 | −30 | 0 | 0 | 0 | 30 | 0 | 0 | 0.33 | 0.33 | 0.33 | −16 | 0 | 0 |
| 0 | 0 | 0.66 | −30 | −30 | −30 | 0 | 0 | 0 | 30 | 30 | 0 | 0.66 | 0.66 | 0.66 | −15 | −15 | 0 |
| 0.33 | 0 | 0.66 | −30 | −30 | −30 | 0 | 0 | 0 | 30 | 30 | 0 | 0.66 | 0.66 | 0.66 | −15 | −15 | 0 |
| 0.66 | 0 | 0.66 | −30 | −30 | −30 | 0 | 0 | 0 | 30 | 30 | 0 | 0.66 | 0.66 | 0.66 | −15 | −15 | 0 |
| 1 | 0 | 0.66 | −30 | −30 | −30 | 0 | 0 | 0 | 30 | 30 | 0 | 0.66 | 0.66 | 0.66 | −15 | −15 | 0 |
| 0 | 0.33 | 0.66 | −30 | −30 | −30 | 0 | 0 | 0 | 30 | 30 | 0 | 0.66 | 0.66 | 0.66 | −15 | −15 | 0 |
| 0.33 | 0.33 | 0.66 | −30 | −30 | −30 | 0 | 0 | 0 | 30 | 30 | 0 | 0.66 | 0.66 | 0.66 | −15 | −15 | 0 |
| 0.66 | 0.33 | 0.66 | −30 | −30 | −30 | 0 | 0 | 0 | 30 | 30 | 0 | 0.66 | 0.66 | 0.66 | −15 | −15 | 0 |
| 1 | 0.33 | 0.66 | −30 | −30 | −30 | 0 | 0 | 0 | 30 | 30 | 0 | 0.6S | 0.66 | 0.66 | −15 | −15 | 0 |
| 0 | 0.66 | 0.66 | −30 | −30 | −30 | 0 | 0 | 0 | 30 | 30 | 0 | 0.66 | 0.66 | 0.66 | −15 | −15 | 0 |
| 0.33 | 0.66 | 0.66 | −30 | −30 | −30 | 0 | 0 | 0 | 30 | 30 | 0 | 0.66 | 0.66 | 0.66 | −15 | −15 | 0 |
| 0.66 | 0.66 | 0.66 | −30 | −30 | −30 | 0 | 0 | 0 | 30 | 30 | 0 | 0.66 | 0.66 | 0.66 | −15 | −15 | 0 |
| 1 | 0.66 | 0.66 | −30 | −30 | −30 | 0 | 0 | 0 | 30 | 30 | 0 | 0.66 | 0.66 | 0.66 | −15 | −15 | 0 |
| 0 | 1 | 0.66 | −30 | −30 | −30 | 0 | 0 | 0 | 30 | 30 | 0 | 0.66 | 0.66 | 0.66 | −15 | −15 | 0 |
| 0.33 | 1 | 0.66 | −30 | −30 | −30 | 0 | 0 | 0 | 30 | 30 | 0 | 0.66 | 0.66 | 0.66 | −15 | −15 | 0 |
| 0.66 | 1 | 0.66 | −30 | −30 | −30 | 0 | 0 | 0 | 30 | 30 | 0 | 0.66 | 0.66 | 0.66 | −15 | −15 | 0 |
| 1 | 1 | 0.66 | −30 | −30 | −30 | 0 | 0 | 0 | 30 | 30 | 0 | 0.66 | 0.66 | 0.66 | −15 | −15 | 0 |
| 0 | 0 | 1 | −30 | −30 | −30 | 0 | 0 | 0 | 30 | 30 | 30 | 1 | 1 | 1 | −15 | −15 | −15 |
| 0.33 | 0 | 1 | −30 | −30 | −30 | 0 | 0 | 0 | 30 | 30 | 30 | 1 | 1 | 1 | −15 | −15 | −15 |
| 0.66 | 0 | 1 | −30 | −30 | −30 | 0 | 0 | 0 | 30 | 30 | 30 | 1 | 1 | 1 | −15 | −15 | −15 |
| 1 | 0 | 1 | −30 | −30 | −30 | 0 | 0 | 0 | 30 | 30 | 30 | 1 | 1 | 1 | −15 | −15 | −15 |
| 0 | 0.33 | 1 | −30 | −30 | −30 | 0 | 0 | 0 | 30 | 30 | 30 | 1 | 1 | 1 | −15 | −15 | −15 |
| 0.33 | 0.33 | 1 | −30 | −30 | −30 | 0 | 0 | 0 | 30 | 30 | 30 | 1 | 1 | 1 | −15 | −15 | −15 |
| 0.66 | 0.33 | 1 | −30 | −30 | −30 | 0 | 0 | 0 | 30 | 30 | 30 | 1 | 1 | 1 | −15 | −15 | −15 |
| 1 | 0.33 | 1 | −30 | −30 | −30 | 0 | 0 | 0 | 30 | 30 | 30 | 1 | 1 | 1 | −15 | −15 | −15 |
| 0 | 0.66 | 1 | −30 | −30 | −30 | 0 | 0 | 0 | 30 | 30 | 30 | 1 | 1 | 1 | −15 | −15 | −15 |
| 0.33 | 0.66 | 1 | −30 | −30 | −30 | 0 | 0 | 0 | 30 | 30 | 30 | 1 | 1 | 1 | −15 | −15 | −15 |
| 0.66 | 0.66 | 1 | −30 | −30 | −30 | 0 | 0 | 0 | 30 | 30 | 30 | 1 | 1 | 1 | −15 | −15 | −15 |
| 1 | 0.66 | 1 | −30 | −30 | −30 | 0 | 0 | 0 | 30 | 30 | 30 | 1 | 1 | 1 | −15 | −15 | −15 |
| 0 | 1 | 1 | −30 | −30 | −30 | 0 | 0 | 0 | 30 | 30 | 30 | 1 | 1 | 1 | −15 | −15 | −15 |
| 0.33 | 1 | 1 | −30 | −30 | −30 | 0 | 0 | 0 | 30 | 30 | 30 | 1 | 1 | 1 | −15 | −15 | −15 |
| 0.66 | 1 | 1 | −30 | −30 | −30 | 0 | 0 | 0 | 30 | 30 | 30 | 1 | 1 | 1 | −15 | −15 | −15 |
| 1 | 1 | 1 | −30 | −30 | −30 | 0 | 0 | 0 | 30 | 30 | 30 | 1 | 1 | 1 | −15 | −15 | −15 |

TABLE 8-continued

| Targeted | | | Second Sub-frame Group Period A | | | Second Sub-frame Group Period B | | | | | |
|---|---|---|---|---|---|---|---|---|---|---|---|
| Renewing Display | | | Intermediate Transition State I-2a | | | Applied Voltage | | | Intermediate Transition State I-2b | | |
| C | M | Y | C | M | Y | 2a | 2b | 2c | C | M | Y |
| 0 | 0 | 0 | 0 | 0 | 0 | 0 | 0 | 0 | 0 | 0 | 0 |
| 0.33 | 0 | 0 | 0 | 0 | 0 | 0 | 0 | 0 | 0 | 0 | 0 |
| 0.66 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 |
| 0 | 0.33 | 0 | 0 | 0 | 0 | 15 | 0 | 0 | 0.33 | 0.33 | 0 |
| 0.33 | 0.33 | 0 | 0 | 0 | 0 | 15 | 0 | 0 | 0.33 | 0.33 | 0 |
| 0.66 | 0.33 | 0 | 0 | 0 | 0 | 15 | 0 | 0 | 0.33 | 0.33 | 0 |
| 1 | 0.33 | 0 | 0 | 0 | 0 | 15 | 0 | 0 | 0.33 | 0.33 | 0 |
| 0 | 0.66 | 0 | 0 | 0 | 0 | 15 | 15 | 0 | 0.66 | 0.66 | 0 |
| 0.33 | 0.66 | 0 | 0 | 0 | 0 | 15 | 15 | 0 | 0.66 | 0.66 | 0 |
| 0.66 | 0.66 | 0 | 0 | 0 | 0 | 15 | 15 | 0 | 0.66 | 0.66 | 0 |
| 1 | 0.66 | 0 | 0 | 0 | 0 | 15 | 15 | 0 | 0.66 | 0.66 | 0 |
| 0 | 1 | 0 | 0 | 0 | 0 | 15 | 15 | 15 | 1 | 1 | 0 |
| 0.33 | 1 | 0 | 0 | 0 | 0 | 15 | 15 | 15 | 1 | 1 | 0 |
| 0.66 | 1 | 0 | 0 | 0 | 0 | 15 | 15 | 15 | 1 | 1 | 0 |
| 1 | 1 | 0 | 0 | 0 | 0 | 15 | 15 | 15 | 1 | 1 | 0 |
| 0 | 0 | 0.33 | 0 | 0 | 0.33 | 0 | 0 | 0 | 0 | 0 | 0.33 |
| 0.33 | 0 | 0.33 | 0 | 0 | 0.33 | 0 | 0 | 0 | 0 | 0 | 0.33 |
| 0.66 | 0 | 0.33 | 0 | 0 | 0.33 | 0 | 0 | 0 | 0 | 0 | 0.33 |
| 1 | 0 | 0.33 | 0 | 0 | 0.33 | 0 | 0 | 0 | 0 | 0 | 0.33 |
| 0 | 0.33 | 0.33 | 0 | 0 | 0.33 | 15 | 0 | 0 | 0.33 | 0.33 | 0.33 |
| 0.33 | 0.33 | 0.33 | 0 | 0 | 0.33 | 15 | 0 | 0 | 0.33 | 0.33 | 0.33 |
| 0.66 | 0.33 | 0.33 | 0 | 0 | 0.33 | 15 | 0 | 0 | 0.33 | 0.33 | 0.33 |
| 1 | 0.33 | 0.33 | 0 | 0 | 0.33 | 15 | 0 | 0 | 0.33 | 0.33 | 0.33 |
| 0 | 0.66 | 0.33 | 0 | 0 | 0.33 | 15 | 15 | 0 | 0.66 | 0.66 | 0.33 |
| 0.33 | 0.66 | 0.33 | 0 | 0 | 0.33 | 15 | 15 | 0 | 0.66 | 0.66 | 0.33 |
| 0.66 | 0.66 | 0.33 | 0 | 0 | 0.33 | 15 | 15 | 0 | 0.66 | 0.66 | 0.33 |
| 1 | 0.66 | 0.33 | 0 | 0 | 0.33 | 15 | 15 | 0 | 0.66 | 0.66 | 0.33 |
| 0 | 1 | 0.33 | 0 | 0 | 0.33 | 15 | 15 | 15 | 1 | 1 | 0.33 |
| 0.33 | 1 | 0.33 | 0 | 0 | 0.33 | 15 | 15 | 15 | 1 | 1 | 0.33 |
| 0.66 | 1 | 0.33 | 0 | 0 | 0.33 | 15 | 15 | 15 | 1 | 1 | 0.33 |
| 1 | 1 | 0.33 | 0 | 0 | 0.33 | 15 | 15 | 15 | 1 | 1 | 0.33 |
| 0 | 0 | 0.66 | 0 | 0 | 0.66 | 0 | 0 | 0 | 0 | 0 | 0.66 |
| 0.33 | 0 | 0.66 | 0 | 0 | 0.66 | 0 | 0 | 0 | 0 | 0 | 0.66 |
| 0.66 | 0 | 0.66 | 0 | 0 | 0.66 | 0 | 0 | 0 | 0 | 0 | 0.66 |
| 1 | 0 | 0.66 | 0 | 0 | 0.66 | 0 | 0 | 0 | 0 | 0 | 0.66 |
| 0 | 0.33 | 0.66 | 0 | 0 | 0.66 | 15 | 0 | 0 | 0.33 | 0.33 | 0.66 |
| 0.33 | 0.33 | 0.66 | 0 | 0 | 0.66 | 15 | 0 | 0 | 0.33 | 0.33 | 0.66 |
| 0.66 | 0.33 | 0.66 | 0 | 0 | 0.66 | 15 | 0 | 0 | 0.33 | 0.33 | 0.66 |
| 1 | 0.33 | 0.66 | 0 | 0 | 0.66 | 15 | 0 | 0 | 0.33 | 0.33 | 0.66 |
| 0 | 0.66 | 0.66 | 0 | 0 | 0.66 | 15 | 15 | 0 | 0.66 | 0.66 | 0.66 |
| 0.33 | 0.66 | 0.66 | 0 | 0 | 0.66 | 15 | 15 | 0 | 0.66 | 0.66 | 0.66 |
| 0.66 | 0.66 | 0.66 | 0 | 0 | 0.66 | 15 | 15 | 0 | 0.66 | 0.66 | 0.66 |
| 1 | 0.66 | 0.66 | 0 | 0 | 0.66 | 15 | 15 | 0 | 0.66 | 0.66 | 0.66 |
| 0 | 1 | 0.66 | 0 | 0 | 0.66 | 15 | 15 | 15 | 1 | 1 | 0.66 |
| 0.33 | 1 | 0.66 | 0 | 0 | 0.66 | 15 | 15 | 15 | 1 | 1 | 0.66 |
| 0.66 | 1 | 0.66 | 0 | 0 | 0.66 | 15 | 15 | 15 | 1 | 1 | 0.66 |
| 1 | 1 | 0.66 | 0 | 0 | 0.66 | 15 | 15 | 15 | 1 | 1 | 0.66 |
| 0 | 0 | 1 | 0 | 0 | 1 | 0 | 0 | 0 | 0 | 0 | 1 |
| 0.33 | 0 | 1 | 0 | 0 | 1 | 0 | 0 | 0 | 0 | 0 | 1 |
| 0.66 | 0 | 1 | 0 | 0 | 1 | 0 | 0 | 0 | 0 | 0 | 1 |
| 1 | 0 | 1 | 0 | 0 | 1 | 0 | 0 | 0 | 0 | 0 | 1 |
| 0 | 0.33 | 1 | 0 | 0 | 1 | 15 | 0 | 0 | 0.33 | 0.33 | 1 |
| 0.33 | 0.33 | 1 | 0 | 0 | 1 | 15 | 0 | 0 | 0.33 | 0.33 | 1 |
| 0.66 | 0.33 | 1 | 0 | 0 | 1 | 15 | 0 | 0 | 0.33 | 0.33 | 1 |
| 1 | 0.33 | 1 | 0 | 0 | 1 | 15 | 0 | 0 | 0.33 | 0.33 | 1 |
| 0 | 0.66 | 1 | 0 | 0 | 1 | 15 | 15 | 0 | 0.66 | 0.66 | 1 |
| 0.33 | 0.66 | 1 | 0 | 0 | 1 | 15 | 15 | 0 | 0.66 | 0.66 | 1 |
| 0.66 | 0.66 | 1 | 0 | 0 | 1 | 15 | 15 | 0 | 0.66 | 0.66 | 1 |
| 1 | 0.66 | 1 | 0 | 0 | 1 | 15 | 15 | 0 | 0.66 | 0.66 | 1 |
| 0 | 1 | 1 | 0 | 0 | 1 | 15 | 15 | 15 | 1 | 1 | 1 |
| 0.33 | 1 | 1 | 0 | 0 | 1 | 15 | 15 | 15 | 1 | 1 | 1 |
| 0.66 | 1 | 1 | 0 | 0 | 1 | 15 | 15 | 15 | 1 | 1 | 1 |
| 1 | 1 | 1 | 0 | 0 | 1 | 15 | 15 | 15 | 1 | 1 | 1 |

TABLE 9

| Targeted Renewing Display | | | Third Sub-frame Group Period A Applied Voltage | | | Third Sub-frame Group Period A Intermediate Transition State I-3a | | | Third Sub-frame Group Period B Applied Voltage | | | Third Sub-frame Group Period B Renewal Display N | | |
|---|---|---|---|---|---|---|---|---|---|---|---|---|---|---|
| C | M | Y | 3a | 3b | 3c | C | M | Y | 3a | 3b | 3c | C | M | Y |
| 0 | 0 | 0 | 0 | 0 | 0 | 0 | 0 | 0 | 0 | 0 | 0 | 0 | 0 | 0 |
| 0.33 | 0 | 0 | 0 | 0 | 0 | 0 | 0 | 0 | 10 | 0 | 0 | 0.33 | 0 | 0 |
| 0.66 | 0 | 0 | 0 | 0 | 0 | 0 | 0 | 0 | 10 | 10 | 0 | 0.66 | 0 | 0 |
| 1 | 0 | 0 | 0 | 0 | 0 | 0 | 0 | 0 | 10 | 10 | 10 | 1 | 0 | 0 |
| 0 | 0.33 | 0 | −10 | 0 | 0 | 0 | 0.33 | 0 | 0 | 0 | 0 | 0 | 0.33 | 0 |
| 0.33 | 0.33 | 0 | −10 | 0 | 0 | 0 | 0.33 | 0 | 10 | 0 | 0 | 0.33 | 0.33 | 0 |
| 0.66 | 0.33 | 0 | −10 | 0 | 0 | 0 | 0.33 | 0 | 10 | 10 | 0 | 0.66 | 0.33 | 0 |
| 1 | 0.33 | 0 | −10 | 0 | 0 | 0 | 0.33 | 0 | 10 | 10 | 10 | 1 | 0.33 | 0 |
| 0 | 0.66 | 0 | −10 | −10 | 0 | 0 | 0.66 | 0 | 0 | 0 | 0 | 0 | 0.66 | 0 |
| 0.33 | 0.66 | 0 | −10 | −10 | 0 | 0 | 0.66 | 0 | 10 | 0 | 0 | 0.33 | 0.66 | 0 |
| 0.66 | 0.66 | 0 | −10 | −10 | 0 | 0 | 0.66 | 0 | 10 | 10 | 0 | 0.66 | 0.66 | 0 |
| 1 | 0.66 | 0 | −10 | −10 | 0 | 0 | 0.66 | 0 | 10 | 10 | 10 | 1 | 0.66 | 0 |
| 0 | 1 | 0 | −10 | −10 | −10 | 0 | 1 | 0 | 0 | 0 | 0 | 0 | 1 | 0 |
| 0.33 | 1 | 0 | −10 | −10 | −10 | 0 | 1 | 0 | 10 | 0 | 0 | 0.33 | 1 | 0 |
| 0.66 | 1 | 0 | −10 | −10 | −10 | 0 | 1 | 0 | 10 | 10 | 0 | 0.66 | 1 | 0 |
| 1 | 1 | 0 | −10 | −10 | −10 | 0 | 1 | 0 | 10 | 10 | 10 | 1 | 1 | 0 |
| 0 | 0 | 0.33 | 0 | 0 | 0 | 0 | 0 | 0.33 | 0 | 0 | 0 | 0 | 0 | 0.33 |
| 0.33 | 0 | 0.33 | 0 | 0 | 0 | 0 | 0 | 0.33 | 10 | 0 | 0 | 0.33 | 0 | 0.33 |
| 0.66 | 0 | 0.33 | 0 | 0 | 0 | 0 | 0 | 0.33 | 10 | 10 | 0 | 0.66 | 0 | 0.33 |
| 1 | 0 | 0.33 | 0 | 0 | 0 | 0 | 0 | 0.33 | 10 | 10 | 10 | 1 | 0 | 0.33 |
| 0 | 0.33 | 0.33 | −10 | 0 | 0 | 0 | 0.33 | 0.33 | 0 | 0 | 0 | 0 | 0.33 | 0.33 |
| 0.33 | 0.33 | 0.33 | −10 | 0 | 0 | 0 | 0.33 | 0.33 | 10 | 0 | 0 | 0.33 | 0.33 | 0.33 |
| 0.66 | 0.33 | 0.33 | −10 | 0 | 0 | 0 | 0.33 | 0.33 | 10 | 10 | 0 | 0.66 | 0.33 | 0.33 |
| 1 | 0.33 | 0.33 | −10 | 0 | 0 | 0 | 0.33 | 0.33 | 10 | 10 | 10 | 1 | 0.33 | 0.33 |
| 0 | 0.66 | 0.33 | −10 | −10 | 0 | 0 | 0.66 | 0.33 | 0 | 0 | 0 | 0 | 0.66 | 0.33 |
| 0.33 | 0.66 | 0.33 | −10 | −10 | 0 | 0 | 0.66 | 0.33 | 10 | 0 | 0 | 0.33 | 0.66 | 0.33 |
| 0.66 | 0.66 | 0.33 | −10 | −10 | 0 | 0 | 0.66 | 0.33 | 10 | 10 | 0 | 0.66 | 0.66 | 0.33 |
| 1 | 0.66 | 0.33 | −10 | −10 | 0 | 0 | 0.66 | 0.33 | 10 | 10 | 10 | 1 | 0.66 | 0.33 |
| 0 | 1 | 0.33 | −10 | −10 | −10 | 0 | 1 | 0.33 | 0 | 0 | 0 | 0 | 1 | 0.33 |
| 0.33 | 1 | 0.33 | −10 | −10 | −10 | 0 | 1 | 0.33 | 10 | 0 | 0 | 0.33 | 1 | 0.33 |
| 0.66 | 1 | 0.33 | −10 | −10 | −10 | 0 | 1 | 0.33 | 10 | 10 | 0 | 0.66 | 1 | 0.33 |
| 1 | 1 | 0.33 | −10 | −10 | −10 | 0 | 1 | 0.33 | 10 | 10 | 10 | 1 | 1 | 0.33 |
| 0 | 0 | 0.66 | 0 | 0 | 0 | 0 | 0 | 0.66 | 0 | 0 | 0 | 0 | 0 | 0.66 |
| 0.33 | 0 | 0.66 | 0 | 0 | 0 | 0 | 0 | 0.66 | 10 | 0 | 0 | 0.33 | 0 | 0.66 |
| 0.66 | 0 | 0.66 | 0 | 0 | 0 | 0 | 0 | 0.66 | 10 | 10 | 0 | 0.66 | 0 | 0.66 |
| 1 | 0 | 0.66 | 0 | 0 | 0 | 0 | 0 | 0.66 | 10 | 10 | 10 | 1 | 0 | 0.66 |
| 0 | 0.33 | 0.66 | −10 | 0 | 0 | 0 | 0.33 | 0.66 | 0 | 0 | 0 | 0 | 0.33 | 0.66 |
| 0.33 | 0.33 | 0.66 | −10 | 0 | 0 | 0 | 0.33 | 0.66 | 10 | 0 | 0 | 0.33 | 0.33 | 0.66 |
| 0.66 | 0.33 | 0.66 | −10 | 0 | 0 | 0 | 0.33 | 0.66 | 10 | 10 | 0 | 0.66 | 0.33 | 0.66 |
| 1 | 0.33 | 0.66 | −10 | 0 | 0 | 0 | 0.33 | 0.66 | 10 | 10 | 10 | 1 | 0.33 | 0.66 |
| 0 | 0.66 | 0.66 | −10 | −10 | 0 | 0 | 0.66 | 0.66 | 0 | 0 | 0 | 0 | 0.66 | 0.66 |
| 0.33 | 0.66 | 0.66 | −10 | −10 | 0 | 0 | 0.66 | 0.66 | 10 | 0 | 0 | 0.33 | 0.66 | 0.66 |
| 0.66 | 0.66 | 0.66 | −10 | −10 | 0 | 0 | 0.66 | 0.66 | 10 | 10 | 0 | 0.66 | 0.66 | 0.66 |
| 1 | 0.66 | 0.66 | −10 | −10 | 0 | 0 | 0.66 | 0.66 | 10 | 10 | 10 | 1 | 0.66 | 0.66 |
| 0 | 1 | 0.66 | −10 | −10 | −10 | 0 | 1 | 0.66 | 0 | 0 | 0 | 0 | 1 | 0.66 |
| 0.33 | 1 | 0.66 | −10 | −10 | −10 | 0 | 1 | 0.66 | 10 | 0 | 0 | 0.33 | 1 | 0.66 |
| 0.66 | 1 | 0.66 | −10 | −10 | −10 | 0 | 1 | 0.66 | 10 | 10 | 0 | 0.66 | 1 | 0.66 |
| 1 | 1 | 0.66 | −10 | −10 | −10 | 0 | 1 | 0.66 | 10 | 10 | 10 | 1 | 1 | 0.66 |
| 0 | 0 | 1 | 0 | 0 | 0 | 0 | 0 | 1 | 0 | 0 | 0 | 0 | 0 | 1 |
| 0.33 | 0 | 1 | 0 | 0 | 0 | 0 | 0 | 1 | 10 | 0 | 0 | 0.33 | 0 | 1 |
| 0.66 | 0 | 1 | 0 | 0 | 0 | 0 | 0 | 1 | 10 | 10 | 0 | 0.66 | 0 | 1 |
| 1 | 0 | 1 | 0 | 0 | 0 | 0 | 0 | 1 | 10 | 10 | 10 | 1 | 0 | 1 |
| 0 | 0.33 | 1 | −10 | 0 | 0 | 0 | 0.33 | 1 | 0 | 0 | 0 | 0 | 0.33 | 1 |
| 0.33 | 0.33 | 1 | −10 | 0 | 0 | 0 | 0.33 | 1 | 10 | 0 | 0 | 0.33 | 0.33 | 1 |
| 0.66 | 0.33 | 1 | −10 | 0 | 0 | 0 | 0.33 | 1 | 10 | 10 | 0 | 0.66 | 0.33 | 1 |
| 1 | 0.33 | 1 | −10 | 0 | 0 | 0 | 0.33 | 1 | 10 | 10 | 10 | 1 | 0.33 | 1 |
| 0 | 0.66 | 1 | −10 | −10 | 0 | 0 | 0.66 | 1 | 0 | 0 | 0 | 0 | 0.66 | 1 |
| 0.33 | 0.66 | 1 | −10 | −10 | 0 | 0 | 0.66 | 1 | 10 | 0 | 0 | 0.33 | 0.66 | 1 |
| 0.66 | 0.66 | 1 | −10 | −10 | 0 | 0 | 0.66 | 1 | 10 | 10 | 0 | 0.66 | 0.66 | 1 |
| 1 | 0.66 | 1 | −10 | −10 | 0 | 0 | 0.66 | 1 | 10 | 10 | 10 | 1 | 0.66 | 1 |
| 0 | 1 | 1 | −10 | −10 | −10 | 0 | 1 | 1 | 0 | 0 | 0 | 0 | 1 | 1 |
| 0.33 | 1 | 1 | −10 | −10 | −10 | 0 | 1 | 1 | 10 | 0 | 0 | 0.33 | 1 | 1 |
| 0.66 | 1 | 1 | −10 | −10 | −10 | 0 | 1 | 1 | 10 | 10 | 0 | 0.66 | 1 | 1 |
| 1 | 1 | 1 | −10 | −10 | −10 | 0 | 1 | 1 | 10 | 10 | 10 | 1 | 1 | 1 |

Tables 8 and 9 show concretely driving waveforms of the embodiment. In reference to the driving waveforms shown in Tables 8 an 9, when a display state N, that is, (C, M, Y)=(Rc, Rm, Ry) of a targeted next screen, in a resetting period, a transition occurs to a ground state WK, that is, (C, M, Y)=(0, 0, 0) and, during the first sub-frame group period, a transition also occurs to the first intermediate transition state I-1, that is, (C, M, Y)=(Ry, Ry, Ry) and, further, during the next screen sub-frame group period, another transition occurs to the second intermediate transition state I-2*a*, that is, (C, M, Y)=0, 0, Ry) and, after that, another transition occurs to a third intermediate transition state I-2*b*, that is, (C, M, Y)=(Rm. Rm, Ry)

and, then, still another transition to a fourth intermediate transition state I-3*a*, that is, (C, M, Y)=(0, Rm, Ry) occurs and, after that, still another transition occurs to a final (next screen) display state N, that is, (C, M, Y)=(Rc, Rm, Ry), where Rc, Rm and Ry each take on 4 gray levels of (0, 0.33, 0.66, 1). Moreover, configurations of the look-up table to realize driving waveforms in Tables 8 and 9, circuit configurations and operations of circuits are approximately the same as in the first and second embodiments and their descriptions are omitted accordingly.

Thus, in the fourth embodiment, an unstable operation of such a transition from a state in which a given shade of gray is displayed to a state in which a specified shade of gray is displayed is excluded and configurations of direct transition from a ground state to a final color density state together with charged particles C, M, and Y are employed and, therefore, the color density of the intermediate color can be stabilized and variation characteristics for every display section (electronic paper) and variation density can be suppressed. As a result, according to the fourth embodiment, displaying with multiple gray levels being more excellent in quality can be realized.

In the fourth embodiment, it is described as above that Rc, Rm and Ry each take values of (0, 0.33, 0.66, 1) as 4 gray levels. However, Rc, Rm and Ry are not limited to values as above and can each assume arbitrary values.

Also, in the fourth embodiment, the second sub-frame group period A and the first sub-frame group period B are separately described, however, the second sub-frame group period B and the first sub-frame group period can be set so as to be mixed with each other.

For example, if necessary, it is possible to unite the sub-frame numbers in a way like 1*a*→2*a*→1*b*→2*b*→1*c*→2*c* and, in this case, out of the intermediate transition states I-1 and I-2*a*, the intermediate transition state I-1 does not appear and only the intermediate transition state I-2*a* appears. Also, the third sub-frame group period and second sub-frame group period and the second sub-frame group have the same characteristic relationship as described above and, in this case, the intermediate transition state I-2*b* does not appear and the intermediate transition state I-3*b* appears.

Further, in the fourth embodiment, the unit sub-frame time in each period is made variable, however, the sub-frame time in each period may beset to be constant and the number of sub-frames for each period may be set to be variable. It is described that white is displayed in each ground state of C, M, Y for the WK, I-2*a* and so on, however, black may be displayed. Also, the period for the application of 0V voltage, as in the case of the third embodiment, may be deleted. According to the embodiment, displaying not only with 4 gray levels but also with 3 gray levels can be employed.

Fifth Embodiment

Figure 23:
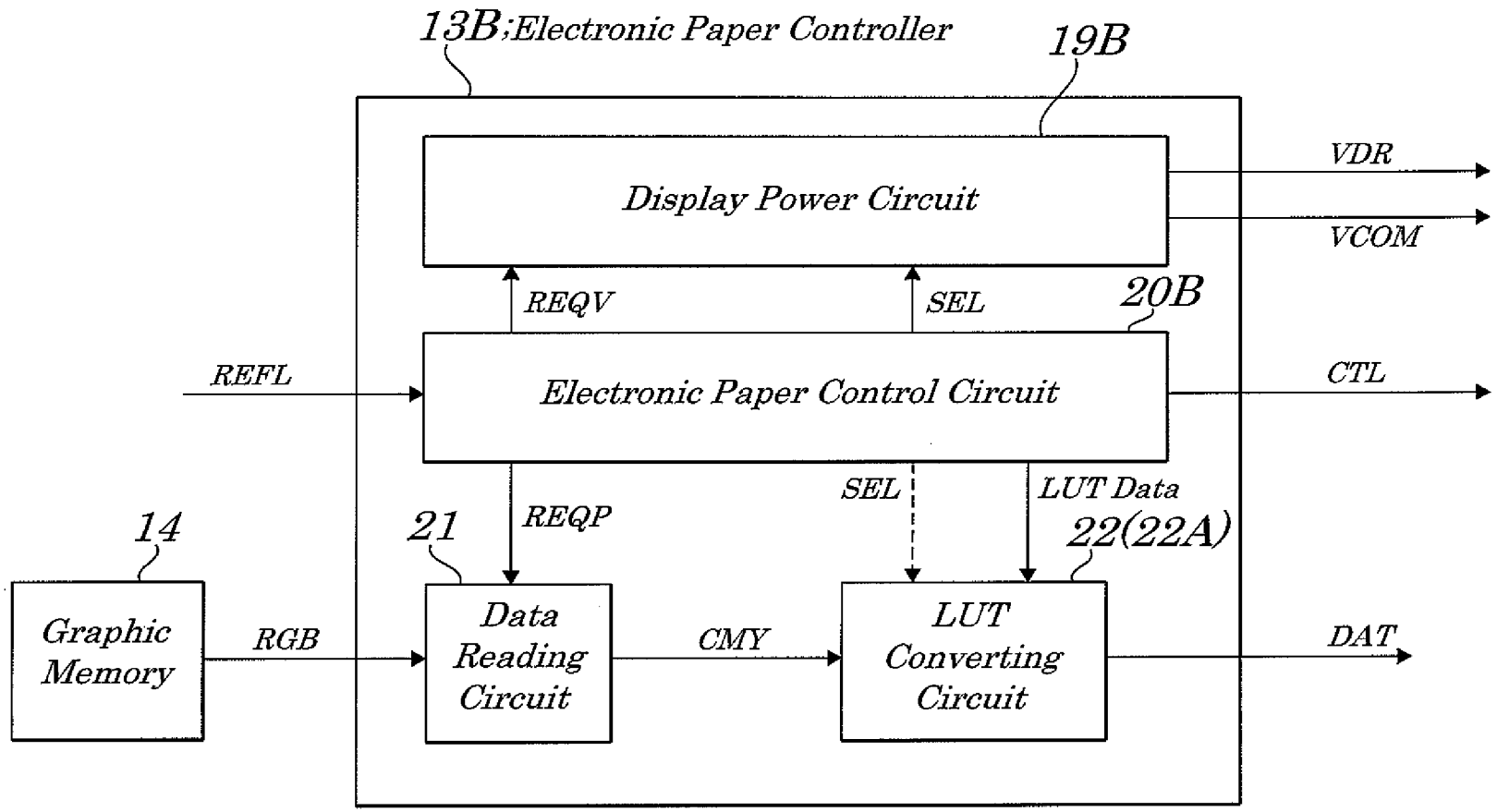
FIG. 23 is a block diagram showing, in detail, an electronic paper controller making up an electronic paper display device according to a fifth embodiment of the present invention.
Figure 24:
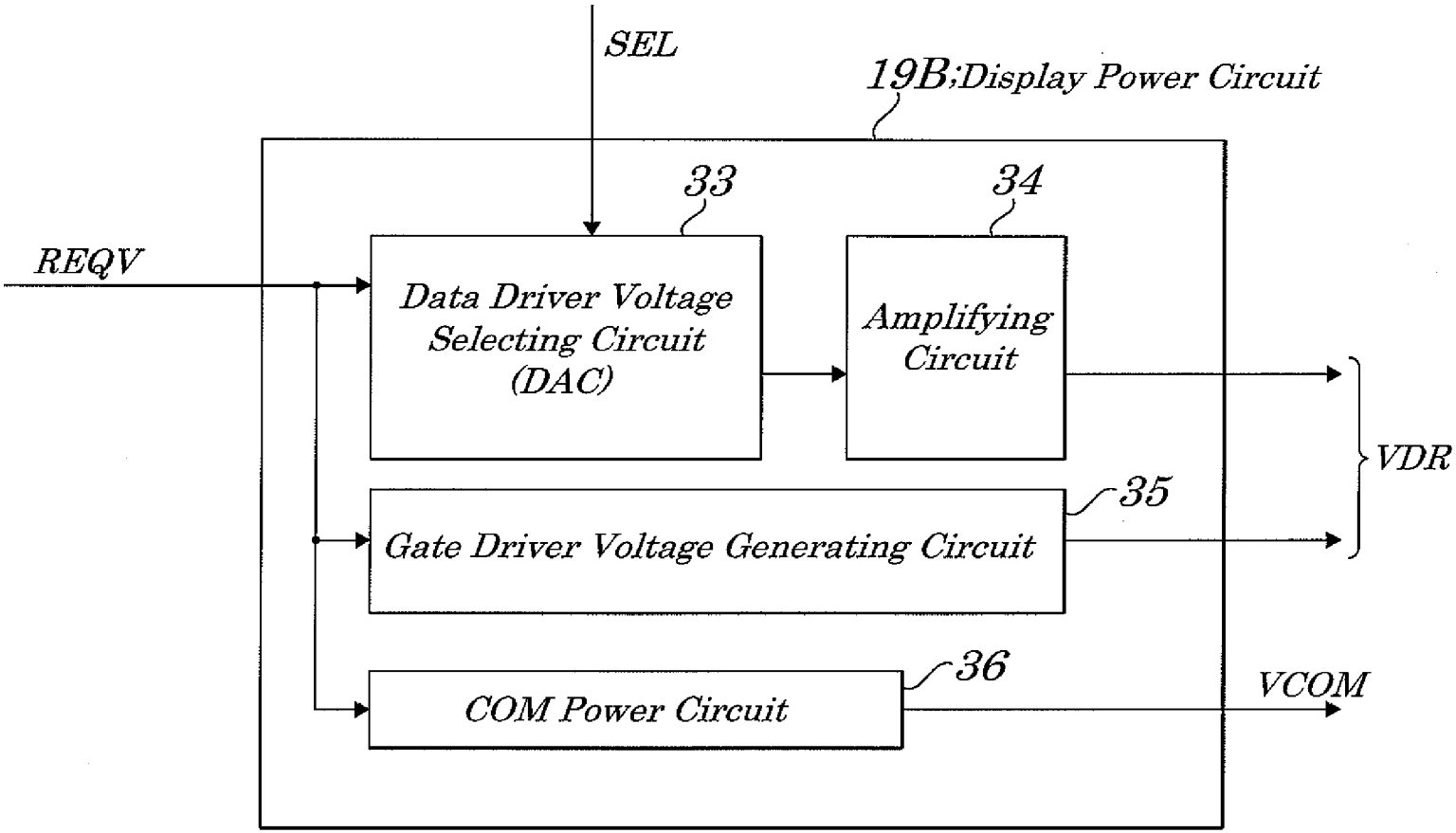
FIG. 24 is a block diagram showing, in detail, a display power circuit making up the electronic paper display device of the fifth embodiment of the present invention.

Next, the fifth embodiment of the present invention is described. According to the first to fourth embodiments, the voltage signal to be supplied to a data driver of an electronic paper section 9 includes 7 voltage values, however, in the fifth embodiment, the voltage signal to be supplied to the data driver is made up of, for example, 3 voltage values of Vdd, 0, −Vdd may be used and a reference voltage for a driver can be varied for every sub-frame. FIG. 23 is a black diagram showing, in detail, an electronic paper controller making up an electronic paper display device of the fifth embodiment. FIG. 24 is a block diagram showing, in detail, a display power circuit making up the electronic paper controller.

The electronic paper controller 13B, by using the LUT group WFn shown in Table 3, has a circuit configuration as a voltage control means to realize the driving waveforms shown in FIGS. 4 to 12 and, more specifically, includes, as shown in FIG. 23, a display power circuit 19B, an electronic paper control circuit 20B, a data reading circuit 21 and an LUT converting circuit 22 (or 22A).

The electronic paper control circuit 20B transmits a pixel reading demand signal REQP being the same kind of signal described in the first (and second) embodiment, LUT data (and selecting signal SEL), a power output demand signal REQT and additionally a two-bit selecting signal SEL showing whether a current sub-frame belongs to a reset period (R) or to a first sub-frame group period (S1), or to a second sub-frame period (S2) or to a third sub-frame group period (S3) to the display power circuit 19B for every sub-frame period.

For example, SEL=[00] represents an R period, SEL=[01] represents an S1 period, SEL=[10] represents an S2 period, and SEL=[11] represents an S3 period. The display power circuit 19B, when receiving a power output demand signal REQV, outputs a driver reference voltage VDR and a COM voltage VCOM, however, changes the driver reference voltage VDR in accordance with the selecting signal SEL. The driver reference voltage VDR includes a data driver plus reference voltage VDR_GND. When SEL is [00] and [01], the display power circuit 19B outputs the voltage of VDR_D+ (=+30V) and VDR_D− (=−30V) and, when SEL=[10], the display power circuit 19B outputs the voltage of VDR_D+ (=+15V) and VDR_D− (=−15V), and further when SEL=[11], outputs the voltage of VDR_D+ (=+10V) and VDR_D− (=−10V).

FIG. 24 shows a block diagram showing internal configurations of the display power circuit. The display power circuit 19B includes a data driver voltage selecting circuit 33, an amplifying circuit 34 for the data driver voltage selecting circuit 33, a gate driver voltage generating circuit 35, and a COM power circuit 36. The gate driver voltage generating circuit 35 generates voltages of VDR_G+ and VDR_G−. The COM power circuit 36 generates the common voltage VCOM. The data driver selecting circuit 33 is a digital-analog converter (DAC) and, when SEL=[00], outputs a voltage +3V/−3V, and when SEL=[01], outputs voltages +3V/−3V, when SEL=[10], outputs voltages +1.5 V/−1.5V, when SEL=[11], outputs voltages +1V/−1V. These voltages are amplified by 10 and the VDR_D+ and VDR_D− can be made variable for every sub-frame.

According to the fifth embodiment, even when the data driver 12 cannot output simultaneously voltages required for driving, an electrophoretic display device can be driven and, therefore, the driver can be configured simply, which can serve to achieve costdown.

Moreover, according to the fifth embodiment, the first voltage V1 is applied during the first sub-frame group period and the second voltage V2 is applied during the second sub-frame group period, and the third voltage V3 is applied during the third sub-frame group period and, therefore, the selecting signal is explained by using 2-bits. However, in order to be able to extend the structures up to those employed in seventh to tenth embodiments, it is preferable that a voltage is variable for every sub-frame, for example, and, if a screen renewing period is made up of 256 sub-frames, by making the selecting signal SEL be made up of 8 bits, an applied voltage is made variable for each sub-frame, in general, by constructing the signal of n-bits and the number of two squared sub-frames can be variable.

Sixth Embodiment

Next, the sixth embodiment of the present invention is described. In the sixth embodiment, even when a withstand voltage of a data driver is below a driving voltage of an electrophoretic display device, by making a COM voltage be variable for every sub-frame, a driving voltage of the electrophoretic display device is realized. Here, the data driver has 3 values as in the case of the fifth embodiment and a withstand voltage of the data driver is Vdd/−Vdd=+15V/−15V. The voltage to be applied to the electrophoretic display device during the resetting period is ±30V and the voltage V1 to be applied during the first sub-frame group period S1 is ±30V and 0V and the voltage V2 to be applied during the second sub-frame group period S2 is ±20V and 0V (here, for easy understanding that the COM voltage is made variable, the voltage V2 to be applied during the second sub-frame period has been changed to be |V2| (=20V).

In the sixth embodiment, during the resetting period R in which the voltage to be applied to the electrophoretic display device exceeds a withstand voltage |Vdd| of a data driver, the first sub-frame group period S1 and second sub-frame group period S2 are divided into two groups respectively, that is, a plus sub-frame group and a minus sub-frame group. That is, as shown in Table 10, the period is divided into periods of R+, R−, S1+, S1−, S2+, S2−, and S3. By setting the reference voltage of the data driver to be VDR_D+=+15V and VDR_D−=−15V and by setting the COM voltage to be VCOM=−15V during R+ and S1+, as the data driver signal, as shown in Table 10, the voltage VD=+15V, 0V, and −15V can be outputted and, therefore, the voltage V to be applied to the electrophoretic display device becomes V=VD−VCOM=30V, (15V), 0V. Similarly, during the periods R− and S1, by setting the COM voltage to be VCOM=+15V, as a data driver signal, as shown in Table 10, the voltages VD=15V, 0V, −15V can be outputted and, therefore, the voltage V to be applied to the electrophoretic display device becomes VD−VCOM=−30V, (−15V), 0V.

Similarly, by setting the reference voltage (VD) of the data driver to be VDR_D=+10V and VDR_D=−10V and by setting the reference voltage of COM to be VCOM=−10V during the S2+ period, as shown in Table 10, VD becomes +10V, 0V, −10V and, therefore, the voltage V to be applied to the electrophoretic display device becomes V=VD−VCOM=20V, (10V), 0V. Also, by setting the reference voltage of COM to be VCOM=+10V during the S2− period, as shown in Table 10, VD becomes +10V, 0V, −10V and, therefore, the voltage V to be applied to the electrophoretic display device becomes V=VD−VCOM=−20V, (−10V), 0V. During the S3 period, by setting the VCOM to be 0V, the voltage V becomes −10V, 0V, +10V.

TABLE 10

| | | R+ | | R− | | S1+ | | S1− | |
|---|---|---|---|---|---|---|---|---|---|
| | | a | b | a | b | a | b | a | b |
| Selectable Voltage | V | 30, 0 | | −30, 0 | | 30, 0 | | −30, 0 | |
| | VD | 15, 0, −15 | | 15, 0, −15 | | 15, 0, −15 | | 15, 0, −15 | |
| | VCOM | −15 | | 15 | | −15 | | 15 | |
| (C, M, Y) = (0.5, 1, 0.5) | V | 0 | 0 | −30 | −30 | 30 | 0 | 0 | 0 |
| | VD | −15 | −15 | −15 | −15 | 15 | −15 | −15 | −15 |
| | VCOM | −15 | −15 | 15 | 15 | −15 | −15 | −15 | 15 |

| | | S2+ | | | | S2− | | | | S3 | | | | | |
|---|---|---|---|---|---|---|---|---|---|---|---|---|---|---|---|
| | | a | b | c | d | a | b | c | d | a | b | c | d | e | f |
| Selectable Voltage | V | 20, 0 | | | | −20, 0 | | | | 10, 0, −10 | | | | | |
| | VD | 10, 0, −10 | | | | 10, 0, −10 | | | | 10, 0, −10 | | | | | |
| | VCOM | −10 | | | | 10 | | | | 0 | | | | | |
| (C, M, Y) = (0.5, 1, 0.5) | V | 20 | 20 | 0 | 0 | 0 | 0 | 0 | 0 | −10 | −10 | −10 | 0 | 0 | 0 |
| | VD | 10 | 10 | −10 | −10 | 10 | 10 | 10 | 10 | −10 | −10 | −10 | 0 | 0 | 0 |
| | VCOM | −10 | −10 | −10 | −10 | 10 | 10 | 10 | 10 | 0 | 0 | 0 | 0 | 0 | 0 |

Figure 6A:
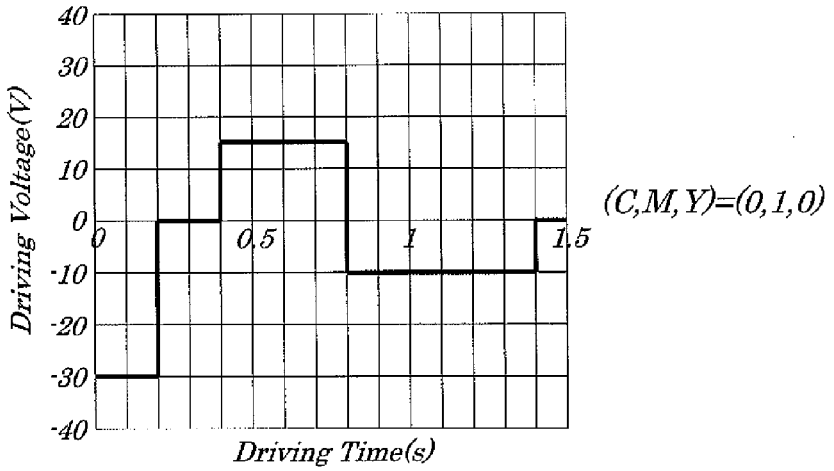
FIG. 6 is a waveform diagram showing a driving voltage waveform for explaining the driving method of the first embodiment.
Figure 6B:
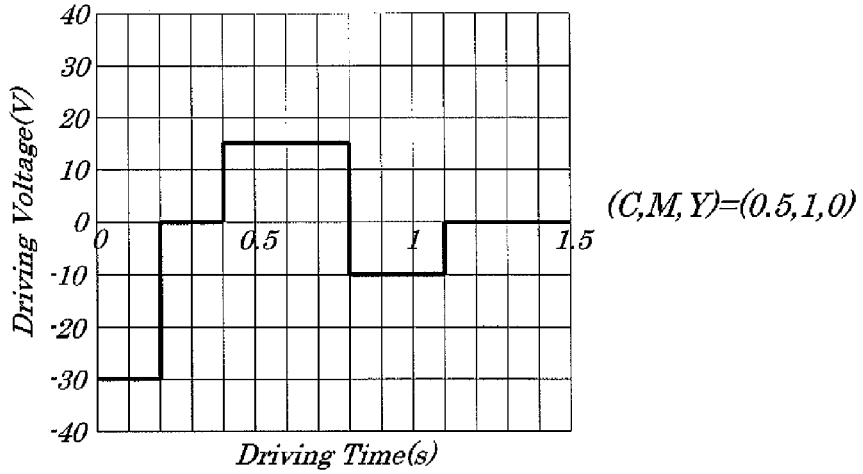
Figure 6B:
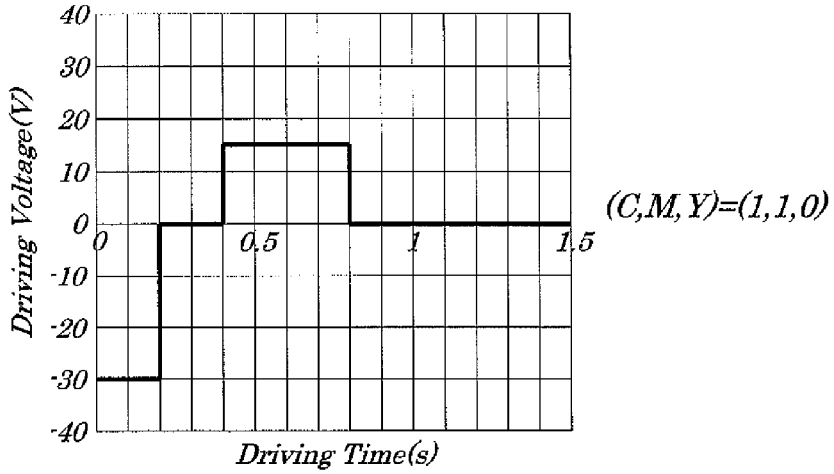
Figure 7A:
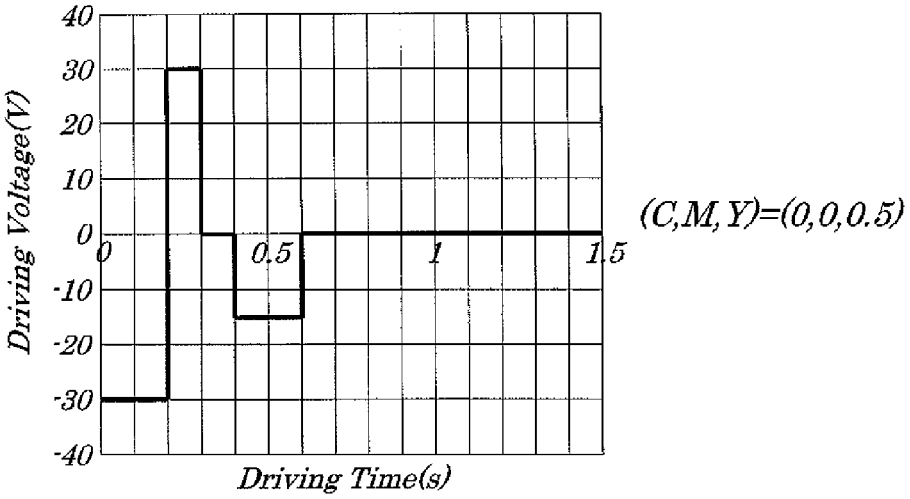
FIG. 7 is a waveform diagram showing a driving voltage waveform for explaining the driving method of the first embodiment.
Figure 7B:
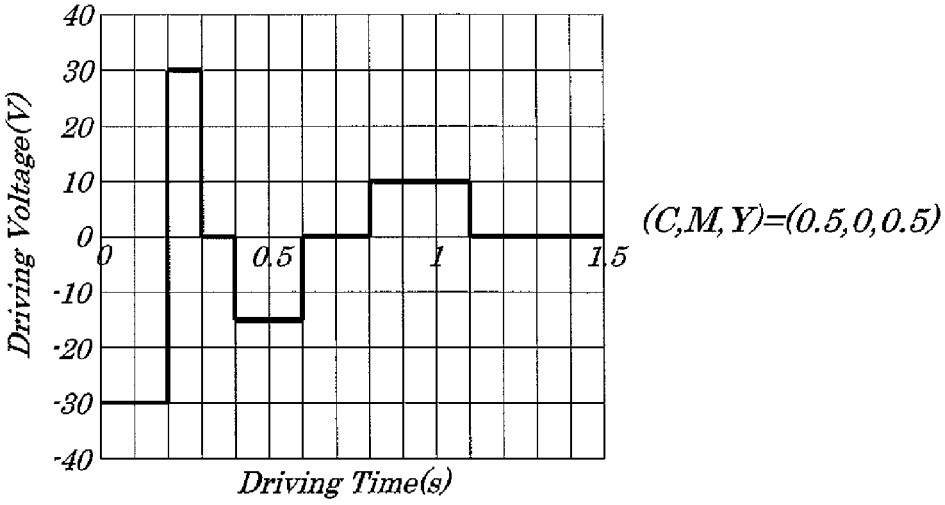
Figure 7C:
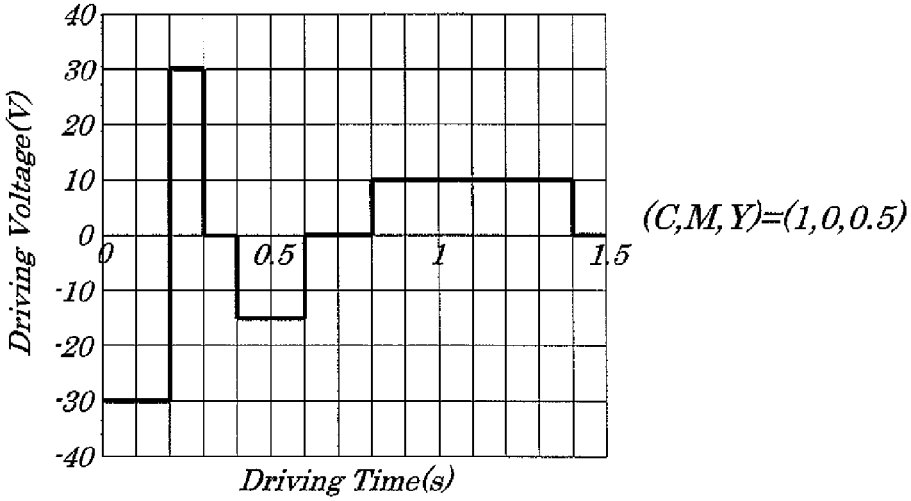
Figure 8A:
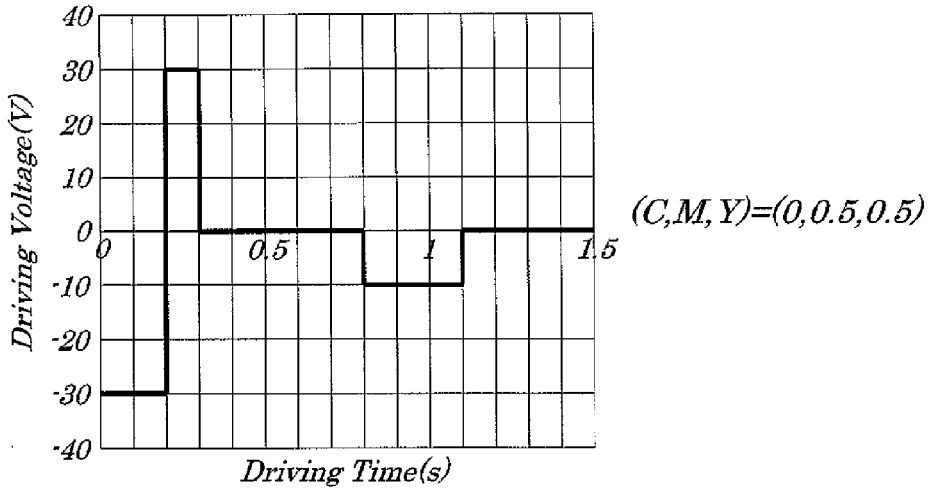
FIG. 8 is a waveform diagram showing a driving voltage waveform for explaining the driving method of the first embodiment.
Figure 8B:
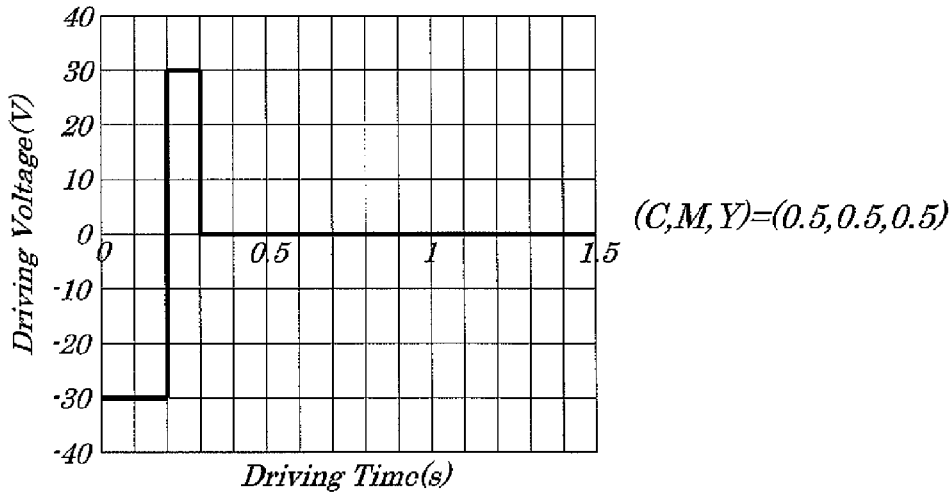
Figure 8C:
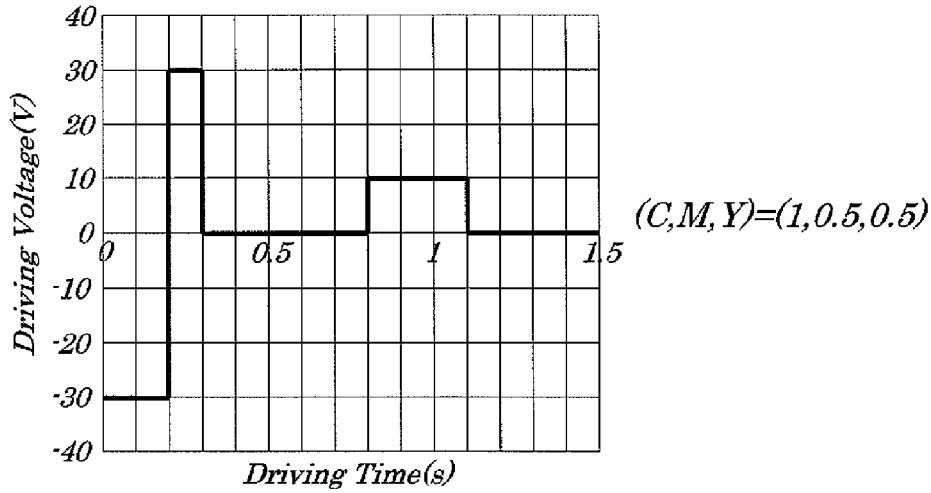
Figure 25:
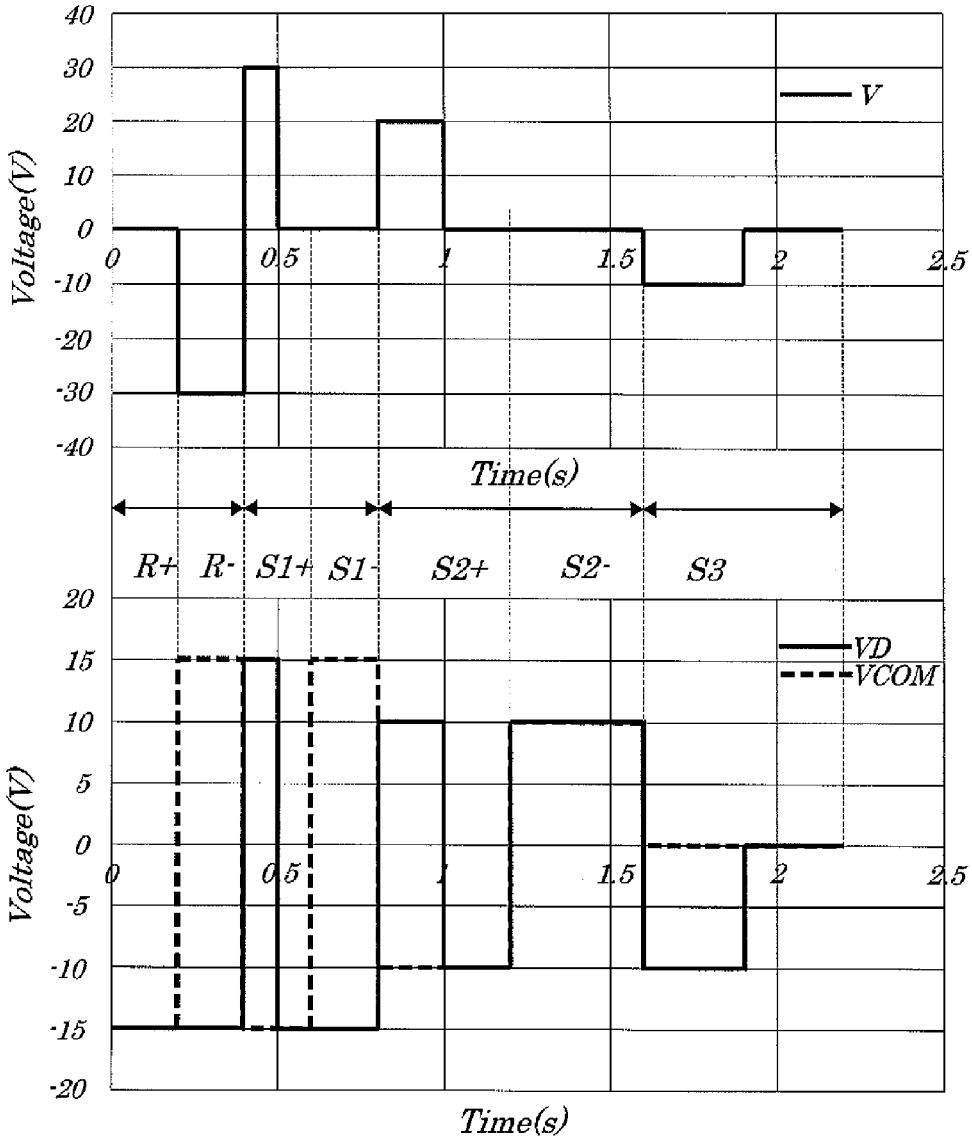
FIG. 25 is a waveform diagram explaining a sixth embodiment of the present invention.
Figure 26:
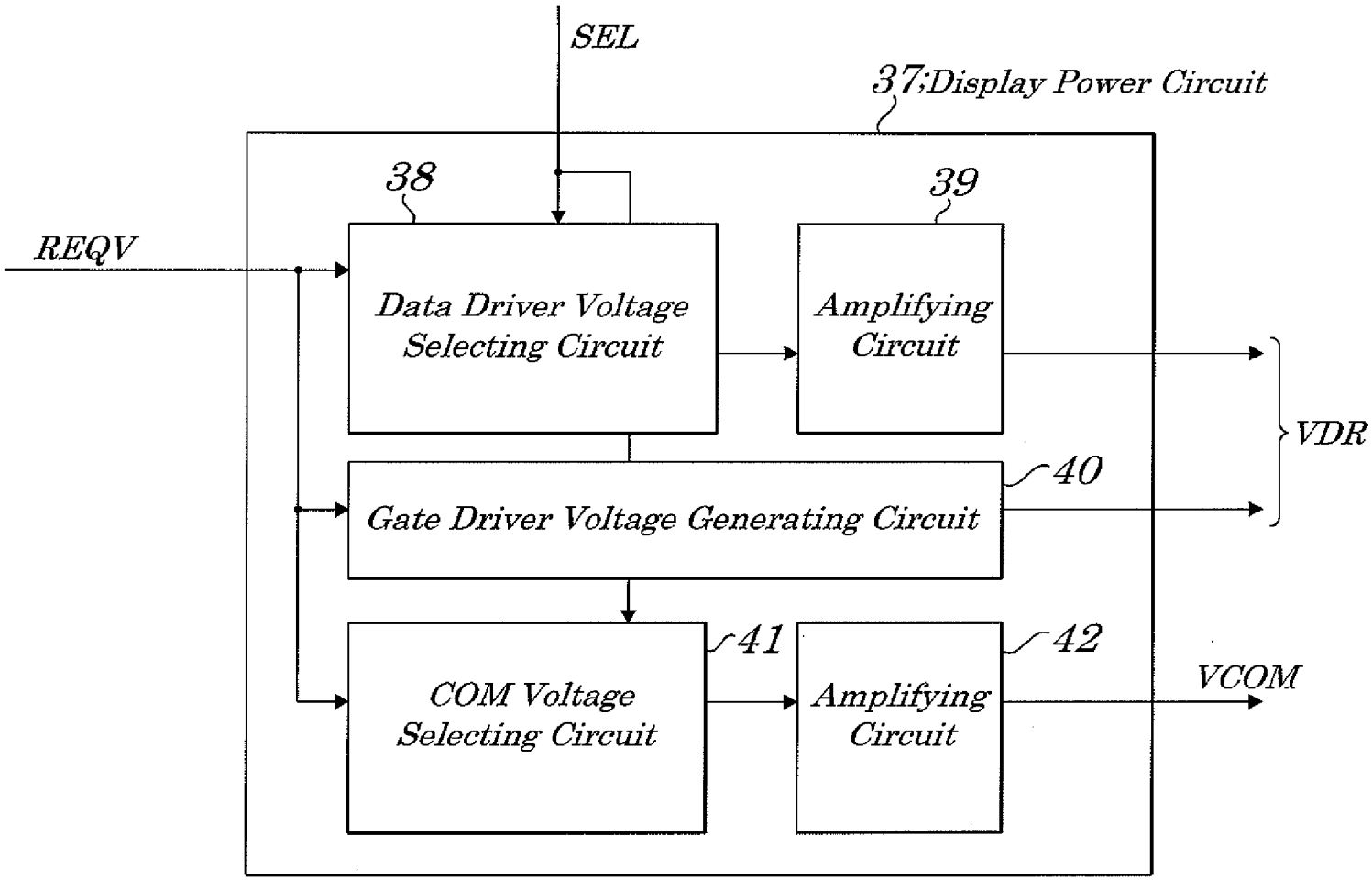
FIG. 26 is a block diagram showing, in detail, a display power circuit making up the electronic paper controller of the sixth embodiment.
Figure 27:
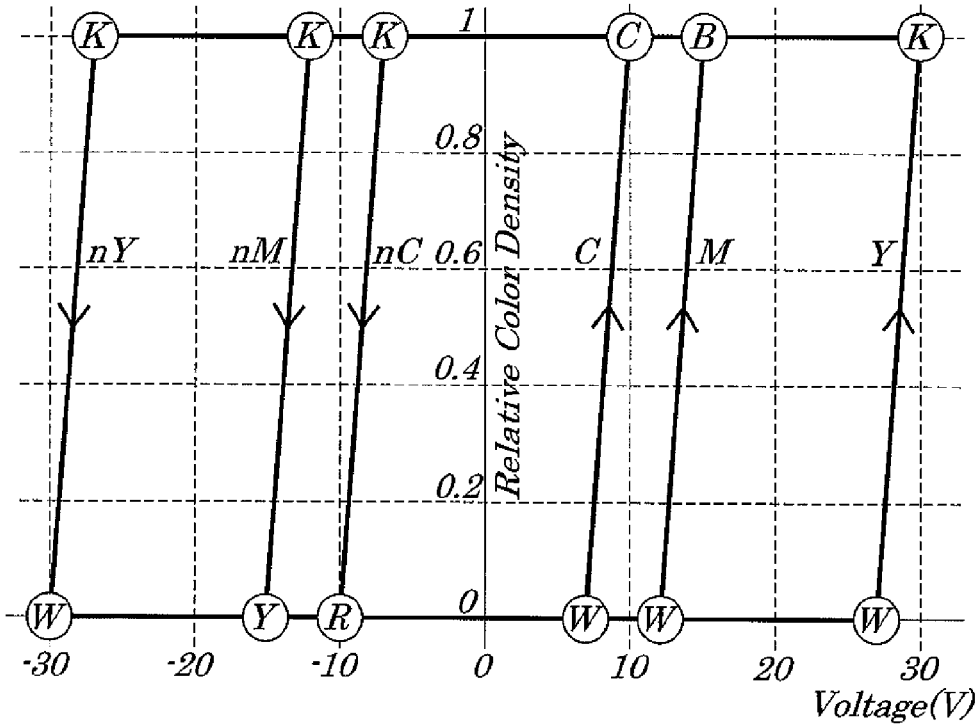
FIG.27 (RELATED ART)
FIG. 27 is a diagram explaining problems of a related technology.
Figure 28:
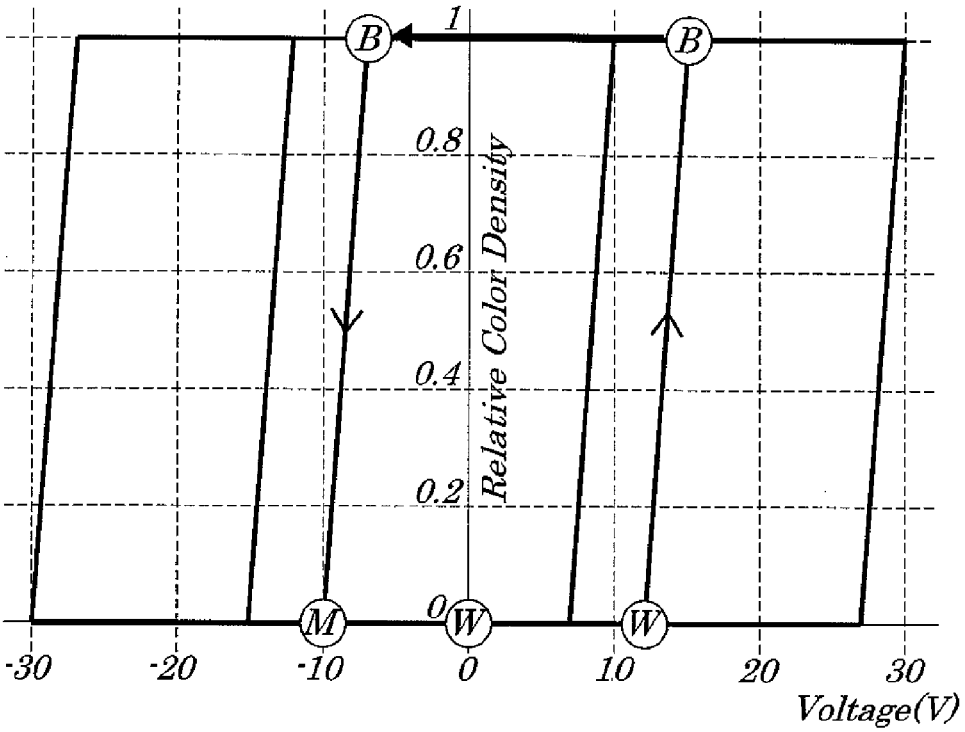
FIG.28 (RELATED ART)
FIG. 28 is a diagram explaining problems of the related technology.

In Table 10, as one example, the voltage VD to be outputted from the data driver, COM voltage VCOM, voltage V to be applied to the electrophoretic display device, which are required to realize (C, M, Y)=(0.5, 1.0, 0.5), are shown. Also, in FIG. 25, driving waveforms to realize (C, M, Y)=(0.5, 1.0, 0.5) are shown. The circuit configurations to achieve the above driving waveforms are the same as in the fifth embodiment except the internal configurations of the display power circuit. The display power circuit of the embodiment includes, as shown in FIG. 6, a data driver voltage selecting circuit 38, its amplifying circuit 39, a gate driver voltage generating circuit 40, a COM voltage selecting circuit 41, and its amplifying circuit 42. The selecting signal SEL to be outputted from the electronic paper control circuit is represented by 3 bits and inputted into the display power circuit 37 for every frame period. For example, the SEL=[000] represents R+ period, SEL=[100] represents R−, SEL=[100] represents R−, SEL=[001] represents S1+ period, SEL=[101] represents S1− period, SEL=[010] represents S2+ period, SEL=[110] represents S2− period, and SEL=[011] represents S3 period.

The gate driver voltage generating circuit 40 generates VDR_G+ and VDR_G−. The data driver selecting circuit 38 is a digital/analog converter (DAC) and, by referring to low-order two bits SEL[1:0] of SEL, outputs 3V/−3V at time of SEL[1:0]=[00], +3V/−3V at time of SEL[1:0]=[01], +2V/−2V at time of SEL[1:0]=[10] and +V/−V at time of SEL [1:0]=[11] and these outputted voltages are amplified by 5 and setting is made so that the VDR_D+ and VDR_D− can be made variable for every sub-frame period.

The COM voltage selecting circuit 41 is a digital/analog converter (DAC) and outputs −3V at time of SEL=[000], +3V at time of SEL [100], −3V at time of SEL=[001], +3V at time of SEL=[101], −2V at time of SEL=[010], +2V at time of SEL=[110], and 0V at time of SEL=[011] and these outputted voltages are amplified by 5 and a set is performed so that a common voltage COM is made variable for each sub-frame period. In the above, it is described that each of the R period, S1 period, and S2 period is divided into the plus sub-frame period and minus sub-frame period, however, in each of the R, S1, and S2 periods, only the plus sub-frame period or the minus sub-frame period is used and, therefore, the sub-frame group period of one being not used can be omitted.

Thus, according to the embodiment, even when the data driver 12 cannot output simultaneously voltages required for driving and even if the data driver is under the driving voltage of the electrophoretic display device, it is possible to drive the electrophoretic display device and the driver can be simply configured which can reduce costs.

Seventh Embodiment

Next, the seventh embodiment of the present invention is described. The electronic paper display device of the seventh embodiment is different from the electronic paper display device of the first to sixth embodiment, that is, the electronic paper display device of the first to sixth embodiments is made up of electrophoretic particles (charged particles) C, M, and Y all having the same polarity (for example, in the first to sixth embodiments, all the particles have a positive polarity), however, in the seventh embodiment, three color charged particles C, M, and Y are made up of a combination of two given particles having the same polarity and one remaining particle having a different polarity. Hereinafter, the electronic paper display device of the seventh embodiment is described in which, for example, the charged particles C and Y are positively charged having the same polarity and the charged particle M is negatively charged having a different polarity.

In this embodiment, as in the case of the first to sixth embodiments described above, by introducing intermediate transition states (MG, I-1, and I-2) during which a current display state CUR (hereinafter, "current screen") and a display state N (hereinafter, "next screen") appearing after the renewal of an image are displayed, a systematic and simple method of driving operations of displaying intermediate colors and shades of gray is realized. That is, the driving period of having a plurality of sub-frame period includes a resetting period for a transition to a ground state, a first sub-frame group period (first voltage application period) during which voltages of V1, 0, −V1[V] are applied, a second sub-frame group period (second voltage application period) during which voltages of V2, 0, −V2[V] are applied, and a third sub-frame group period (third voltage application period) during which voltages of V3, 0, −V3[V] are applied. However, the ground state refers to a state in which, by fully applying a voltage V1 or −V1, a particle having a different polarity (charged particle M of the present invention) is moved to a display surface side and a magenta color is displayed, that is, M is displayed or charged particle M is moved to a display surface side or a rear surface side and a green color is displayed. Therefore, if aground state is defined as a state in which a charged particle M is moved to a display screen, a display color in the ground state is a magenta color (M) while, if a ground state is defined as a state in which a charged particle is moved to a read surface side, the display color in the ground state is a green (G).

More specifically, pixel information of an image to be displayed (next screen N to which a display state is renewed) is expressed by a relative color density (Rc, Rm, and Ry) of charged particles (C, M, and Y), the first sub-frame period is a period during which a transition occurs from a ground state (MG) in which a magenta color (M) or a green color G) is displayed to a first intermediate transition state I-1 during which the relative color density of the charged particle Y becomes Ry and the second sub-frame group period is a period during which a transition occurs from the first intermediate transition state I-1 in which the third sub-frame group period is a period during which a transition occur in which Y density is Ry and M density becomes Rm to the second intermediate transition state and the third sub-frame group period is a period during which a transition occurs from the second intermediate transition state I-2 to a renewal display state in which Y density is Ry and M density is Rm, and C density becomes Rc.

Table 11 shows concrete driving voltage data in which each of the three colors (cyan C, magenta M, and yellow Y) providing 3 gray levels is shown. In this embodiment, the particles C and Y are positively charged and particles M are negatively charged and, a large/small characteristic relationship of the charged amount is |Qc|>|Qm|>|Qy| and, therefore, the large/small characteristic relationship of a threshold voltage for initiating a movement of charged particles C, M, and Y is set to be |Vth(c)|<|Vth(m)|<|Vth(y)|. On the other hand, by making weight and/or size of each of the particles be different from one another, the movement mobility to the same applied voltage becomes the same as that of the charged particles C, M, and Y.

In this embodiment also, a driving voltage driving the electrophoretic display device is set to be |V1|=30V or 0V in the first sub-frame group period, |V2|=15V or 0V in the second sub-frame group period, and |V3|=10V or 0V in the third sub-frame group period (moreover, if necessary, it is needless to say that the driving voltage may be changed to be a given value).

TABLE 11

| Targeted | | | Resetting Period | | | | | First Sub-frame Group Period | | | | | Second Sub-frame Group Period | | | | | | |
|---|---|---|---|---|---|---|---|---|---|---|---|---|---|---|---|---|---|---|---|
| Renewing Display | | | Applied Voltage | | Ground State | | | Applied Voltage | | Intermediate Transition State I-1 | | | Applied Voltage | | | | Intermediate Transition State I-2 | | |
| C | M | Y | Ra | Rb | C | M | Y | 1a | 1b | C | M | Y | 2a | 2b | 2c | 2d | C | M | Y |
| 0 | 0 | 0 | −30 | −30 | 0 | 1 | 0 | 0 | 0 | 0 | 1 | 0 | 15 | 15 | 15 | 15 | 0 | 0 | 0 |
| 0.5 | 0 | 0 | −30 | −30 | 0 | 1 | 0 | 0 | 0 | 0 | 1 | 0 | 15 | 15 | 15 | 15 | 0 | 0 | 0 |
| 1 | 0 | 0 | −30 | −30 | 0 | 1 | 0 | 0 | 0 | 0 | 1 | 0 | 15 | 15 | 15 | 15 | 0 | 0 | 0 |
| 0 | 0.5 | 0 | −30 | −30 | 0 | 1 | 0 | 0 | 0 | 0 | 1 | 0 | 15 | 15 | 0 | 0 | 0 | 0.5 | 0 |
| 0.5 | 0.5 | 0 | −30 | −30 | 0 | 1 | 0 | 0 | 0 | 0 | 1 | 0 | 15 | 15 | 0 | 0 | 0 | 0.5 | 0 |
| 1 | 0.5 | 0 | −30 | −30 | 0 | 1 | 0 | 0 | 0 | 0 | 1 | 0 | 15 | 15 | 0 | 0 | 0 | 0.5 | 0 |
| 0 | 1 | 0 | −30 | −30 | 0 | 1 | 0 | 0 | 0 | 0 | 1 | 0 | 0 | 0 | 0 | 0 | 0 | 1 | 0 |
| 0.5 | 1 | 0 | −30 | −30 | 0 | 1 | 0 | 0 | 0 | 0 | 1 | 0 | 0 | 0 | 0 | 0 | 0 | 1 | 0 |
| 1 | 1 | 0 | −30 | −30 | 0 | 1 | 0 | 0 | 0 | 0 | 1 | 0 | 0 | 0 | 0 | 0 | 0 | 1 | 0 |
| 0 | 0 | 0.5 | −30 | −30 | 0 | 1 | 0 | 30 | 0 | 0.5 | 0.5 | 0.5 | 15 | 15 | 0 | 0 | 1 | 0 | 0.5 |
| 0.5 | 0 | 0.5 | −30 | −30 | 0 | 1 | 0 | 30 | 0 | 0.5 | 0.5 | 0.5 | 15 | 15 | 0 | 0 | 1 | 0 | 0.5 |
| 1 | 0 | 0.5 | −30 | −30 | 0 | 1 | 0 | 30 | 0 | 0.5 | 0.5 | 0.5 | 15 | 15 | 0 | 0 | 1 | 0 | 0.5 |

TABLE 11-continued

| | | | | | | | | | | | | | | | | | | | |
|---|---|---|---|---|---|---|---|---|---|---|---|---|---|---|---|---|---|---|---|
| 0 | 0.5 | 0.5 | −30 | −30 | 0 | 1 | 0 | 30 | 0 | 0.5 | 0.5 | 0.5 | 0 | 0 | 0 | 0 | 0.5 | 0.5 | 0.5 |
| 0.5 | 0.5 | 0.5 | −30 | −30 | 0 | 1 | 0 | 30 | 0 | 0.5 | 0.5 | 0.5 | 0 | 0 | 0 | 0 | 0.5 | 0.5 | 0.5 |
| 1 | 0.5 | 0.5 | −30 | −30 | 0 | 1 | 0 | 30 | 0 | 0.5 | 0.5 | 0.5 | 0 | 0 | 0 | 0 | 0.5 | 0.5 | 0.5 |
| 0 | 1 | 0.5 | −30 | −30 | 0 | 1 | 0 | 30 | 0 | 0.5 | 0.5 | 0.5 | −15 | −15 | 0 | 0 | 0 | 1 | 0.5 |
| 0.5 | 1 | 0.5 | −30 | −30 | 0 | 1 | 0 | 30 | 0 | 0.5 | 0.5 | 0.5 | −15 | −15 | 0 | 0 | 0 | 1 | 0.5 |
| 1 | 1 | 0.5 | −30 | −30 | 0 | 1 | 0 | 30 | 0 | 0.5 | 0.5 | 0.5 | −15 | −15 | 0 | 0 | 0 | 1 | 0.5 |
| 0 | 0 | 1 | −30 | −30 | 0 | 1 | 0 | 30 | 30 | 1 | 0 | 1 | 0 | 0 | 0 | 0 | 1 | 0 | 1 |
| 0.5 | 0 | 1 | −30 | −30 | 0 | 1 | 0 | 30 | 30 | 1 | 0 | 1 | 0 | 0 | 0 | 0 | 1 | 0 | 1 |
| 1 | 0 | 1 | −30 | −30 | 0 | 1 | 0 | 30 | 30 | 1 | 0 | 1 | 0 | 0 | 0 | 0 | 1 | 0 | 1 |
| 0 | 0.5 | 1 | −30 | −30 | 0 | 1 | 0 | 30 | 30 | 1 | 0 | 1 | −15 | −15 | 0 | 0 | 0.5 | 0.5 | 1 |
| 0.5 | 0.5 | 1 | −30 | −30 | 0 | 1 | 0 | 30 | 30 | 1 | 0 | 1 | −15 | −15 | 0 | 0 | 0.5 | 0.5 | 1 |
| 1 | 0.5 | 1 | −30 | −30 | 0 | 1 | 0 | 30 | 30 | 1 | 0 | 1 | −15 | −15 | 0 | 0 | 0.5 | 0.5 | 1 |
| 0 | 1 | 1 | −30 | −30 | 0 | 1 | 0 | 30 | 30 | 1 | 0 | 1 | −15 | −15 | −15 | −15 | 0 | 1 | 1 |
| 0.5 | 1 | 1 | −30 | −30 | 0 | 1 | 0 | 30 | 30 | 1 | 0 | 1 | −15 | −15 | −15 | −15 | 0 | 1 | 1 |
| 1 | 1 | 1 | −30 | −30 | 0 | 1 | 0 | 30 | 30 | 1 | 0 | 1 | −15 | −15 | −15 | −15 | 0 | 1 | 1 |

| Targeted | | | Third Sub-frame Group Period | | | | | | | | |
|---|---|---|---|---|---|---|---|---|---|---|---|
| Renewing Display | | | Applied Voltage | | | | | | Renewal Display | | |
| C | M | Y | 3a | 3b | 3c | 3d | 3e | 3f | C | M | Y |
| 0 | 0 | 0 | 0 | 0 | 0 | 0 | 0 | 0 | 0 | 0 | 0 |
| 0.5 | 0 | 0 | 10 | 10 | 10 | 0 | 0 | 0 | 0.5 | 0 | 0 |
| 1 | 0 | 0 | 10 | 10 | 10 | 10 | 10 | 10 | 1 | 0 | 0 |
| 0 | 0.5 | 0 | 0 | 0 | 0 | 0 | 0 | 0 | 0 | 0.5 | 0 |
| 0.5 | 0.5 | 0 | 10 | 10 | 10 | 0 | 0 | 0 | 0.5 | 0.5 | 0 |
| 1 | 0.5 | 0 | 10 | 10 | 10 | 10 | 10 | 10 | 1 | 0.5 | 0 |
| 0 | 1 | 0 | 0 | 0 | 0 | 0 | 0 | 0 | 0 | 1 | 0 |
| 0.5 | 1 | 0 | 10 | 10 | 10 | 0 | 0 | 0 | 0.5 | 1 | 0 |
| 1 | 1 | 0 | 10 | 10 | 10 | 10 | 10 | 10 | 1 | 1 | 0 |
| 0 | 0 | 0.5 | −10 | −10 | −10 | −10 | −10 | −10 | 0 | 0 | 0.5 |
| 0.5 | 0 | 0.5 | −10 | −10 | −10 | 0 | 0 | 0 | 0.5 | 0 | 0.5 |
| 1 | 0 | 0.5 | 0 | 0 | 0 | 0 | 0 | 0 | 1 | 0 | 0.5 |
| 0 | 0.5 | 0.5 | −10 | −10 | −10 | 0 | 0 | 0 | 0 | 0.5 | 0.5 |
| 0.5 | 0.5 | 0.5 | 0 | 0 | 0 | 0 | 0 | 0 | 0.5 | 0.5 | 0.5 |
| 1 | 0.5 | 0.5 | 10 | 10 | 10 | 0 | 0 | 0 | 1 | 0.5 | 0.5 |
| 0 | 1 | 0.5 | 0 | 0 | 0 | 0 | 0 | 0 | 0 | 1 | 0.5 |
| 0.5 | 1 | 0.5 | 10 | 10 | 10 | 0 | 0 | 0 | 0.5 | 1 | 0.5 |
| 1 | 1 | 0.5 | 10 | 10 | 10 | 10 | 10 | 10 | 1 | 1 | 0.5 |
| 0 | 0 | 1 | −10 | −10 | −10 | −10 | −10 | −10 | 0 | 0 | 1 |
| 0.5 | 0 | 1 | −10 | −10 | −10 | 0 | 0 | 0 | 0.5 | 0 | 1 |
| 1 | 0 | 1 | 0 | 0 | 0 | 0 | 0 | 0 | 1 | 0 | 1 |
| 0 | 0.5 | 1 | −10 | −10 | −10 | 0 | 0 | 0 | 0 | 0.5 | 1 |
| 0.5 | 0.5 | 1 | 0 | 0 | 0 | 0 | 0 | 0 | 0.5 | 0.5 | 1 |
| 1 | 0.5 | 1 | 10 | 10 | 10 | 0 | 0 | 0 | 1 | 0.5 | 1 |
| 0 | 1 | 1 | 0 | 0 | 0 | 0 | 0 | 0 | 0 | 1 | 1 |
| 0.5 | 1 | 1 | 10 | 10 | 10 | 0 | 0 | 0 | 0.5 | 1 | 1 |
| 1 | 1 | 1 | 10 | 10 | 10 | 10 | 10 | 10 | 1 | 1 | 1 |

By referring to Table 11, a concrete driving method of the present embodiment is described. In Table 11, the first column shows relative color densities (C, M, Y) in a targeting display state. The second column shows a applied voltage during the resetting period and relative color density in a ground state appearing after the resetting period. The resetting period is made up of two sub-frames Ra and Rb and selectable applied voltage is −30V. The third column shows an applied voltage to be used in the first sub-frame group period and in the intermediate transition state I-1 occurring at a termination point of the period. The sub-frame group period is made up of 2 sub-frames 1*a* and 1*b* and selectable applied voltage is +30V, 0V, and −30V). The fourth column shows an applied voltage in the second sub-frame group period and a relative color density in the second intermediate transition state I-2 appearing at a termination point of the period. The second sub-frame group period is made up of 4 sub-frames 2*a*, 2*b*, 2*c*, and 2*d* and selectable applied voltages are +15V, 0V, and −15V. The fifth column shows an applied voltage in the third sub-frame group period and a relative color density in a renewal display state N being a final transition state appearing at a termination point of the period. The third sub-frame group period is made up of 6 sub-frames 3*a*, 3*b*, 3*c*, 3*d*, 3*e*, and 3*f* and selectable applied voltage is +10, 0V, and −10V.

In the resetting period, V1 (=−30V) is applied for 2 frames and by moving a charged particle M to a display surface and by moving charged particles C and Y to a rear surface side, a magenta color (M) is displayed as a display color in the ground state MG. During the first sub-frame group period, in a manner to correspond to a relative color density of charged particle Y, when the relative color density Y is 0, the applied voltage becomes 0V and, when the relative color density Y is 0.5, the applied voltage 30V is applied only for one frame, and when the relative color density of charged particle Y is 1, the applied voltage 30V is applied for 2 sub-frames. By controlling the voltages as above, a transition occurs from the ground state MG to the first intermediate transition state I-1, that is, (C, M, Y)=(x1*c*, x1*m*, Ry), where Ry takes on values of 3 gray levels (0, 0.5, 1), and x1*c* and x1*m* each are arbitrary values.

During the second sub-frame group period, predetermined amounts of the voltage −15V or 15V are applied so that the relative color density of a targeting charged particle M becomes Rm. That is, a difference (Rm−x1*m*) between the targeting color density Rm and the relative color density x1*m* of the first intermediate transition state I-1 is calculated and predetermined amounts of the voltage −15V or 15V are applied. For example, when x1*m*=1 and Rm=0.5, since its density difference (Rm−x1*m*)=−0.5 and, therefore, in order to lower the gray levels by one, the voltage +15V (since the charged particle M is negatively charged) is applied for 2 sub-frames to reduce the number of charged particles Mon the display surface side.

Thus, a transition is allowed to occur from the first intermediate transition state I-1, that is, (C, M, Y)=(x1*c*, x1*m*, Ry) to the second transition state I-2, that is, (C, M, Y)=(x2*c*, Rm, Ry), where Rm takes on values of 3 gray levels (0, 0.5, 1), and x2*c* is an arbitrary value.

During the third sub-frame group period, predetermined amounts of the voltage −10V or 10V are applied so that the relative color density of a targeting charged particle C becomes Rc. For example, when x2*c*=0 and Rc=0.5, since its density difference (Rc−x2*c*)=−0.5 and, therefore, in order to raise the gray levels by one, the voltage +10V (since the particle C is positively charged) is applied for 3 sub-frames to increase the number of charged particles C on the display surface side. Thus, a transition occurs from the second intermediate transition state I-2, that is, (C, M, Y)=(x2*c*, Rm, and Ry) to the targeting renewal display state N, that is, (C, M, Y)=(Rc, Rm, Ry), where Rc takes on values of 3 gray levels (0, 0.5, 1).

Moreover, the driving circuit of the seventh embodiment can be realized by using any one of circuit configurations of the first, fifth, and sixth embodiments (FIGS. 15 to 18, FIG. 23, FIG. 24, and FIG. 26) and, therefore, their descriptions are omitted. This hold true for the eighth and ninth embodiments.

Eighth Embodiment

Next, the eighth embodiment of the present invention is described. The eighth embodiment differs from the first to seventh embodiments in that charged particles having two colors and same polarity, instead of three color charged particles described above are employed. In the eighth embodiment, by using a cyan (C) color charged particles being complementary to one another, red (R) color charged particles, white (W) color charged particles serving as a holding body to hold the charged particles, display of R, C, black (K), W, and their intermediate colors and shades of gray is made possible.

Hereinafter, assuming that charged particles C and R are positively charged, the driving method is described.

The driving waveforms to be used in this embodiment are formed by voltages applied during a resetting period during which a transition to a ground state where white or black is displayed, a first sub-frame group period (first voltage applying period) during which voltages V1, 0, −V1[V] are applied, a second sub-frame group period (second voltage applying period) during which voltages V2, 0, −V2[V] are applied. More specifically, when the relative density (C and R) of charged particles being display information for each pixel of a next screen NEXT to be renewed is expressed by (Rc and Rr), the first sub-frame group period is a transition period from the ground state where white (W) or black (K) is displayed to the intermediate transition state in which a relative color density of the charged particle becomes Rr, and the second sub-frame group period is a period during which a transition occurs from the first intermediate transition state I-1 to a renewal display state (renewing screen).

Here, as values for the relative color density Rx (x=c, r), 0 to 1 is taken and, the case when Rx=0 represents no X particles (X=C, R) exists on a display surface and the case when Rx=1 represents all particles are moving on the display surface.

Table 12 shows concrete driving data presuming that each of the charged particles C and R has two colors and provides 3 gray levels. For simplification purpose, a charged amount Q of each of the charged particles C and R is set so as to be |Q(c)|>|Q(r) and, therefore, the threshold value voltage for initiating movements of charged particles is set so as to be |Vth(c)|<|Vth(r)|. In the embodiment, the voltage to drive an electrophoretic element and to be applied during the first sub-frame group period is set to be |V1|=30V or 0V and to |V1|=15V or 0V during the second sub-frame period.

TABLE 12

| Targeted | | Resetting Period | | | | First Sub-frame Group Period | | | | Second Sub-frame Group Period | | | | | |
|---|---|---|---|---|---|---|---|---|---|---|---|---|---|---|---|
| Renewing Display | | Applied Voltage | | Ground State | | Applied Voltage | | Intermediate Transition State I-1 | | Applied Voltage | | | | Renewal Display | |
| C | R | Ra | Rb | C | R | 1a | 1b | C | R | 2a | 2b | 2c | 2d | C | R |
| 0 | 0 | −30 | −30 | 0 | 0 | 0 | 0 | 0 | 0 | 0 | 0 | 0 | 0 | 0 | 0 |
| 0.5 | 0 | −30 | −30 | 0 | 0 | 0 | 0 | 0 | 0 | 15 | 15 | 0 | 0 | 0.5 | 0 |
| 1 | 0 | −30 | −30 | 0 | 0 | 0 | 0 | 0 | 0 | 15 | 15 | 15 | 15 | 1 | 0 |
| 0 | 0.5 | −30 | −30 | 0 | 0 | 30 | 0 | 0.5 | 0.5 | −15 | −15 | 0 | 0 | 0 | 0.5 |
| 0.5 | 0.5 | −30 | −30 | 0 | 0 | 30 | 0 | 0.5 | 0.5 | 0 | 0 | 0 | 0 | 0.5 | 0.5 |
| 1 | 0.5 | −30 | −30 | 0 | 0 | 30 | 0 | 0.5 | 0.5 | 15 | 15 | 0 | 0 | 1 | 0.5 |
| 0 | 1 | −30 | −30 | 0 | 0 | 30 | 30 | 1 | 1 | −15 | −15 | −15 | −15 | 0 | 1 |
| 0.5 | 1 | −30 | −30 | 0 | 0 | 30 | 30 | 1 | 1 | −15 | −15 | 0 | 0 | 0.5 | 1 |
| 1 | 1 | −30 | −30 | 0 | 0 | 30 | 30 | 1 | 1 | 0 | 0 | 0 | 0 | 1 | 1 |

Moreover, the time Δt required for each of the charged particles C and R to move from a rear to a display surface, as described in the first embodiment, has a relation being reverse proportional to an applied voltage V (exceeding the threshold value voltage) and V×Δt=constant. In the embodiment, one sub-frame period is set to be 100 ms and the screen renewing period includes 8 sub-frame periods (2 sub-frames as resetting voltage applying period, 2 sub-frames as first resetting group period, and 4 sub-frames as second sub-frame group period).

Next, by referring to Table 12, a concrete driving method of the embodiment is described. The first column shows a relative color density in a targeting renewal display state. The second column shows an applied voltage during the resetting period and a relative color density in a ground state appearing after the resetting period. The resetting period, in the eighth embodiment, includes 3 sub-frames Ra and Rb and selectable voltage is −30V. The third column shows an applied voltage during the first sub-frame group period and a relative color density in the intermediate transition state I-1 appearing at a termination point of the period. The sub-frame group period includes 2 sub-frames 1*a* and 1*b* and selectable voltage is +30V, 0V, and (−30V). The reason why it includes 2 sub-frames is that a response time of a particle is 0.2 sec at 30V and 0.1 sec is needed in one sub-frame period. The fourth column shows an applied voltage for the second sub-frame group period and a relative color density in a renewal display state N appearing at the termination point of the period. The second sub-frame group period includes 4 sub-frames 2*a*, 2*b*, 2*c*, and 2*d*. The reason why it includes 4 frames is that response time of a particle is 0.4 seconds at 30V and 0.1 sec is needed in one sub-frame period.

During the resetting period, the voltage −V1 (=−30V) is applied for 2 sub-frames and charged particles C and R are allowed to move and gather on a rear side being opposite to a display surface to display a white (W) color being a display color in the ground state. In the next first sub-frame group period, in a manner to correspond to the relative color density of charged particle R, when the relative color density (R) is 0, the voltage 0V is applied to 2 frames and when the relative color density (R) is 0.5, the voltage 30V is applied to one sub-frame and 0V is applied for one sub-frame. When a relative color density (R) is 1, the voltage 30V is applied for 2 sub-frames. By controlling the voltage as above, a transition occurs from a boundary state W to an intermediate transition state I-1, that is, (C, R)=Rr, Rr), where Rr takes on values of 3 gray levels (0, 0, 5, 1).

During next second sub-frame group period, similarly, a transition is allowed to occur, by applying a predetermined amount of −15V or 15V, from an intermediate transition state I-1, that is, (C, R)=R (Rr and Rr) to a renewal display state N, that is, (C, R)=(Rc, Rc). For example, if a difference (Rc−Rr) between the relative color density Rr in the intermediate transition state I-1 and the relative color density Rc in the renewal display state=0.5, the voltage 15V is applied for 2 sub-frames. Also, when a density difference (Rc−Rr)=1, −0.5, 0, −1, a predetermined amount of voltage 15V or −15V is applied. By this applying operation of voltages, a transition occurs from the intermediate transition state I-1, that is, (C, R)=(Rr, Rr) to a renewal display state N, that is, (C, R)=(Rc, Rr), where Rc and Rr each take on values of 3 gray levels (0, 0.5, 1).

Thus, according to the eighth embodiment, by using 2 kinds of charged particles being complementary in color to one another, displaying of an intermediate color and shades of gray can be realized.

Ninth Embodiment

Next, the ninth embodiment of the present invention is described. In the ninth embodiment, as in the case of the eighth embodiment, by using charged particles having a cyan (C) color being complementary in color to charged particles having a red (R) color, and white uncharged particles serving as a holding body to hold the charged particles, displaying of red (R), black (K), white (W) and their intermediate color and shades of gray is achieved. However, the ninth embodiment differs from the eighth embodiment in that charged particles C and R having two colors and polarities being different from one another is used, instead of charged particles having two colors and same polarity. In the ninth embodiment, the particle C is negatively charged and particles R is positively charged and by setting a charged amount Q to be |Q(c)|>|Q(r)|, large/small characteristic relationship of the threshold value voltages for initiating movements of charged particles C and R is set to be |Vth(c)|<|Vth(r)|.

Table 13 shows concrete driving voltage data obtained when each of the two color charged particles C and R, to be employed in the driving method of the embodiment, provides 3 gray levels. Hereinafter, the driving method of the ninth embodiment is described.

TABLE 13

| Targeted | | Resetting Period | | | | First Sub-frame Group Period | | | | Second Sub-frame Group Period | | | | | |
|---|---|---|---|---|---|---|---|---|---|---|---|---|---|---|---|
| Renewing Display | | Applied Voltage | | Ground State | | Applied Voltage | | Intermediate Transition State I-1 | | Applied Voltage | | | | Renewal Display | |
| C | R | Ra | Rb | C | R | 1a | 1b | C | R | 2a | 2b | 2c | 2d | C | R |
| 0 | 0 | −30 | −30 | 1 | 0 | 0 | 0 | 0 | 0 | 0 | 0 | 0 | 0 | 0 | 0 |
| 0.5 | 0 | −30 | −30 | 1 | 0 | 0 | 0 | 0 | 0 | −15 | −15 | 0 | 0 | 0.5 | 0 |
| 1 | 0 | −30 | −30 | 1 | 0 | 0 | 0 | 0 | 0 | −15 | −15 | −15 | −15 | 1 | 0 |
| 0 | 0.5 | −30 | −30 | 1 | 0 | 30 | 0 | 0.5 | 0.5 | 15 | 15 | 0 | 0 | 0 | 0.5 |
| 0.5 | 0.5 | −30 | −30 | 1 | 0 | 30 | 0 | 0.5 | 0.5 | 0 | 0 | 0 | 0 | 0.5 | 0.5 |
| 1 | 0.5 | −30 | −30 | 1 | 0 | 30 | 0 | 0.5 | 0.5 | −15 | −15 | 0 | 0 | 1 | 0.5 |
| 0 | 1 | −30 | −30 | 1 | 0 | 30 | 30 | 0 | 1 | 0 | 0 | 0 | 0 | 0 | 1 |
| 0.5 | 1 | −30 | −30 | 1 | 0 | 30 | 30 | 0 | 1 | −15 | −15 | 0 | 0 | 0.5 | 1 |
| 1 | 1 | −30 | −30 | 1 | 0 | 30 | 30 | 0 | 1 | −15 | −15 | −15 | −15 | 1 | 1 |

First, during the resetting period, the voltage V1 (=−30V) is applied for 2 sub-frames and by moving and gathering charged particles C to a display surface side and charged particles R to a rear side being reverse to the display surface side, cyan (C) being a display color in a ground state is displayed. During the next sub-frame group period, in a manner to correspond to a relative color density of the charged particles, when a relative color density (R) is 0, a voltage 0V is applied for 2 sub-frames and when a relative color density (R) is 0.5, a voltage 30V is applied for one sub-frame and 0V is also applied for one sub-frame. When the relative color density (R) is 1, a voltage 30V is applied for 2 sub-frames. By operating as above, a transition occurs from a ground state W to an intermediate transition state I-1, that is, (C, R)=(x1*c*, Rr), where Rr takes on values of 3 gray levels (0, 0.5, 1), and x1*c* takes on any given value. Then, during the second sub-frame group period, in a similar way, by applying a predetermined amount of the voltage of −15V or 15V, a transition is allowed to occur from the intermediate transition state I-1, that is, (C, R)=(x1*c*, Rr), to a renewal display state N, that is, (C, R)=(Rc, Rr). For example, if a difference (Rc−x1*c*) between the relative color density x1*c* in the intermediate transition state I-1 and the relative color density Rc in the renewal display state=0.5, the voltage −15V is applied for 2 sub-frames. Also, when a density difference (Rc−Rr)=1, −0.5, 0, −1, a predetermined amount of voltage 15V or −15V is applied. By this applying operation of voltages, a transition occurs from the intermediate transition state I-1, that is, (C, R)=(x1*c*, Rr) to a renewal display state N, that is, (C, R)=(Rc, Rr), where Rc and Rr each take on values of 3 gray levels (0, 0.5, 1). Thus, according to the ninth embodiment, by using 2 kinds of charged particles being complementary in color to each another, displaying of intermediate colors and shades of gray can be realized. These operating principles of the electronic paper display device (image display device) of the eighth and ninth embodiments can be generalized as below.

That is, in the configurations using 2 kinds of charged particles out of the configurations of the present invention, the charged particle includes 2 kinds of charged particles C and R each having a different color and a different threshold value voltage for initiating electrophoresis and has a characteristic relationship of |Vth(c)|<|Vth(r)|, where |Vth(c)| is a threshold value voltage of the charged particle C and |Vth(r)| is a threshold value voltage of the charged particle R, and, when a relative color density of the charged particle C, of each pixel making up a renewing next screen, is Rc and a relative color density of the charged particle R is Rr, the above predetermined period for the application of voltages, includes, at least, a resetting period during which a resetting voltage is applied, a first sub-frame group period including, at least, a sub-frame for applying a first voltage V1, −V1, and/or 0V and allowing a transition to occur to an intermediate transition state in which the color density of the charged particle R becomes Rr, and a second sub-frame including, at least, a sub-frame for applying a first voltage V2, −V2, and/or 0V and allowing a transition to occur, with the color density of the charged particle R being held to be Rr, to an intermediate transition state in which the color density of the charged particle C becomes Rc, and a following formula of a characteristic relationship of the voltages V1 and V2 is satisfied: |Vth(c)|<|V2|<|Vth(r)|<|V1|.

Tenth Embodiment

Next, the tenth embodiment is described below. The tenth embodiment differs from the first to ninth embodiments in driving waveforms for driving electrophoretic elements. In the present embodiment, the concept that "a relative color density of a charged particle Ck is determined" is expanded up to a concept that "a change of the relative color density after being determined is small is acceptable, even when compared with a color density difference among gray levels of each color". In the embodiment, a k-th sub-frame group period includes a low voltage sub-frame during which a voltage of (Vk, 0, −Vk) is applied and a high voltage sub-frame during which a voltage (Vx, 0, −Vx) being higher than |Vk| is applied.

Hereinafter, the driving method of the embodiment is described. In the case of the first embodiment, a period for the driving waveform, when a sub-frame period is set to be 0.01 s, instead of 0.1 s, includes a first sub-frame group period during which |30V| or 0V is applied is made up of 20 sub-frames (it is equivalent to 2 sub-frames when the sub-frame period is 0.1 s), a second sub-frame group period during which |15V| or 0V is applied is made up of 40 sub-frame (it is equivalent to 4 sub-frames when the sub-frame period is 0.1 s), and a third sub-frame group period during which |10V| or 0V is applied is made up 60 sub-frames (it is equivalent to 6 sub-frames when the sub-frame period is 0.1 seconds). Therefore, if a relative color density to be obtained during a targeting renewing state is, for example, (C, M, Y)=(0.5, 1, 0.5) is to be realized, a voltage −10V is applied to the third sub-frame group period for 30 frames. However, in the tenth embodiment, according to the tenth embodiment, when the sub-frame period is set to be 0.01 s, a relative color density of 0.5 of a charged particle C can be realized by a voltage −15V (high voltage) is applied to the third sub-frame group for 2 sub-frames (being equivalent to −10V applied for 3 sub-frames) and a voltage of −10V (low voltage) is applied for 27 sub-frames. As a result, though a color density of a charged particle M becomes small (the color density of the charged particle M lowers to 1−2/40=0.95 by simple calculation), if a gray level is at 3 gray levels of 0, 0.5, 1 or so, even if two high voltage sub-frames during which a voltage (V2, 0, −V2) (V2=15V) is applied are added to part of the third sub-frame group period, the color density of the charged particle C can be determined without any influence on a relative color density of charged particle M, that is, within a range of an error. Thus, the number of sub-frames as a total can be reduced (in the above examples, the number of sub-frames decreases by one), thereby shortening a screen renewing period.

It is apparent that the present invention is not limited to the above embodiments and may be changed and modified without departing from the scope and spirit of the invention.

For example, in the above embodiments, the electrophoretic display device uses charged particles having three colors of cyan (C), magenta (M) and yellow (Y) and a white holding body, however, instead of the cyan (C), magenta (M), and yellow (Y) charged particles, red (R), green (G), and blue (B) charged particles may be employed. Moreover, in order to hold the charged particle, instead of a holding body, a microcapsule housing a charged particle may be used. The white particle is not limited to a huge holding body and non-charged particle floating in a solvent can be used and a weakly charged particles having a low electric field sensitivity may be employed. In other words, by applying the present invention to an electrophoretic display device including three kinds or more of color particles having a different color and a different threshold value voltage (4 color particles C, M, Y, and K, color particles R, G, B, and W, or 6 color particles C, M, Y, R, G, and B), not only each single color display but also any given color (La*b*) including intermediate colors can be simply realized.

The configurations of the present invention including the case of electrophoretic particles having three colors or more can be generalized as below.

That is, according to a generalized first configuration of the present invention, the electrophoretic image display device having a memory property includes: a display section made up of a first substrate in which switching elements, pixel electrodes are arranged in a matrix manner, a second substrate in which a facing electrode is formed, and an electrophoretic layers interposed between the first and second substrates containing electrophoretic particles, and a voltage applying unit to apply a specified voltage for a predetermined period to the electrophoretic particles interposed between the pixel electrode and facing electrode at time of renewal of a screen and to renew a display state of the display section from a current screen to a next screen having a predetermined color density, wherein the electrophoretic particles include n-kinds ("n" is a natural number being 3 or more) of charged particles Cn, . . . , Ck, . . . , C1 (k=2 to n−1) each having colors different from one another and threshold value voltages at which electrophoresis starts also different from one another and charged particles Cn, . . . , Ck, . . . , C1 have a characteristic relationship of |Vth(cn)|< . . . <|Vth(ck)|< . . . <|Vth(c1)|, where |Vth(cn)| is a threshold value voltage of a charged particle Cn, |Vth(ck)| is a threshold value voltage of a charged particle Ck, and |Vth(c1)| is a threshold value voltage of a charged particle C1 and wherein, at time of renewal of a screen, the predetermined color density of a next screen determines a relative color density of each of the charged particles in order of charged particles C1→ . . . , →CK, . . . , →Cn.

In the above first configuration, the concept that "each of the charged particles is determined in order of charged particles C1→ . . . , →Cn" includes the concept that the change of a relative color density after being determined is fully small when compared with color density difference between gray levels.

According to a generalized second configuration of the present invention, the electrophoretic image display device having a memory property includes: a display section made up of a first substrate in which switching elements, pixel electrodes are arranged in a matrix manner, a second substrate in which a facing electrode is formed, and an electrophoretic layer interposed between the first and second substrates containing electrophoretic particles, and a voltage applying unit to apply a specified voltage, in accordance with driver data to be inputted from a voltage control circuit, at time of renewal of a screen, to the electrophoreic particles interposed between the pixel electrode and the facing electrode, in order to renew display state of the display screen from a current screen to a next screen having a predetermined density, wherein the electrophoretic particles include n-kinds ("n" is a natural number being 3 or more) of charged particles Cn, . . . , Ck, . . . , C1 (k=2 to n−1) which each are different from one another in color and in threshold value voltage for initiating electrophoresis and the charged particles Cn, . . . , Ck, . . . , C1 have a characteristic relationship of |Vth(cn)|< . . . <|Vth(ck)|< . . . |Vth(c1)|, where |Vth(cn)| is a threshold value voltage of a charged particle Cn, |Vth(ck)| is a threshold value voltage of a charged particle Ck, and |Vth(c1)| is a threshold value voltage of a charged particle C1, and wherein, when relative color density information of charged particle Cn is Rn, relative color density information of charged particle Ck is Rk, and relative color density information of charged particle C1 is R1, in each of pixels making up a next screen to be renewed, the specified period during which a voltage is applied includes, at least, a resetting period during which a reset is performed to a ground state, a first sub-frame group period including at least a sub-frame during which a first voltage V1 (or −V1) and/or 0V are applied during which a transition is allowed to occur from the above ground state to a first intermediate transition state in which charged particle C1 becomes the relative color density R1, a second to "n−1"-th sub-frame group period including at least a sub-frame during k-th voltage Vk (or −Vk) and/or 0V are applied during which a transition is allowed to occur from the "k−1"-th intermediate transition state to k-th intermediate transition state in which, with the relative color density of charged particle C1 being held to be R1, with the relative color density of charged particle Ck−1 being held to be Rk−1, the relative color density of charged particle Ck becomes Rk, and an n-th sub-frame group period including at least a sub-frame during n-th voltage Vn (or −Vn) and/or 0V are applied during which a transition is allowed to occur from the "n−1"-th intermediate transition state to a renewal display state (final transition state) in which, with the relative color density of charged particle C1 being held to be R1, with the relative color density of charged particle Cn−1 being held to be Rn−1, the relative color density of charged particle Cn becomes Rn, and the following formula of a characteristic relationship between the above threshold value voltage of each of the above charged particles and the above voltage to be applied during the above sub-frame group period is satisfied:

$$|Vth(cn)|<|Vn|<|Vth(c(n-1))|,$$

$$|Vth(ck)|<|Vk|<|Vth(c(k-1))|, \text{ and}$$

$$|Vth(c1)|<|V1|.$$

In the above configurations, the concept of "with a relative color density being held" is the concept that a change of relative color density obtained before the transition state of each sub-frame group period and after the completion of each of sub-frame group periods is fully small when compared with a color density difference among gray levels of each color. This is the same in the following third and fourth configurations.

According to a generalized third configuration of the present invention, the electrophoretic image display device having a memory property includes: a display section made up of a first substrate in which switching elements and pixel electrodes are arranged in a matrix manner, a second substrate in which facing electrodes are formed, and an electrophoretic layers containing electrophoretic particles interposed between the first substrate and the second substrate; and a voltage applying unit to apply a specified voltage for a predetermined period to the electrophoretic particle interposed between the pixel electrodes and the facing electrodes at time of renewal of a screen and to renew a display state of the display section from a current screen to a next screen having a predetermined color density, wherein the electrophoretic particles include n-kinds ("n" is a natural number being 3 or more) of charged particles Cn, . . . , Ck, . . . , C1 (k=2 to n−1) which each are different from one another in color and in threshold value voltage for initiating electrophoresis and the charged particles Cn, . . . , Ck, . . . , C1 have a characteristic relationship of |Vth(cn)|< . . . <|Vth(ck)|< . . . <|Vth(c1)|, where |Vth(cn)| is a threshold value voltage of a charged particle Cn, |Vth(ck)| is a threshold value voltage of a charged particle Ck, and |Vth(c1)| is a threshold value voltage of a charged particle C1, and wherein, in each pixel making up a next screen to be renewed, when relative color density information of the charged particle Cn is Rn, . . . , and relative color density information of the charged particle Ck is Rk, and relative color density information of the charged particle C1 is R1, the specified period during which a voltage is applied includes, at least, a resetting period to reset to a ground state, a first sub-frame group period containing at least a sub-frame during which a first voltage V1 (or −V1) and/or 0V are applied to cause a transition from the ground state to a first intermediate transition state in which a relative color density of the charged particle C1 becomes R1, a second to "n−1"-th sub-frame group period during which, after a transition occurs, by containing at least a sub-frame during which an n-th voltage Vk (or −Vk) is applied, from a "k−1"-th intermediate transition state to a k-th (1) intermediate transition state in which, with a relative color density of the charged particle C1 being held to be R1, . . . , and a relative color density of the charged particle Ck−1 being held to be Rk−1, a relative color density of the charged particle Ck becomes 0 or 1 in a ground state, a transition occurs, by containing at least a sub-frame during which a k-th voltage Vk (or −Vk) and/or 0V are applied, from the K-th (1) intermediate transition state to a K-th (2) intermediate transition state, with a relative color density of the charged particle C1 being held to be R1, . . . , and a relative color density of the charged particle Ck−1 being held to be Rk−1, a relative color density of the charged particle Ck becomes Rk, and an n-th sub-frame group period during which, after a transition occurs, by containing at least a sub-frame in which an n-th voltage Vn (or −Vn) is applied, from the "n−1"-th intermediate transition state to an n-th (1) intermediate transition state in which, with a relative color density C1 being held to be R1, . . . , and with a relative color density of a charged particle Cn−1 being held to be Rn−1, a relative color density of charged particle Cn becomes 0 or 1 in the ground state, a transition occurs, by containing at least a sub-frame during which an n-th voltage Vn (or −Vn) and/or 0V are applied, from the n-th (1) intermediate transition state to a renewal display state (final transition) during which, with a relative color density of the charged particle C1 being held to be R1, . . . , and with a relative color density of a charged particle Cn−1 being held to be Rn−1, a relative color density of the charged particle Cn becomes Rn, and a following formula of characteristic relationship between the threshold voltage of each of the charged particles and the voltage to be applied during each of the sub-frame group periods is satisfied:

$$|Vth(cn)|<|Vn|<|Vth(c(n-1))|,$$

$$|Vth(ck)|<|Vk|<|Vth(c(k-1))|, \text{ and}$$

$$|Vth(c1)|<|V1|.$$

According to a generalized fourth configuration of the present invention, the image display device having a memory property includes: a display section made up of a first substrate in which switching elements and pixel electrodes are arranged in a matrix manner, a second substrate in which facing electrodes are formed, and electrophoretic layers containing electrophoretic particles interposed between the first substrate and the second substrate; and a voltage applying unit to apply a specified voltage, in accordance with driver data to be inputted from a voltage control circuit, at time of renewal of a screen, to the electrophoreic particles interposed between the pixel electrode and the facing electrode, in order to renew display state of the display screen from a current screen to a next screen having a predetermined density, wherein the electrophoretic particles include n-kinds ("n" is a natural number being 3 or more) of charged particles Cn, . . . , Ck, . . . , C1 (k=2 to n−1) which each are different from one another in color and in threshold value voltage for initiating electrophoresis and the charged particles Cn, . . . , Ck, . . . , C1 have a characteristic relationship of |Vth(cn)|< . . . <|Vth(ck)|< . . . <|Vth(c1)|, where |Vth(cn)| is a threshold value voltage of a charged particle Cn, |Vth(ck)| is a threshold value voltage of a charged particle Ck, and |Vth(c1)| is a threshold value voltage of a charged particle C1, and wherein, in each pixel making up a next screen to be renewed, when relative color density information of the charged particle Cn is Rn, relative color density information of the charged particle Ck is Rk, and relative color density information of the charged particle C1 is R1, the specified period during which a voltage is applied includes, at least, a resetting period to reset to a ground state, a first sub-frame group period containing a sub-frame during which a first voltage V1 (or −V1), second voltage V2 (or −V2) and/or 0V are applied to cause a transition to a first intermediate transition state in which, with a relative color density of the charged particle C1 being held to be R1, and a relative color density of a charged particle C2 becomes 0 or 1, a second to "n−1"-th sub-frame group period containing at least a sub-frame during which a "k−1"-th sub-frame voltage Vk−1 (or −(Vk−1)), k-th voltage Vk (or −Vk) and/or 0V are applied to cause a transition from a "k−1"-th intermediate transition state to a second to "n−1"-th intermediate transition state in which, with a relative color density of the charged particle C1 being held to be R1 and, with a relative color density of a charged particle Ck−1 being held to be Rk−1, a relative color density of the charged particle Ck becomes 0 or 1, an n-th sub-frame group period containing at least a sub-frame period during which an n-th voltage Vn (or −Vn) is applied to cause a transition from the n−1-th intermediate transition state to a renewal display state (final transition) in which, with a relative color density of the charged particle C1 being held to be R1, a relative color density of a charged particle Cn−1 being held to be Rn−1 and, with a relative color density of charged particle Cn becomes Rn, and a following formula of a characteristic relationship between the threshold value voltage of each of the charged particles and the voltage to be applied during each of the sub-frames is satisfied:

$$|Vth(cn)|<|Vn|<|Vth(c(n-1))|,$$

$$|Vth(ck)|<|Vk|<|Vth(c(k-1))|, \text{ and}$$

$$|Vth(c1)|<|V1|.$$

According to a generalized fifth configuration of the present invention, the voltage control unit, when receiving a screen renewing command to renew a current screen to a next screen, starts counting of a sub-frame number, outputs the driver data, when the sub-frame number is for a resetting period, by referring to a look-up table for resetting period, and when the sub-frame number is for a number of a first sub-frame group period, based on the relative color density of the charged particle C and the sub-frame number, and by referring to a look-up table for the first sub-frame, abstracts corresponding driver data and outputs the data to the voltage applying unit, and when the sub-frame group period is a number of a k-th (K=2 to "n−1"-th) sub-frame, based on the relative color density information Rk and Rk−1 of charged particles Ck and Ck−1, respectively, and on a sub-frame number and by referring to a look-up table for a k-th sub-frame, abstracts corresponding the driver data and sequentially outputs the data to the voltage applying unit, and when the sub-frame is a number for an n-th sub-frame group period, based on relative color densities Rn and Rn−1 of the charged particles Cn and Cn−1 and the sub-frame number and by referring to a look-up table for the second sub-frame group periods, abstracts corresponding the driver data and outputs the data to the voltage applying unit.

Moreover, during the above resetting period, the number of sub-frames of each of the sub-frame group periods may be freely set depending on the above display state on a next screen to be renewed.

Further, in the ground state, when the electrophoretic display element is made up of charged particles having three colors C, M, Y (|Vth(c)|<|Vth(m)|<|Vth(y|, where |Vth(c)| is a threshold value voltage of a charged particle C, |Vth(m)| is a threshold value voltage of a charged particle M, and |Vth(y)| is a threshold value voltage of a charged particle Y, where a set is performed to a white or black near to a relative color density of a charged particle Y for every display state of a next screen to be renewed.

Still further, if the above is to be generalized, in the ground state, when the electrophoretic display element is made up of n-kinds ("n" is a natural number being 3 or more) of charged particles Cn, . . . , Ck, . . . , C1 (k=2 to n−1), which have a characteristic relationship of |Vth(cn)|< . . . <|Vth(ck)|< . . .

<|Vth(c1)|, where |Vth(cn)| is a threshold value voltage of a charged particle Cn, |Vth(ck)| is a threshold value voltage of a charged particle Ck, and |Vth(c1)| is a threshold value voltage of a charged particle C1, and where a set is performed to a white or black near to a relative color density of charged particle C1 for every display state. Additionally, the LUT used to realize the above driving may be prepared for every group and the COM voltage for determining a reference voltage of a voltage applying unit (data driver) for every sub-frame or a reference voltage of an electrophoretic particle may be changed. By using a fluorescent charged particle as an electrophoretic particle, a color image display device providing more clear and rich coloration can be realized. The present invention can be applied to color electronic paper display devices such as electronic books, electronic newspaper, digital signage and the like.

Appendix 1

An image display device having a memory property including:

a display section including a first substrate in which switching elements and pixel electrodes are arranged in a matrix manner, a second substrate in which facing electrodes are formed, and electrophoretic layers containing electrophoretic particles interposed between the first substrate and the second substrate; and a voltage applying unit to apply a specified voltage, in accordance with driver data to be inputted from a voltage control unit, for a predetermined period to the electrophoretic particles interposed between the pixel electrodes and the facing electrode, at time of renewal of a screen, and to renew a display state of the display section from a current screen to a next screen having a predetermined color density, wherein the electrophoretic particles include 3 kinds of charged particles C, M, and Y which each are different from one another in color and in threshold value voltage for initiating electrophoresis and the charged particles C, M, and Y have a characteristic relationship of |Vth(c)|<|Vk(m)|<|Vth(y)|, where |Vth(c)| is a threshold value voltage of a charged particle C, |Vth(m)| is a threshold value voltage of a charged particle M, and |Vth(y)| is a threshold value voltage of a charged particle Y, and wherein, concerning relative color density information in each pixel making up a next screen in which a display state is renewed, when a relative color density of the charged particle C is Rc, a relative color density of the charged particle M is Rm, and a relative color density of the charged particle Y is Ry, the specified period during which a voltage is applied includes, at least, a resetting period to perform a reset to a ground state, a first sub-frame group period containing at least a sub-frame period during which a first voltage V1 (or −V1) and/or 0V are applied to cause a transition from the ground state to a first intermediate transition state in which a relative color density of the charged particle Y becomes Ry, a second sub-frame group period containing at least a sub-frame during which a second voltage V2 (or −V2) and/or 0V are applied to cause a transition from the first intermediate transition state to a second intermediate transition state in which a relative color density of the charged particle M becomes Rm, with a relative color density of the charged particle Y being held to be Ry, a third sub-frame group period containing at least a sub-frame during which a third voltage V3 (or −V3) and/or 0V are applied to cause a transition from the second intermediate transition state to a renewal display state in which a relative color density of the charged particle C become Rc, with a relative color density of charged particles M and Y being held to be Rm and Ry, and a following formula of a characteristic relationship between the threshold value voltage of each of the charged particles and the voltage to be applied during each of the sub-frame group periods is satisfied:

$$|Vth(c)|<|V3|<|Vth(m)|<|V2|<|Vth(y)|<|V1|.$$

Appendix 2

An image display device having a memory property including:

a display section including a first substrate in which switching elements and pixel electrodes are arranged in a matrix manner, a second substrate in which facing electrodes are formed, and electrophoretic layers containing electrophoretic particles interposed between the first substrate and the second substrate; and a voltage applying unit to apply a specified voltage, in accordance with driver data to be inputted from a voltage control unit, for a predetermined period to the electrophoretic particles interposed between the pixel electrodes and the facing electrode, at time of renewal of a screen, and to renew a display state of the display section from a current screen to a next screen having a predetermined color density, wherein the electrophoretic particles include 3 kinds of charged particles C, M, and Y which each are different from one another in color and in threshold value voltage for initiating electrophoresis and the charged particles C, M, and Y have a characteristic relationship of |Vth(c)|<|Vk(m)|<|Vth(y)|, where |Vth(c)| is a threshold value voltage of a charged particle C, |Vth(m)| is a threshold value voltage of a charged particle M, and |Vth(y)| is a threshold value voltage of a charged particle Y, and wherein, concerning relative color density information in each pixel making up a next screen in which a display state is renewed, when a relative color density of the charged particle C is Rc, a relative color density of charged particle M is Rm, and a relative color density of charged particle Y is Ry, the specified period during which a voltage is applied includes, at least, a resetting period to perform a reset to a ground state, a first sub-frame group period containing at least a sub-frame period during which a first voltage V1 (or −V1) and/or 0V are applied to cause a transition from the ground state to a first intermediate transition state in which a relative color density of the charged particle Y becomes Ry, a second sub-frame group period during which, after a transition occurs, by containing at least a sub-frame period during which a second voltage V2 (or −V2) is applied, from the first intermediate transition state to a second intermediate transition state in which a relative color density of the charged particle M becomes the ground state of 0 or 1, with a relative color density of the charged particle Y being held to be Ry, a transition occurs, by containing at least a sub-frame period during which a second voltage V2 (or −V2) and/or 0V is applied, from the second intermediate transition state to a third intermediate transition state in which a relative color density of the charged particle M becomes Rm, with a relative color density of the charged particle Y being held to be Ry, and a third sub-frame group period during which, after a transition occurs, by containing at least a sub-frame period during which a third voltage V3 (or −V3) is applied, from the third intermediate transition state to a fourth intermediate transition state in which a relative color density of the charged particle C becomes 0 and 1 in the ground state, with a relative color density of charged M and Y being held to be Rm and Ry, a transition occurs, by containing at least a sub-frame period during which a third voltage V3 (or −V3) and/or 0V is applied, from the fourth intermediate transition state to a renewal display state in which a relative color density of the charged particle C becomes Rc, with a relative color density of charged particles M and Y being held to be Rm and Ry, and a following formula of a characteristic relationship between the threshold value voltage of each of the charged particles and the voltage to be applied during each of sub-frame group periods is satisfied:

$$|Vth(c)|<|V3|<|Vth(m)|<|V2|<|Vth(y)|<|V1|.$$

Appendix 3

An image display device having a memory property including:

a display section including a first substrate in which switching elements and pixel electrodes are arranged in a matrix manner, a second substrate in which facing electrodes are formed, and electrophoretic layers containing electrophoretic particles interposed between the first substrate and the second substrate; and a voltage applying unit to apply a specified voltage, in accordance with driver data to be inputted from a voltage control unit, for a predetermined period to the electrophoretic particles interposed between the pixel electrodes and the facing electrode, at time of renewal of a screen, and to renew a display state of the display section from a current screen to a next screen having a predetermined color density, wherein the electrophoretic particles include 3 kinds of charged particles C, M, and Y which each are different from one another in color and in threshold value voltage for initiating electrophoresis and the charged particles C, M, and Y have a characteristic relationship of |Vth(c)|<|Vk(m)|<|Vth(y)|, where |Vth(c)| is a threshold value voltage of a charged particle C, |Vth(m)| is a threshold value voltage of a charged particle M, and |Vth(y)| is a threshold value voltage of a charged particle Y, and wherein, concerning relative color density information in each pixel making up a next screen in which a display state is renewed, when a relative color density of the charged particle C is Rc, a relative color density of the charged particle M is Rm, and a relative color density of the charged particle Y is Ry, the specified period during which a voltage is applied includes, at least, a resetting period to perform a reset to a ground state, a first sub-frame group period containing at least a sub-frame during which a first voltage V1 (or −V1) and/or second voltage V2 (or −V2) and/or 0V are applied to cause a transition from the ground state to a first intermediate transition state in which a relative color density of charged particle Y becomes Ry and a relative color density of the charged particle M becomes the ground state of 0 or 1, and a second sub-frame group period containing at least a sub-frame during which the second voltage V2 (or V2) and a third voltage V3 (or −3V) are applied to cause a transition from the first intermediate transition state to a second intermediate transition state in which a relative color density of the charged particle Y becomes Ry, a relative color density of the charged particle M becomes Rm and a relative color density of charged particle C becomes the ground state of 0 or 1, a third sub-frame group period containing at least a sub-frame during which the third voltage V3 (or −V3) and/or 0V are applied to cause a transition from the second intermediate transition to a renewal display state in which a relative color density of the charged particle C becomes Rc, with a relative color density of the charged particle M and Y being held to be Rm and Ry, and a following formula of a characteristic relationship between the threshold value voltage of each of the charged particles and the voltage to be applied during each of the sub-frame group periods is satisfied:

$$|Vth(c)|<|V3|<|Vth(m)|<|V2|<|Vth(y)|<|V1|.$$

Appendix 4

The image display device having a memory property according to Appendixes 1, 2 or 3, wherein the voltage control unit, when receiving a screen renewing command to renew a current screen to a new screen, starts counting of a sub-frame number and when the sub-frame number is for a resetting period, by referring to a look-up table for the resetting period, outputs the driver data to the voltage applying unit and, when the sub-frame number is a number of a first sub-frame group, based on the relative color density Ry of the charged particle Y and on the sub-frame number, and by referring to the look-up table for a first sub-frame group, abstracts corresponding driver data and outputs the data to the voltage applying unit and, when the sub-frame number is a number of a second sub-frame group, based on the relative color densities Rm and Ry of charged particles M and Y and on the sub-frame number and by referring to a look-up table for the second sub-frame group, abstracts a corresponding driver data and outputs the data to the voltage applying unit, and when the sub-frame number is a number of a third sub-frame group, based on the relative color densities Rm and Rc of the charged particles M and C and on the sub-frame number, and by referring to a look-up table for a third sub-frame group, abstracts corresponding the driver data and outputs the data to the voltage applying unit.

Appendix 5

The image display device having a memory property according to any relevant one of the previous appendixes, wherein, if said ground state, or a given intermediate transition state out of a plurality of said intermediate transition states coincides with said renewal display state, sub-frames and beyond are omitted.

Appendix 6

The image display device having a memory property according to any relevant one of the previous appendixes, wherein said resetting period and each of said sub-frame periods comprise a plurality of sub-frame to be set depending on an intermediate color and/or a number of gray levels.

Appendix 7

The image display device having a memory property according to any relevant one of the previous appendixes, wherein the number of sub-frames making up each of said resetting periods and said sub-frame group periods are to be set according to said display state of a next screen in which a display state is renewed.

Appendix 8

The image display device having a memory property according to any relevant one of the previous appendixes, wherein, in said ground state, a white or black is displayed, the near to a relative color density after being renewed of said charged particle Y, for every display state of a next screen in which a display state is renewed.

Appendix 9

The image display device having a memory property according to any relevant one of the previous appendixes, wherein a reference voltage of said voltage applying unit is varied for every sub-frame.

Appendix 10

The image display device having a memory property according to any relevant one of the previous appendixes, wherein a COM voltage to determine a reference voltage to be applied to said facing electrode, of said electrophoretic particle is varied for every sub-frame.

Appendix 11

The image display device having a memory property according to any relevant one of the previous appendixes, each of said charged particles has a same polarity.

Appendix 12

The image display device having a memory property according to any relevant one of the previous appendixes, wherein, out of said charged particles, a part of particles has a polarity being different from remaining particles.

What is claimed is:

1. An image display device comprising:

a display section including a first substrate in which switching elements and pixel electrodes are arranged in a matrix manner, a second substrate in which facing electrodes are formed, and electrophoretic layers containing electrophoretic particles which are interposed between said first substrate and said second substrate; and a voltage applying unit to apply a specified voltage for a predetermined period to said electrophoretic particles interposed between said pixel electrodes and said facing electrodes at time of renewal of a screen and to renew a display state of said display section from a current screen to a next screen having a predetermined color density, wherein said electrophoretic particles comprise three or more kinds of charged particles which each are different from one another in color and in threshold value voltage for initiating electrophoresis;

wherein said predetermined period during which a said specified voltage is applied comprises, at least, a resetting period in which a resetting voltage is applied, and three or more voltage applying periods, subsequently following said resetting period, which are associated with said three or more kinds of charged particles in a one-to-one correspondence, wherein, in each of voltage applying periods, said voltage applying unit applies, as said specified voltage, (i) |driving voltage|; (ii) 0V; or (iii) |driving voltage| and 0V sequentially; thereby to cause an electrophoresis of a corresponding kind of charged particle, in response to a relative color density of the corresponding kind of charged particle for renewal, said relative color density having any value from "0" to "1", where a threshold value voltage of a kind of charged particles associated with a previous voltage applying period>said |driving voltage|>a threshold value voltage of the corresponding kind of charged particles, voltage applying period increasing with decreasing |driving voltage|, and wherein, at time of renewal of a screen, a relative color density of each of said charged particles is determined in order of a decreasing threshold voltage of the charged particles, according to said predetermined color density of said next screen.

2. The image display device according to claim 1, wherein, in said resetting period or out of said three or more voltage applying periods, during a given voltage applying period except for a final voltage applying period, when an intermediate transition state coincides with a display state of a next screen, voltage applying periods thereafter are omitted.

3. The image display device according to claim 1, wherein said resetting period and each of said voltage applying periods comprise a plurality of sub-frame periods to be set depending on an intermediate color and/or on a number of gray levels.

4. An image display device comprising:

a display section including a first substrate in which switching elements and pixel electrodes are arranged in a matrix manner, a second substrate in which facing electrodes are formed, and electrophoretic layers containing electrophoretic particles which are interposed between said first substrate and said second substrate; and a voltage applying unit to apply a specified voltage for a predetermined period to said electrophoretic particles interposed between said pixel electrodes and said facing electrodes at time of renewal of a screen and to renew a display state of said display section from a current screen to a next screen having a predetermined color density, wherein said electrophoretic particles comprise three or more kinds of charged particles which each are different from one another in color and in threshold value voltage for initiating electrophoresis, wherein said predetermined period during which said specified voltage is applied comprises, at least, a resetting period in which a resetting voltage is applied such that a relative color density of every kind of charged particles becomes a ground state of "0" or "1", and three or more voltage applying periods, subsequently following said resetting period, which are associated with said three or more kinds of charged particles in a one-to-one correspondence, said relative color density having any value from "0" to "1", and said three or more voltage applying periods comprising a first voltage applying period and subsequent two or more voltage applying periods, wherein, in said first voltage applying period, said voltage applying unit applies, as said specified voltage, (i) |driving voltage|; (ii) 0V; or (iii) |driving voltage| and 0V sequentially; thereby to cause an electrophoresis of a corresponding kind of charged particle, in response to a relative color density of the corresponding kind of charged particle for renewal, whereas in each of the subsequent two or more voltage applying periods, said voltage applying unit applies, as said specified voltage, a corresponding partially resetting voltage to be applied such that not-yet-determined relative color density of any kinds of charged particles becomes a ground state of "0" or "1" and subsequently (i) |driving voltage|; ii 0V; or (iii) |driving voltage| and 0V sequentially; thereby to cause an electrophoresis of a corresponding kind of charged particle, in response to a relative color density of the corresponding kind of charged particle for renewal, where a threshold value voltage of a kind of charged particles associated with a previous voltage applying period>said |driving voltage|>a threshold value voltage of the corresponding kind of charged particles, voltage applying period increasing with decreasing |driving voltage|, and wherein, at time of renewal of a screen, a relative color density of each of said charged particles is determined in order of a decreasing threshold voltage of the charged particles, according to said predetermined color density of said next screen.

5. An image display device comprising:

a display section including a first substrate in which switching elements and pixel electrodes are arranged in a matrix manner, a second substrate in which facing electrodes are formed, and electrophoretic layers containing electrophoretic particles which are interposed between said first substrate and said second substrate; and a voltage applying unit to apply a specified voltage for a predetermined period to said electrophoretic particles interposed between said pixel electrodes and said facing electrodes at time of renewal of a screen and to renew a display state of said display section from a current screen to a next screen having a predetermined color density, wherein said electrophoretic particles comprise three or more kinds of charged particles which each are different from one another in color and in threshold value voltage for initiating electrophoresis, wherein said predetermined period during which said specified voltage is applied comprises, at least, a resetting period in which a resetting voltage is applied such that a relative color density of every kind of charged particles becomes a ground state of "0" or "1", and three or more voltage applying periods, subsequently following said resetting period, which are associated with said three or more kinds of charged particles in a one-to-one correspondence, said relative color density having any value from "0" to "1", and said three or more voltage applying periods comprising preceding two or more voltage applying periods and a final voltage applying period, wherein, in each of the preceding two or more voltage applying periods, said voltage applying unit applies, as said specified voltage, a corresponding partially resetting voltage to be applied such that not-yet-determined relative color density of any kinds of charged particles becomes a ground state of "0" or "1" and subsequently (i) |driving voltage|; (ii) 0V; or (iii) |driving voltage| and 0V sequentially; thereby to cause an electrophoresis of a corresponding kind of charged particle, in response to a relative color density of the corresponding kind of charged particle for renewal, whereas in the final voltage applying period, said voltage applying unit applies, as said specified voltage, (i) |driving voltage|; (ii) 0V; or (iii) |driving voltage| and 0V sequentially; thereby to cause an electrophoresis of a corresponding kind of charged particle, in response to a relative color density of the corresponding kind of charged particle for renewal, where a threshold value voltage of a kind of charged particles associated with a previous voltage applying period>said |driving voltage|>a threshold value voltage of the corresponding kind of charged particles, voltage applying period increasing with decreasing |driving voltage|, and wherein, at time of renewal of a screen, a relative color density of each of said charged particles is determined in order of a decreasing threshold voltage of the charged particles, according to said predetermined color density of said next screen.

6. An image display device comprising:

a display section including a first substrate in which switching elements and pixel electrodes are arranged in a matrix manner, a second substrate in which facing electrodes are formed, and electrophoretic layers containing electrophoretic particles interposed between said first substrate and said second substrate; and a voltage applying unit to apply a specified voltage for a predetermined period to said electrophoretic particles interposed between said pixel electrodes and said facing electrodes at time of renewal of a screen and to renew a display state of said display section from a current screen to a next screen having a predetermined color density, and wherein said electrophoretic particles comprise 3 kinds of charged particles C, M, Y having colors and threshold value voltages for initiating electrophoresis each being different from one another and having a characteristic relationship of $|Vth(c)|<|Vk(m)|<|Vth(y)|$, where $|Vth(c)|$ is a threshold value voltage of a charged particle C, $|Vth(m)|$ is a threshold value voltage of a charged particle M, and $|Vth(y)|$ is a threshold value voltage of a charged particle Y, and wherein, concerning relative color density information in each pixel making up a next screen in which a display state is renewed, when a relative color density of said charged particle C is Rc, a relative color density of said charged particle M is Rm, and a relative color density of said charged particle Y is Ry, said relative color density Rc, Rm, Ry having any value from "0" to "1", said predetermined period during which said specified voltage is applied comprises, at least, a resetting period during which a resetting voltage is applied to perform a reset to a ground state, a first voltage applying period during which (i) a first voltage $|V1|$; (ii) 0V; or (iii) $|V1|$ and 0V sequentially are applied to cause a transition from said ground state to a first intermediate transition state in which a relative color density of said charged particle Y becomes Ry, a second voltage applying period during which (i) a second voltage $|V2|$; (ii) 0V; or (iii) $|V2|$ and 0V sequentially are applied, with a relative color density of said charged particle Y being held to be Ry, to cause a transition from said first intermediate transition state to a second intermediate transition state in which a relative color density of said charged particle M becomes Rm, and a third voltage applying period during which (i) a third voltage $|V3|$; (ii) 0V; or (iii) $|V3|$ and 0V sequentially are applied, with relative color densities of said charged particle M and Y being held to be Rm and Ry, to cause a transition from said second intermediate transition state to a renewal display state in which a relative color density of said charged particle C becomes Rc, and a following formula of a characteristic relationship between said threshold value voltage of each of said charged particles and said voltage to be applied during each of said voltage applying periods is satisfied: $|Vth(c)|<|V3|<|Vth(m)|<|V2|<|Vth(y)|<|V1|$, and first voltage applying period<second voltage applying period<third voltage applying period.

7. An image display device comprising:

a display section including a first substrate in which switching elements and pixel electrodes are arranged in a matrix manner, a second substrate in which facing electrodes are formed, and electrophoretic layers containing electrophoretic particles which are interposed between said first substrate and said second substrate; and a voltage applying unit to apply a specified voltage for a predetermined period to said electrophoretic particles interposed between said pixel electrodes and said facing electrodes at time of renewal of a screen and to renew a display state of said display section from a current screen to a next screen having a predetermined color density, wherein said electrophoretic particles comprise 3 kinds of charged particles C, M, and Y having colors and threshold value voltages for initiating electrophoresis each being different from one another and having a characteristic relationship of $|Vth(c)|<|Vk(m)|<|Vth(y)|$, where $|Vth(c)|$ is a threshold value voltage of a charged particle C, $|Vth(m)|$ is a threshold value voltage of a charged particle M, and $|Vth(y)|$ is a threshold value voltage of a charged particle Y, and wherein, concerning relative color density information in each pixel making up a next screen in which a display state is renewed, when a relative color density of said charged particle C is Rc, a relative color density of said charged particle M is Rm, and a relative color density of said charged particle Y is Ry, said relative color density Rc, Rm, Ry having any value from "0" to "1", said predetermined period during which said specified voltage is applied comprises, at least, a resetting period during which a resetting voltage is applied to perform a reset to a ground state, a first voltage applying period during which (i) a first voltage $|V1|$; (ii) 0V; or (iii) $|V1|$ and 0V sequentially are applied to cause a transition from said ground state to a first intermediate transition state in which a relative color density of said charged particle Y becomes Ry, a second voltage applying period during which, after a transition occurs, by application of (i) said second voltage $|V2|$; (ii) 0V; or (iii) $|V2|$ and 0V sequentially, from said first intermediate transition to a second intermediate transition state in which a relative color density of said charged particle M becomes said ground state of 0 or 1, with a relative color density of said charged particle Y being held to be Ry, a transition occurs, by (i) said second voltage $|V2|$; (ii) 0V; or (iii) $|V2|$ and 0V sequentially, from said second transition state to a third intermediate transition state in which a relative color density of said charged particle M becomes Rm, with a relative color density of said charged particle Y being held to be Ry, a third voltage applying period during which, after a transition occurs, by application of said third voltage $|V3|$ from said third intermediate transition state to a fourth intermediate transition state in which the relative color density of said charged particle C becomes 0 or 1, with a relative color density of said charged particles M and Y being held to be Rm and Ry, a transition occurs, by application of (i) said third voltage $|V3|$; (ii) 0V; or (iii) $|V3|$ and 0V sequentially, from said fourth intermediate transition state to a renewal display state in which said relative color density of said charged particle C becomes Rc, with said relative color density of said charged particles M and Y still being held to be Rm and Ry, and a following formula of a characteristic relationship between said threshold value voltage of each of said charged particles and said voltage to be applied during each of said voltage applying periods is satisfied:

$|Vth(c)|<|V3|<|Vth(m)\sqrt[3]{}<|V2|<|Vth(y))|<|V1|$, and first voltage applying period<second voltage applying period<third voltage applying period.

8. An image display device comprising:

a display section including a first substrate in which switching elements and pixel electrodes are arranged in a matrix manner, a second substrate in which facing electrodes are formed, and electrophoretic layers containing electrophoretic particles which are interposed between said first substrate and said second substrate; and a voltage applying unit to apply a specified voltage for a predetermined period to said electrophoretic particles interposed between said pixel electrodes and said facing electrodes at time of renewal of a screen and to renew a display state of said display section from a current screen to a next screen having a predetermined color density, wherein said electrophoretic particles comprise 3 kinds of charged particles C, M, and Y having colors and threshold value voltages for initiating electrophoresis each being different from one another and having a characteristic relationship of $|Vth(c)|<|Vk(m)|<|Vth(y)|$, where $|Vth(c)|$ is a threshold value voltage of a charged particle C, $|Vth(m)|$ is a threshold value voltage of a charged particle M, and $|Vth(y)|$ is a threshold value voltage of a charged particle Y, and wherein, concerning relative color density information in each pixel making up a current screen to which a display state is renewed, when a relative color density of said charged particle C is Rc, a relative color density of said charged particle M is Rm, and a relative color density of said charged particle Y is Ry, said relative color density Rc, Rm, Ry having any value from "0" to "1", said predetermined period during which a said specified voltage is applied comprises, at least, a resetting period during which a resetting a voltage is applied to perform a reset, a first voltage applying period during which (i) a first voltage $|V|$; (ii) a second voltage $|V2|$; (iii) 0V; or (iv) two or more of $|V1|$, $|V2|$ and 0V sequentially are applied to cause a transition to a first intermediate transition state in which a relative color density of said charged particle Y becomes Ry and a relative color density of said charged particle M becomes 0 or 1, and a second voltage applying period during which said second voltage $|V2|$ and a third voltage $|V3|$ are applied to cause a transition from said first intermediate transition state to a second intermediate transition state in which a ground state occurs where said relative color density of said charged particle Y becomes Ry, said relative color density of said charged particle M becomes Rm, and said relative color density of said charged particle C becomes 0 or 1, and a third voltage applying period during which (i) said third voltage $|V3|$; (ii) 0V; or (iii) $|V3|$ and 0V sequentially are applied to cause a transition, with a relative color density of said charged particles M and Y being still held to be Rm and Ry, from said second intermediate transition state to a renewal display state in which said relative color density of said charged particle C becomes Rc, and a following formula of a characteristic relationship between said threshold value voltage of each of said charged particles and said voltage to be applied during each of said voltage applying periods is satisfied: Vth(c) |<|V3|<|Vth(m)|<|V2|<|Vth(y))|<|V1|, and first voltage applying period<second voltage applying period<third voltage applying period.

9. An image display device comprising:

a display section including a first substrate in which switching elements and pixel electrodes are arranged in a matrix manner, a second substrate in which facing electrodes are formed, and electrophoretic layers containing electrophoretic particles interposed between said first substrate and said second substrate; and a voltage applying unit to apply a specified voltage, in accordance with driver data to be inputted from a voltage control unit, for a predetermined period to said electrophoretic particles interposed between said pixel electrodes and said facing electrodes at time of renewal of a screen and to renew a display state of said display section from a current screen to a next screen having a predetermined color density, wherein said electrophoretic particles comprise three or more kinds of charged particles which each are different from one another in color and in threshold value voltage for initiating electrophoresis;

wherein said predetermined period during which said specified voltage is applied comprises, at least, a resetting period in which a resetting voltage is applied, and three or more sub-frame group periods, subsequently following said resetting period, which are associated with said three or more kinds of charged particles in a one-to-one correspondence, wherein each of sub-frame group periods comprises a plurality of sub-frames during which said voltage applying unit applies, as said specified voltage, |driving voltage| or 0V sequentially to cause an electrophoresis of a corresponding kind of charged particle, in response to a relative color density of the corresponding kind of charged particle for renewal, said relative color density having any value from "0" to "1", where a threshold value voltage of a kind of charged particles associated with a previous sub-frame group period>said |driving voltage|>a threshold value voltage of the corresponding kind of charged particles, sub-frame group period increasing with decreasing |driving voltage|, and wherein, at time of renewal of a screen, a relative color density of each of said charged particles is determined in order of a decreasing threshold voltage of the charged particles, according to said predetermined color density of said next screen.

10. An image display device comprising:

a display section including a first substrate in which switching elements and pixel electrodes are arranged in a matrix manner, a second substrate in which facing electrodes are formed, and electrophoretic layers containing electrophoretic particles interposed between said first substrate and said second substrate; and a voltage applying unit to apply a specified voltage, in accordance with driver data to be inputted from a voltage control unit, for a predetermined period to said electrophoretic particle interposed between said pixel electrodes and said facing electrodes at time of renewal of a screen and to renew a display state of said display section from a current screen to a next screen having a predetermined color density, wherein said electrophoretic particles comprise three or more kinds of charged particles which each are different from one another in color and in threshold value voltage for initiating electrophoresis and threshold value voltages for initiating electrophoresis, wherein said predetermined period during which said specified voltage is applied comprises, at least, a resetting period in which a resetting voltage is applied such that a relative color density of every kind of charged particles becomes a ground state of "0" or "1", and three or more sub-frame group periods, subsequently following said resetting period, which are associated with said three or more kinds of charged particles in a one-to-one correspondence, said relative color density having any value from "0" to "1", and said three or more sub-frame group periods comprising a first sub-frame group period and subsequent two or more sub-frame group periods, wherein, said first sub-frame group period comprises a plurality of sub-frames that said voltage applying unit applies, as said specified voltage, |driving voltage| or 0V sequentially to cause an electrophoresis of a corresponding kind of charged particle, in response to a relative color density of the corresponding kind of charged particle for renewal, whereas each of the subsequent two or more sub-frame group periods comprises a plurality of sub-frames that said voltage applying unit applies, as said specified voltage, a corresponding partially resetting voltage to be applied such that not-yet-determined relative color density of any kinds of charged particles becomes a ground state of "0" or "1" and subsequently |driving voltage| or 0V sequentially to cause an electrophoresis of a corresponding kind of charged particle, in response to a relative color density of the corresponding kind of charged particle for renewal, where a threshold value voltage of a kind of charged particles associated with a previous sub-frame group period>said |driving voltage|>a threshold value voltage of the corresponding kind of charged particles, sub-frame group period increasing with decreasing |driving voltage|, and wherein, at time of renewal of a screen, a relative color density of each of said charged particles is determined in order of a decreasing threshold voltage of the charged particles, according to said predetermined color density of said next screen.

11. An image display device comprising:

a display section including a first substrate in which switching elements and pixel electrodes are arranged in a matrix manner, a second substrate in which facing electrodes are formed, and electrophoretic layers containing electrophoretic particles interposed between said first substrate and said second substrate; and a voltage applying unit to apply a specified voltage, in accordance with driver data to be inputted from a voltage control unit, for a predetermined period, to said electrophoreic particles interposed between said pixel electrode and said facing electrode, at time of renewal of a screen, and to renew a display state of said display section from a current screen to a next screen having a predetermined color density, wherein said electrophoretic particles comprise three or more kinds of charged particles which each are different from one another in color and in threshold value voltage for initiating electrophoresis, wherein said predetermined period during which said specified voltage is applied comprises, at least, a resetting period in which a resetting voltage is applied such that a relative color density of every kind of charged particles becomes a ground state of "0" or "1", and three or more sub-frame group periods, subsequently following said resetting period, which are associated with said three or more kinds of charged particles in a one-to-one correspondence, said relative color density having any value from "0" to "1", and said three or more sub-frame group periods comprising preceding two or more sub-frame group periods and a final sub-frame group period, wherein each of the preceding two or more sub-frame group periods comprises a plurality of sub-frames that said voltage applying unit applies, as said specified voltage, a corresponding partially resetting voltage to be applied such that not-yet-determined relative color density of any kinds of charged particles becomes a ground state of "0" or "1" and subsequently |driving voltage| or 0V sequentially to cause an electrophoresis of a corresponding kind of charged particle, in response to a relative color density of the corresponding kind of charged particle for renewal, whereas the final sub-frame group period comprises a plurality of sub-frames that said voltage applying unit applies, as said specified voltage, |driving voltage| or 0V sequentially to cause an electrophoresis of a corresponding kind of charged particle, in response to a relative color density of the corresponding kind of charged particle for renewal, where a threshold value voltage of a kind of charged particles associated with a previous sub-frame group period>said |driving voltage|>a threshold value voltage of the corresponding kind of charged particles, sub-frame group period increasing with decreasing |driving voltage|, and wherein, at time of renewal of a screen, a relative color density of each of said charged particles is determined in order of a decreasing threshold voltage of the charged particles, according to said predetermined color density of said next screen.

12. An image display device according to claim 9, wherein said voltage control unit, when receiving a screen renewing command to renew a current screen to a next screen, starts counting of a sub-frame number, when said sub-frame number is for a resetting period, by referring to a look-up table for resetting period, outputs said driver data to said voltage applying unit, and when said sub-frame number is a number of a first sub-frame group, based on said relative color density R1 of said charged particle C1 and on said sub-frame number, and by referring to a look-up table for said first sub-frame group, retrieves corresponding driver data and outputs said data to said voltage applying unit, and when said sub-frame number is a number of a k-th (k=2 to "n−1"-th) sub-frame group, based on said relative color densities Rk and Rk−1 of charged particles Ck and Ck−1, respectively, and on a sub-frame number and by referring to a look-up table for a k-th sub-frame group, retrieves corresponding said driver data and sequentially outputs the data to said voltage applying unit, and when said sub-frame number is a number for an n-th sub-frame group, based on said relative color densities Rn and Rn−1 of said charged particles Cn and Cn−1 and on said sub-frame number and by referring to a look-up table for said second sub-frame group, retrieves corresponding said driver data and outputs said data to said voltage applying unit.

13. An image display device comprising:

a display section including a first substrate in which switching elements and pixel electrodes are arranged in a matrix manner, a second substrate in which facing electrodes are formed, and electrophoretic layers containing electrophoretic particles interposed between said first substrate and said second substrate;

and a voltage applying unit to apply a specified voltage for a predetermined period to said electrophoretic particles interposed between said pixel electrodes and said facing electrodes at time of renewal of a screen and to renew a display state of said display section from a current screen to a next screen having a predetermined color density, wherein said electrophoretic particles comprise 2 kinds of charged particles C and R which each are different from one another in color and in threshold value voltage for initiating electrophoresis and said charged particles have a characteristic relationship of |Vth(c)|<|Vth(r)|, where |Vth(c)| is a threshold value voltage of a charged particle C and |Vth(r)| is a threshold value voltage of a charged particle R, wherein, concerning relative color density information in each pixel making up a next screen in which a display state is renewed, when a relative color density of said charged particle C is Rc, and a relative color density of said charged particle R is Rr, said relative color density Rc, Rr having any value from "0" to "1", said predetermined period during which a said specified voltage is applied comprises, at least, a resetting period during which a resetting voltage is applied to perform a reset to a ground state, a first sub-frame group period containing a sub-frame during which (i) a first voltage |V1|; (ii) 0V; or (iii) |V1| and 0V sequentially are applied to cause a transition from said ground state to an intermediate transition state in which a color density of said charged particle R becomes Rr, and a second sub-frame group period containing at least a sub-frame during which (i) a second voltage |V2|; (ii) 0V; or (iii) |V2| and 0V sequentially are applied to cause a transition to a renewal display state in which a relative color density of said charged particle C becomes Rc, with the relative color density of charged particle R being held to be Rr, and voltages |V1| and |V2| satisfy a formula of a characteristic relationship of |Vth(c)|<|V2|<|Vth(r)|<|V1|, and first sub-frame group period<second sub-frame group period.

14. The image display device according to claim 9, wherein, in said resetting period or out of said three or more sub-frame group periods, during a given sub-frame group period except for a final sub-frame group period, when an intermediate transition state coincides with a display state of a next screen, sub-frame group periods thereafter are omitted.

15. The image display device according to claim 9, wherein said resetting period and each of said sub-frame group periods comprise a plurality of sub-frame to be set depending on an intermediate color and/or a number of gray levels.

16. The image display device according to claim 9, wherein the number of sub-frames making up each of said resetting periods and said sub-frame group periods are to be set according to said display state of a next screen in which a display state is renewed.

17. The image display device according to claim 1, wherein, in said ground state, a white or black is displayed, the white or black near to a relative color density of the charged particle having a highest threshold voltage after being renewed, for every display state of a next screen in which a display state is renewed.

18. The image display device according to claim 9, wherein a reference voltage of said voltage applying unit is varied for every sub-frame.

19. The image display device according to claim 9, wherein a COM voltage to determine a reference voltage to be applied to said facing electrode, of said electrophoretic particle is varied for every sub-frame.

20. The image display device according to claim 1, each kind of said charged particles has a same polarity.

21. The image display device according to claim 1, wherein, out of said charged particles, a part of charged particles has a polarity being different from remaining charged particles.

* * * * *